US006377915B1

(12) United States Patent
Sasaki

(10) Patent No.: US 6,377,915 B1
(45) Date of Patent: Apr. 23, 2002

(54) SPEECH DECODING USING MIX RATIO TABLE

(75) Inventor: Seishi Sasaki, Yokosuka (JP)

(73) Assignee: YRP Advanced Mobile Communication Systems Research Laboratories Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/525,066

(22) Filed: Mar. 14, 2000

(30) Foreign Application Priority Data

Mar. 17, 1999 (JP) ..... 11-072062
Aug. 6, 1999 (JP) ..... 11-223804

(51) Int. Cl.[7] ..... G10L 11/06
(52) U.S. Cl. ..... 704/206; 704/208
(58) Field of Search ..... 704/207–209, 704/205, 206; 714/701, 752; 708/203

(56) References Cited

U.S. PATENT DOCUMENTS 5,870,405 A * 2/1999 Hardwick et al. ..... 714/701

FOREIGN PATENT DOCUMENTS

JP 2711737 10/1997

OTHER PUBLICATIONS

"A Mixed Excitation LPC Vocoder Model for Low BitRate Speech Coding" by A. V. McCree; IEEE Transactions on Speech and Audio Processing, vol. 3, No. 4, Jul. 1995; pp., 242–250.

"Selective Modeling of the LPC Residual During Unvoiced Frames: White Noise or Pulse Excitation" by thomson et al.; 1986 IEEE; pp., 3087–3090.

"Melp: The New Federal Standard at 2400 BPS" by L. M. Supplee et al.; 1997 IEEE; pp., 1591–1594.

"Analog to Digital Conversion of Voice by 2,400 Bit/Second Mixed Excitation Linear Prediction" May 28, 1998 Draft; pp., 1–35.

"Analog to Digital Conversion of Voice by 2,400 Bit/Second Linear Predictive Coding"; Federal Standard 1015; Nov. 28, 1984; pp., 1–8.

* cited by examiner

*Primary Examiner*—David D. Knepper
(74) *Attorney, Agent, or Firm*—Lowe Hauptman Gilman & Berner, LLP

(57) ABSTRACT

A decoder compares a spectral envelope value y8 on a frequency axis with a predetermined threshold f9 to identify a voiced region and an unvoiced region. An excitation signal is produced by using excitations suitable for respective frequency regions. An encoder applies the nonuniform quantization to the period of the aperiodic pitch in accordance with its frequency of occurrence. The result of the nonuniform quantization is transmitted together with the quantization result of the unvoiced state and the periodic pitch as one code. A decoder obtains spectral envelope amplitude l8' from the spectral envelope information, and identifies a frequency band e10' where the spectral envelope amplitude value is maximized in each of respective bands divided on the frequency axis. A mixing ratio g8', which is used in mixing a pitch pulse generated in response to the pitch period information and white noise, is determined based on the identified frequency band and voiced/unvoiced discriminating information. A mixing signal of each frequency band is produced in accordance with the mixing ratio. Then, the mixing signals of respective frequency bands are summed up to produce a mixed excitation signal x8'.

6 Claims, 18 Drawing Sheets

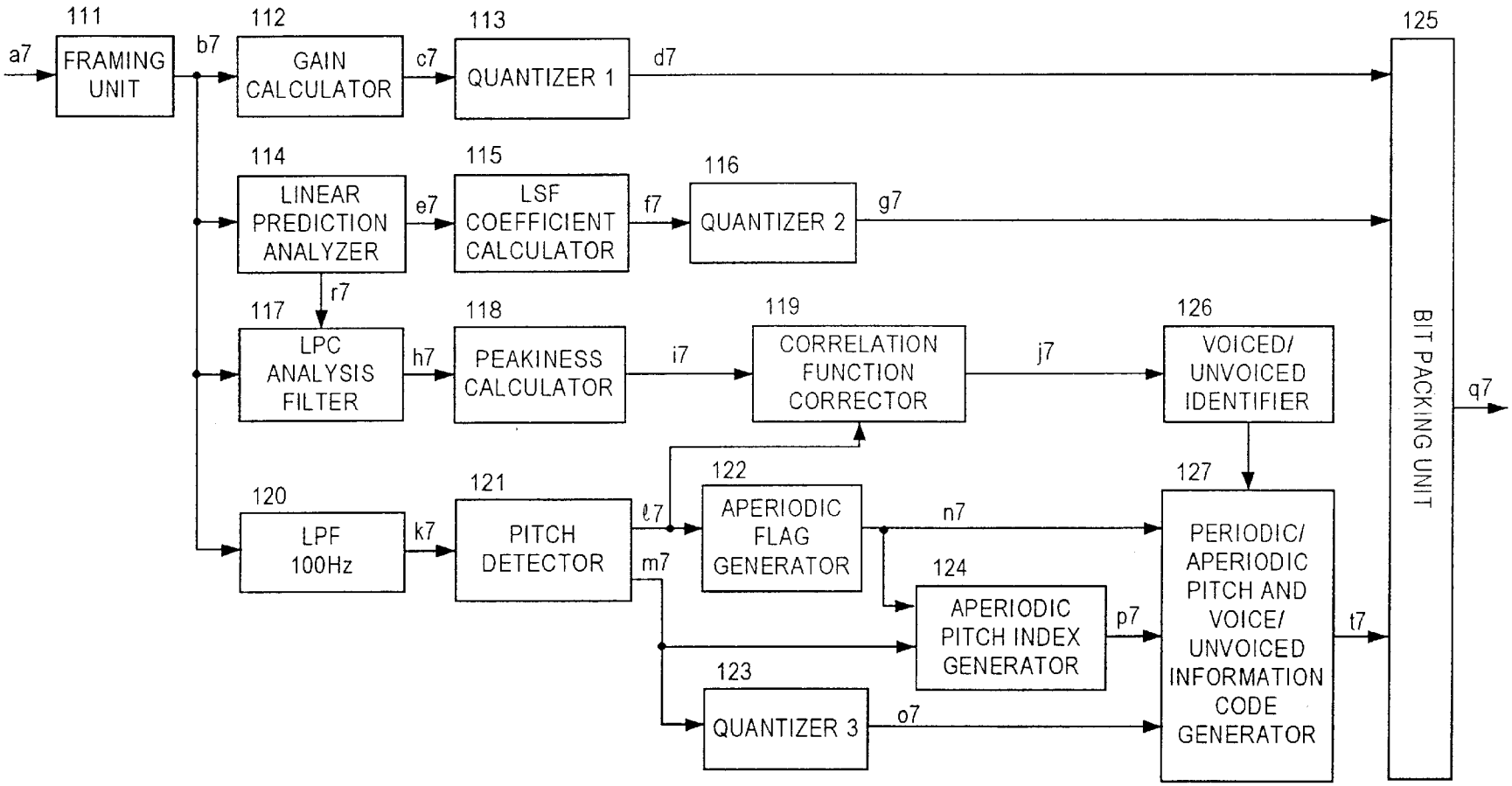
FIG. 1
a7
111
FRAMING UNIT
b7
112
GAIN CALCULATOR
c7
113
QUANTIZER 1
d7
114
LINEAR PREDICTION ANALYZER
e7
115
LSF COEFFICIENT CALCULATOR
f7
116
QUANTIZER 2
g7
r7
117
LPC ANALYSIS FILTER
h7
118
PEAKINESS CALCULATOR
i7
119
CORRELATION FUNCTION CORRECTOR
j7
120
LPF 100Hz
k7
121
PITCH DETECTOR
ℓ7
m7
122
APERIODIC FLAG GENERATOR
n7
123
QUANTIZER 3
o7
124
APERIODIC PITCH INDEX GENERATOR
p7
125
BIT PACKING UNIT
q7
126
VOICED/ UNVOICED IDENTIFIER
127
PERIODIC/ APERIODIC PITCH AND VOICE/ UNVOICED INFORMATION CODE GENERATOR
t7

SPECTRAL ENVELOPE SHAPE

DFT RESULT OF SINGLE PULSE

OUTPUT (SOLID LINE=r8, DOTTED LINE=s8 OF MIXED EXCITATION FILTERING UNIT

DFT RESULT OF WHITE NOISE

OUTPUT (t8) OF NOISE EXCITATION FILTERING UNIT

SPECTRUM OF OUTPUT (a9) OF MIXED EXCITATION GENERATOR 3

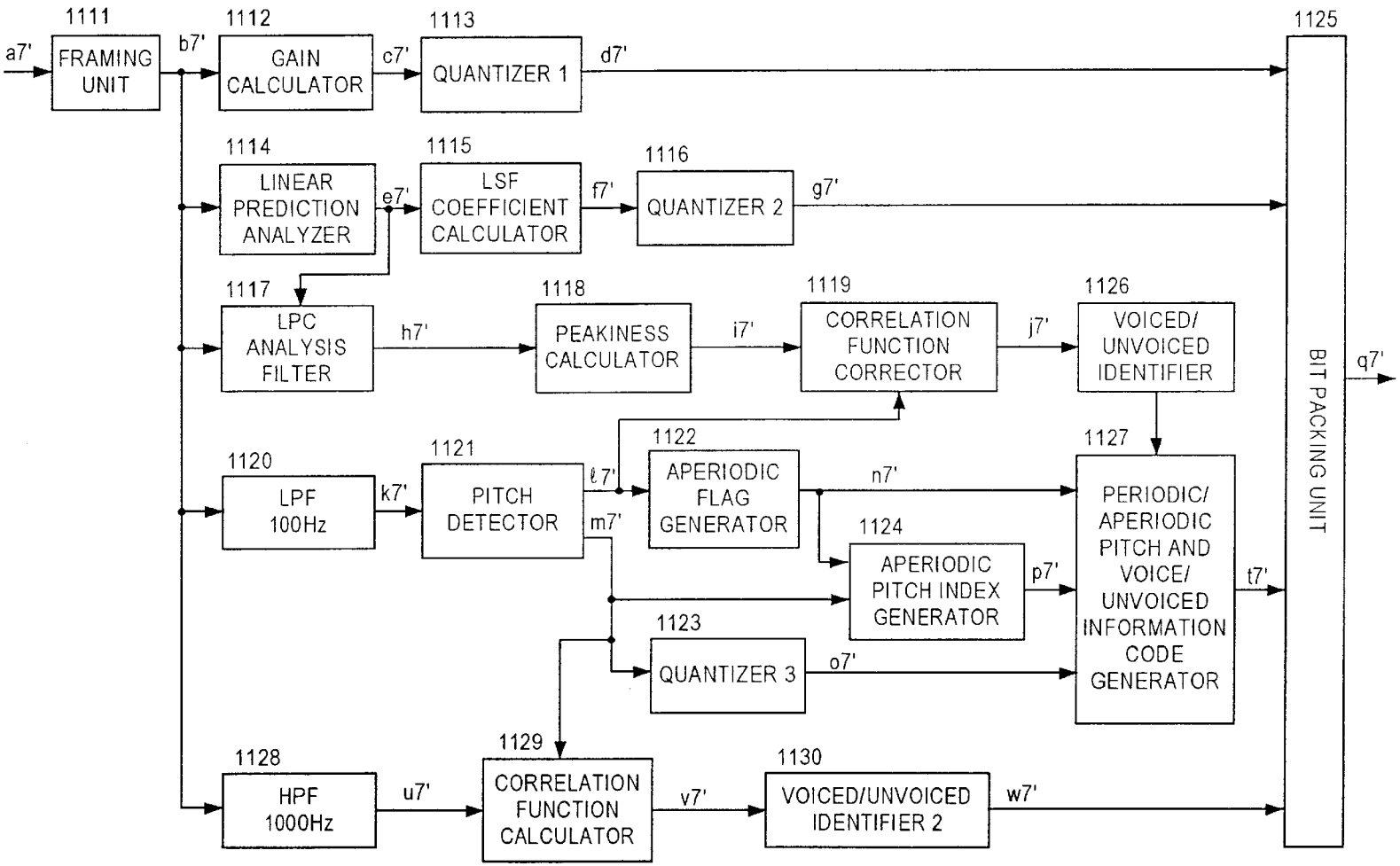
FIG. 9
a7'
1111
FRAMING UNIT
b7'
1112
GAIN CALCULATOR
c7'
1113
QUANTIZER 1
d7'
1114
LINEAR PREDICTION ANALYZER
e7'
1115
LSF COEFFICIENT CALCULATOR
f7'
1116
QUANTIZER 2
g7'
1117
LPC ANALYSIS FILTER
h7'
1118
PEAKINESS CALCULATOR
i7'
1119
CORRELATION FUNCTION CORRECTOR
j7'
1120
LPF 100Hz
k7'
1121
PITCH DETECTOR
ℓ7'
m7'
1122
APERIODIC FLAG GENERATOR
n7'
1123
QUANTIZER 3
o7'
1124
APERIODIC PITCH INDEX GENERATOR
p7'
1125
BIT PACKING UNIT
q7'
1126
VOICED/ UNVOICED IDENTIFIER
1127
PERIODIC/ APERIODIC PITCH AND VOICE/ UNVOICED INFORMATION CODE GENERATOR
t7'
1128
HPF 1000Hz
u7'
1129
CORRELATION FUNCTION CALCULATOR
v7'
1130
VOICED/UNVOICED IDENTIFIER 2
w7'

2ND, 3RD, 4TH SUB-BAND VOICING STRENGTH (FOR VOICED STATE)

2ND, 3RD, 4TH SUB-BAND VOICING STRENGTH (FOR UNVOICED STATE)

(PRIOR ART)

SPEECH DECODING USING MIX RATIO TABLE

BACKGROUND OF THE INVENTION

The present invention relates to speech coding and decoding method for encoding and decoding a speech signal at a low bit rate, and relates to speech coding and decoding apparatus capable of encoding and decoding a speech signal at a low bit rate.

The low bit rate speech coding system conventionally known is 2.4 kbps LPC (i.e., Linear Predictive Coding) or 2.4 kbps MELP (i.e., Mixed Excitation Linear Prediction). Both of these coding systems are the speech coding systems in compliance with the United States Federal Standard. The former is already standardized as FS-1015. The latter is selected in 1997 and standardized as a sound quality improved version of FS-1015.

The following references relate to at least either of 2.4 kbps LPC system and 2.4 kbps MELP system.

[1] FEDERAL STANDARD 1015, "ANALOG TO DIGITAL CONVERSATION OF VOICE BY 2,400 BIT/SECOND LINEAR PREDICTIVE CODING," Nov. 28, 1984

[2] Federal Information Processing Standards publication, "Analog to Digital Conversation of Voice by 2,400 Bit/Second Mixed Excitation Linear Prediction," May 28, 1998 Draft

[3] L. Supplee, R. Cohn, J. Collura and A. McCree, "MELP: The new federal standard at 2,400 bps," Proc. ICASSP, pp.1591–1594, 1997

[4] A. McCree and T. Barnwell III, "A Mixed Excitation LPC Vocoder Model for Low Bit Rate Speech Coding," IEEE TRANSACTIONS ON SPEECH AND AUDIO PROCESSING, VOL. 3, No. 4, pp.242–250, July 1995

[5] D. Thomson and D. Prezas, "SELECTIVE MODELING OF THE LPC RESIDUAL DURING UNVOICED FRAMES: WHITE NOISE OR PULSE EXCITATION," Proc. ICASSP, pp.3087–3090, 1986

[6] Seishi Sasaki and Masayasu Miyake, "Decoder for a Linear Predictive Analysis/synthesis System," Japanese Patent No. 2,711,737 corresponding to the first Japanese Patent Publication No. 03-123,400 published on May 27, 1991.

First, the principle of 2.4 kbps LPC system will be explained with reference to FIGS. 18 and 19 (details of the processing can be found in the above reference [1]).

FIG. 18 is a block diagram showing the circuit arrangement of an LPC type speech encoder. A framing unit 11 is a buffer which stores an input speech sample al having being bandpass-limited to the frequency range of 100–3,600 Hz and sampled at the frequency of 8 kHz and then quantized to the accuracy of at least 12 bits. The framing unit 11 fetches the speech samples (180 samples) for every single speech coding frame (22.5 ms), and sends an output b1 to a speech coding processing section.

Hereinafter, the processing performed for every single speech coding frame will be explained.

A pre-emphasis unit 12 processes the output b1 of the framing unit 11 to emphasize the high-frequency band thereof, and produces a high-frequency band emphasized signal c1. A linear prediction analyzer 13 performs the linear predictive analysis on the received high-frequency band emphasized signal c1 by using the Durbin-Levinson method. The linear prediction analyzer 13 outputs a $10^{th}$ order reflection coefficient d1 which serves as spectral envelope information. A first quantizer 14 applies the scholar quantization to the $10^{th}$ order reflection coefficient d1 for each order. The first quantizer 14 sends the quantization result e1 of a total of 41 bits to an error correction coding/bit packing unit 19. Table 1 shows the bit allocation for the reflection coefficients of respective orders.

An RMS (i.e., Root Mean Square) calculator 15 calculates an RMS value representing the level information of the high-frequency band emphasized signal c1 and outputs a calculated RMS value f1. A second quantizer 16 quantizes the RMS value f1 to 5 bits, and outputs a quantized result g1 to the error correction coding/bit packing unit 19.

A pitch detection/voicing unit 17 receives the output b1 of the framing unit 11 and outputs a pitch period h1 (ranging from 20 to 156 samples corresponding to 51–400 Hz) and voicing information i1 (i.e., information for discriminating voiced, unvoiced, and transitional periods). A third quantizer 18 quantizes the pitch period h1 and the voicing information i1 to 7 bits, and outputs a quantized result j1 to the error correction coding/bit packing unit 19. The quantization (i.e., allocation of the pitch information and the voicing information to the 7-bit codes, i.e., a total of 128 codewords) is performed in the following manner. The codeword having 0 in all of the 7 bits and seven codewords having 1 in only one of the 7 bits are allocated to the unvoiced state. The codeword having 1 in all of the 7 bits and seven codewords having 0 in only one of the 7 bits are allocated to the transitional state. Other codewords are used for the voiced state and allocated to the pitch period information.

The error correction coding/bit packing unit 19 packs the received information, i.e., all of the quantization result e1, the quantized result g1, and quantized result j1, into a 54 bit/frame to constitute a speech coding information frame. Thus, the error correction coding/bit packing unit 19 outputs a bit stream k1 consisting of 54 bits per frame. The produced speech information bit stream k1 is transmitted to a receiver via a modulator and a wireless device in case of the radio communications.

Table 1 shows the bit allocation per frame. As understood from this table, the error correction coding/bit packing unit 19 transmits the error correction code (20 bits) when the voicing of the current frame does not indicate the voiced state (i.e., when the voicing of the current frame indicates the unvoiced or transitional period), instead of transmitting $5^{th}$ to $10^{th}$ order reflection coefficients. When current frame is the unvoiced or transitional period, the information to be error protected is upper 4 bits of the RMS information and the $1^{st}$ to $4^{th}$ order reflection coefficient information. The sync bit of 1 bit is added to each frame.

TABLE 1

2.4 kbps LPC type Bit Allocation

| parameters | voiced frame | unvoiced frame |
|---|---|---|
| reflection coefficient (1st order) | 5 | 5 |
| reflection coefficient (2nd order) | 5 | 5 |
| reflection coefficient (3rd order) | 5 | 5 |
| reflection coefficient (4th order) | 5 | 5 |
| reflection coefficient (5th order) | 4 | — |
| reflection coefficient (6th order) | 4 | — |
| reflection coefficient (7th order) | 4 | — |
| reflection coefficient (8th order) | 4 | — |
| reflection coefficient (9th order) | 3 | — |
| reflection coefficient (10th order) | 2 | — |
| pitch and voicing information | 7 | 7 |

TABLE 1-continued 2.4 kbps LPC type Bit Allocation

| parameters | voiced frame | unvoiced frame |
|---|---|---|
| RMS | 5 | — |
| error protection | — | 20 |
| sync bit | 1 | 1 |
| unused | — | 1 |
| total bits/22.5 ms frame | 54 | 54 |

Next, a circuit arrangement of an LPC type speech decoder will be explained with reference to FIG. 19.

A bit separating/error correcting decoder 21 receives a speech information bit stream a2 consisting of 54 bits for each frame and separates it into respective parameters. When the current frame is an unvoiced or in voicing transition, the bit separating/error correcting decoder 21 applies the error correction decoding processing to the corresponding bits. As a result of the above processing, the bit separating/error correcting decoder 21 outputs a pitch/voicing information bit b2, a $10^{th}$ order reflection coefficient information bit e2 and an RMS information bit g2.

A pitch/voicing information decoder 22 decodes the pitch/voicing information bit b2, and outputs a pitch period c2 and a voicing information d2. A reflection coefficient decoder 23 decodes the $10^{th}$ order reflection coefficient information bit e2, and outputs a $10^{th}$ order reflection coefficient f2. An RMS decoder 24 decodes the RMS information bit g2 and output an RMS information h2.

A parameter interpolator 25 interpolates the parameters c2, d2, f2 and h2 to improve the reproduced speech quality, and outputs the interpolated result (i.e., interpolated pitch period i2, interpolated voicing information j2, interpolated $10^{th}$ order reflection coefficient o2, and interpolated RMS information r2, respectively).

Next, an excitation signal m2 is produced in the following manner. A voicing switcher 28 selects a pulse excitation k2 generated from a pulse excitation generator 26 in synchronism with the interpolated pitch period i2 when the interpolated voicing information j2 indicates the voiced state. On the other hand, the voicing switcher 28 selects a white noise l2 generated from a noise generator 27 when the interpolated voicing information j2 indicates the unvoiced state. Meanwhile, when the interpolated voicing information j2 indicates the transitional state, the voicing switcher 28 selects the pulse excitation k2 for the voiced portion in this transitional frame and selects the white noise (i.e., pseudo-random excitation) l2 for the unvoiced portion in this transitional frame. In this case, the border between the voiced portion and the unvoiced portion in the same transitional frame is determined by the parameter interpolator 25. The pitch period information i2, used in this case for generating the pulse excitation k2, is the pitch period information of an adjacent voiced frame. An output of the voicing switcher 28 becomes the excitation signal m2.

An LPC synthesis filter 30 is an all-pole filter with a coefficient equal to the linear prediction coefficient p2. The LPC synthesis filter 30 adds the spectral envelope information to the excitation signal m2, and outputs a resulting signal n2. The linear prediction coefficient p2, serving as the spectral envelope information, is calculated by a linear prediction coefficient calculator 29 based on the interpolated reflection coefficient o2. For the voiced speech, the LPC synthesis filter 30 acts as a $10^{th}$ order all-pole filter with the $10^{th}$ order linear prediction coefficient p2. For the unvoiced speech, the LPC synthesis filter 30 acts as a $4^{th}$ order all-pole filter with the $4^{th}$ order linear prediction coefficient p2.

A gain adjuster 31 adjusts the gain of the output n2 of the LPC synthesis filter 30 by using the interpolated RMS information r2, and generates a gain-adjusted output q2. Finally, a de-emphasis unit 32 processes the gain-adjusted output q2 in a manner opposed to the processing of the previously described pre-emphasis unit 12 to output a reproduced speech s2.

The above-described LPC system includes the following problems (refer to the above reference [4]).

Problem A: The LPC system selectively assigns one of the voiced state, the unvoiced state and the transitional state to each frame in the entire frequency range. However, the excitation signal of natural speech comprises both of voiced-natured bands and unvoiced-natured bands when carefully observed in respective small frequency bands. Accordingly, if the frame is once identified as the voiced state in the LPC system, there is the possibility that the portion to be excited by the noise may be erroneously excited by the pulse. The buzz sound will be caused in this case. This is remarkable in the higher frequency range.

Problem B: In the transitional period from the unvoiced state to the voiced state, the excitation signal may comprise an aperiodic pulse. However, according to the LPC system, it is impossible to express an aperiodic pulse excitation in the transitional period. The tone noise will be caused accordingly.

In this manner, the LPC system possibly produces the buzz sound and the tone noise and therefore causes the problem in that the sound quality of the reproduced speech is mechanical and hard to listen.

To solve the above-described problems, the MELP system has been proposed as a system capable of improving the sound quality (refer to the above references [2] to [4]).

First, the sound quality improvement realized by the MELP system will be explained with reference to FIGS. 20A to 20C. As shown in FIG. 20A, the natural speech consists of a plurality of frequency band components when separated into smaller frequency bands on the frequency axis. Among them, a periodic pulse component is indicated by the white portion. A noise component is indicated by the black portion. When a large part of a concerned frequency band is occupied by the white portion (i.e., by the periodic pulse component), this band is the voiced state. On the other hand, when a large part of a concerned frequency band is occupied by the black portion (i.e., by the noise component), this band is the unvoiced state. The reason why the produced sound of the LPC vocoder becomes the mechanical one as described above is believed that, in the entire frequency range, the excitation of the voiced frame is expressed by the periodic pulse components while the excitation of the unvoiced frame is expressed by the noise components, as shown in FIG. 20B. In the case of the transitional frame, the frame is separated into a voiced state and an unvoiced state on the time axis. To solve this problem, the MELP system applies a mixed excitation by switching the voiced state and the unvoiced state for each sub band, i.e., each of five consecutive frequency bands, in a single frame, as shown in FIG. 20C.

This method is effective in solving the above-described problem "A" caused in the LPC system and also in reducing the buzz sound involved in the reproduced speech.

Furthermore, to solve the above-described problem "B" caused in the LPC system, the MELP system obtains the aperiodic pulse information and transmits the obtained information to a decoder to produce an aperiodic pulse excitation.

Moreover, to improve the sound quality of the reproduced speech, the MELP system employs an adaptive spectral enhancement filter and a pulse dispersion filter and also utilizes the harmonics amplitude information. Table 2 summarizes the effects of the means employed in the MELP system.

TABLE 2

Effects of the Means Employed in MELP System

| means | effects |
|---|---|
| ① mixed excitation | The buzz sound can be reduced as the voiced/unvoiced judgement is feasible for each of frequency bands. |
| ② aperiodic pulse | The tone noise can be reduced by expressing an irregular (aperiodic) glottal pulse caused in the transitional period or unvoiced plosives. |
| ③ adaptive spectral enhancement filter | The naturalness of the reproduced speech can be enhanced by sharpening the formant resonance and also by improving the similarity to the formant of natural speech. |
| ④ pulse dispersion filter | The naturalness of the reproduced speech can be enhanced by improving the similarity of the pulse excitation waveform with respect to the glottal pulse waveform of the natural speech. |
| ⑤ harmonics amplitude | The quality of nasal sound, the capability of discriminating a speaker, and the quality of vowel included in the wide band noise can be enhanced by accurately expressing the spectrum. |

Next, the arrangement of 2.4 kbps MELP system will be explained with reference to FIGS. 21 and 22 (details of the processing can be found in the above reference [2]).

FIG. 21 is a block diagram showing the circuit arrangement of an MELP speech encoder.

A framing unit 41 is a buffer which stores an input speech sample a3 having being bandpass-limited to the frequency range of 100–3,800 Hz and sampled at the frequency of 8 kHz and then quantized to the accuracy of at least 12 bits. The framing unit 41 fetches the speech samples (180 samples) for every single speech coding frame (22.5 ms), and sends an output b3 to a speech coding processing section.

Hereinafter, the processing performed for every single speech coding frame will be explained.

A gain calculator 42 calculates a logarithm of the RMS value serving as the level information of the output b3, and outputs a resulting logarithmic RMS value c3. This processing is performed for each of the first half and the second half of every single frame. Namely, the gain calculator 42 produces two logarithmic RMS values per frame. A first quantizer 43 linearly quantizes the logarithmic RMS value c3 to 3 bits for the first half of the frame and to 5 bits for the second half of the frame. Then, the first quantizer 43 outputs a resulting quantized data d3 to an error-correction coding/bit packing unit 70.

A linear prediction analyzer 44 performs the linear prediction analysis on the output b3 of the framing unit 41 by using the Durbin-Levinson method, and outputs a $10^{th}$ order linear prediction coefficient e3 which serves as spectral envelope information. An LSF coefficient calculator 45 converts the $10^{th}$ order linear prediction coefficient e3 into a $10^{th}$ order LSF (i.e., Line Spectrum Frequencies) coefficient f3. The LSF coefficient is a characteristic parameter equivalent to the linear prediction coefficient but excellent in both of the quantization characteristics and the interpolation characteristics. Hence, many of recent speech coding systems employ the LSF coefficient. A second quantizer 46 quantizes the $10^{th}$ order LSF coefficient f3 to 25 bits by using a multistage (four stages) vector quantization. The second quantizer 46 sends a resulting quantized LSF coefficient g3 to the error-correction coding/bit packing unit 70.

A pitch detector 54 obtains an integer pitch period from the signal components of 1 kHz or less contained in the output b3 of the framing unit 41. The output b3 of the framing unit 41 is entered into an LPF (i.e., low-pass filter) 55 to produce a bandpass-limited output q3 of 500 Hz or less. The pitch detector 54 obtains a fractional pitch period r3 based on the integer pitch period and the bandpass-limited output q3, and outputs the obtained fractional pitch period r3. The pitch period is given or defined as a delay amount which maximizes a normalized auto-correlation function. The pitch detector 54 outputs a maximum value o3 of the normalized auto-correlation function at this moment. The maximum value o3 of the normalized auto-correlation function serves as information representing the periodic strength of the input signal b3. This information is used in a later-described aperiodic flag generator 56. Furthermore, the maximum value o3 of the normalized auto-correlation function is corrected in a later-described correlation function corrector 53. Then, a corrected maximum value n3 of the normalized auto-correlation function is sent to the error-correction coding/bit packing unit 70 to make the voiced/unvoiced judgement of the entire frequency range. When the corrected maximum value n3 of the normalized auto-correlation function is equal to or smaller than a threshold (=0.6), it is judged that a current frame is an unvoiced state. Otherwise, it is judged that the current frame is a voiced state.

A third quantizer 57 receives the fractional pitch period r3 produced from the pitch detector 54 to convert it into a logarithmic value, and then linearly quantizes the logarithmic value by using 99 levels. A resulting quantized data s3 is sent to the error-correction coding/bit packing unit 70.

A total of four BPFs (i.e., band pass filters) 58, 59, 60 and 61 are provided to produce bandpass-limited signals of different frequency ranges. More specifically, the first BPF 58 receives the output b3 of the framing unit 41 and produces a bandpass-limited output t3 in the frequency range of 500–1,000 Hz. The second BPF 59 receives the output b3 of the framing unit 41 and produces a bandpass-limited output u3 in the frequency range of 1,000–2,000 Hz. The third BPF 60 receives the output b3 of the framing unit 41 and produces a bandpass-limited output v3 in the frequency range of 2,000–3,000 Hz. And, the fourth BPF 61 receives the output b3 of the framing unit 41 and produces a bandpass-limited output w3 in the frequency range of 3,000–4,000 Hz. A total of four auto-correlation calculators 62, 63, 64 and 65 are provided to receive and process the output signals t3, u3, v3 and w3 of BPFs 58, 59, 60 and 61, respectively. More specifically, the first auto-correlation calculator 62 calculates a normalized auto-correlation function of the input signal t3 at a delay amount corresponding to the fractional pitch period r3, and outputs a calculated value x3. The second auto-correlation calculator 63 calculates a normalized auto-correlation function of the input signal u3 at the delay amount corresponding to the fractional pitch period r3, and outputs a calculated value y3. The third auto-correlation calculator 64 calculates a normalized auto-correlation function of the input signal v3 at the delay amount corresponding to the fractional pitch period r3, and outputs a calculated value z3. The fourth auto-correlation calculator 65 calculates normalized auto-correlation function of the input signal w3 at the delay amount corresponding to the fractional pitch period r3, and outputs a calculated value a4.

A total of four voiced/unvoiced flag generators 66, 67, 68 and 69 are provided to generate voiced/unvoiced flags based on the values x3, y3, z3 and a4 produced from the first to fourth auto-correlation calculators 62, 63, 64 and 65, respectively. More specifically, the voiced/unvoiced flag generators 66, 67, 68 and 69 compare the input values x3, y3, z3 and a4 with a threshold (=0.6). The first voiced/unvoiced flag generator 66 judges that the corresponding frequency band is the unvoiced state when the value x3 is equal to or smaller than the threshold and otherwise judges that the corresponding frequency band is the voiced state. Based on this judgement, the first voiced/unvoiced flag generator 66 sends a voiced/unvoiced flag b4 of 1 bit to the correlation function corrector 53. The second voiced/unvoiced flag generator 67 judges that the corresponding frequency band is the unvoiced state when the value y3 is equal to or smaller than the threshold and otherwise judges that the corresponding frequency band is the voiced state. Based on this judgement, the second voiced/unvoiced flag generator 67 sends a voiced/unvoiced flag c4 of 1 bit to the correlation function corrector 53. The third voiced/unvoiced flag generator 68 judges that the corresponding frequency band is the unvoiced state when the value z3 is equal to or smaller than the threshold and otherwise judges that the corresponding frequency band is the voiced state. Based on this judgement, the third voiced/unvoiced flag generator 68 sends a voiced/unvoiced flag d4 of 1 bit to the correlation function corrector 53. The fourth voiced/unvoiced flag generator 69 judges that the corresponding frequency band is the unvoiced state when the value a4 is equal to or smaller than the threshold and otherwise judges that the corresponding frequency band is the voiced state. Based on this judgement, the fourth voiced/unvoiced flag generator 69 sends a voiced/unvoiced flag e4 of 1 bit to the correlation function corrector 53. The produced voiced/unvoiced flags b4, c4, d4 and e4 of respective frequency bands are used in a decoder to produce a mixed excitation.

The aperiodic flag generator 56 receives the maximum value o3 of the normalized auto-correlation function, and outputs an aperiodic flag p3 of 1 bit to the error-correction coding/bit packing unit 70. More specifically, the aperiodic flag p3 is set to ON when the maximum value o3 of the normalized auto-correlation function is smaller than a threshold (=0.5), and is set to OFF otherwise. The aperiodic flag p3 is used in the decoder to produce an aperiodic pulse expressing the excitation of the transitional period and the unvoiced plosives.

A first LPC analysis filter 51 is an all-zero filter with a coefficient equal to the $10^{th}$ order linear prediction coefficient e3, which removes the spectrum envelope information from the input speech b3 and outputs a residual signal l3.

A peakiness calculator 52 receives the residual signal l3 to calculate a peakiness value and outputs a calculated peakiness value m3. The peakiness value is a parameter representing the probability that a signal may contain a peak-like pulse component (i.e., spike). The above reference [5] defines the peakiness by the following formula.

$$\text{peakiness value } \rho = \frac{\sqrt{\frac{1}{N}\sum_{n=1}^{N} e_n^2}}{\frac{1}{N}\sum_{n=1}^{N} |e_n|} \tag{1}$$

where N represents the total number of samples in a single frame, and $e_n$ represents the residual signal.

The numerator of the formula (1) is largely influenced by a large value compared with its denominator. Thus, the peakiness value "p" becomes a large value when the residual signal includes a large spike. Accordingly, when a concerned frame has a large peakiness value, there is a large possibility that this frame is a voiced frame with a jitter which is often found in the transitional period or unvoiced plosives. In general, the frame having unvoiced plosives is a signal having a locally appearing spike (i.e., a sharp peak) with the remaining white noise-like portion.

The correlation function corrector 53 receives the peakiness value m3 from the peakiness calculator 52 and corrects the maximum value o3 of the normalized auto-correlation function and the voiced/unvoiced flags b4 and c4 based on the peakiness value m3. The correlation function corrector 53 sets the maximum value o3 of the normalized auto-correlation function to 1.0 (=voiced state) when the peakiness value m3 is larger than 1.34. Furthermore, the correlation function corrector 53 sets the maximum value o3 of the normalized auto-correlation function to 1.0 (=voiced state) and set the voiced/unvoiced flags b4 and c4 to the value indicating the voiced state when the peakiness value m3 is larger than 1.6. Although the voiced/unvoiced flags d4 and e4 are also input to the correlation function corrector 53, no correction is performed for the voiced/unvoiced flags d4 and e4. The correlation function corrector 53 outputs the corrected results as a corrected maximum value n3 of the normalized auto-correlation function and outputs the corrected voiced/unvoiced flags b4 and c4 and non-corrected voiced/unvoiced flags d4 and e4 as respective frequency bands' voicing information f4.

As described above, the voiced frame with a jitter or unvoiced plosives has a locally appearing spike (i.e., a sharp peak) with the remaining white noise-like portion. Thus, there is a large possibility that its normalized auto-correlation function becomes a value smaller than 0.5. In this case, the aperiodic flag is set to ON. Hence, if voiced frame with a jitter or unvoiced plosives is detected based on the peakiness value, the normalized auto-correlation function can be corrected to 1.0. It will be later judged to be the voiced state in the voiced/unvoiced judgement of the entire frequency range performed in the error-correction coding/bit packing unit 70. In the decoding operation, the sound quality of the voiced frame with a jitter or unvoiced plosives can be improved by using the aperiodic pulse excitation.

Next, the detection of harmonics information will be explained.

A linear prediction coefficient calculator 47 converts the quantized LSF coefficient g3 produced from the second quantizer 46 into a linear prediction coefficient, and outputs a quantized linear prediction coefficient h3. A second LPC analysis filter 48 removes the spectral envelope component from the input signal b3 by using a coefficient equal to the quantized linear prediction coefficient h3, and output a residual signal i3. A harmonics detector 49 detects the amplitude of $10^{th}$ order harmonics (i.e., harmonic component of the basic pitch frequency) in the residual signal i3, and outputs a detected amplitude j3 of the $10^{th}$ order harmonics. A fourth quantizer 50 quantizes the amplitude j3 of the $10^{th}$ order harmonics to 8 bits by using the vector quantization. The fourth quantizer 50 sends a resulting index k3 to the error-correction coding/bit packing unit 70.

The harmonics amplitude information corresponds to the spectral envelope information remaining in the residual signal i3. Accordingly, by transmitting the harmonics amplitude information to the decoder, it becomes possible to accurately express the spectrum of the input signal in the decoding operation. The quality of nasal sound, the capability of discriminating a speaker, and the quality of vowel included in the wide band noise can be enhanced by accurately expressing the spectrum (refer to Table 2-⑤).

As described previously, the error-correction coding/bit packing unit 70 sets the unvoiced frame when the corrected maximum value n3 of the normalized auto-correlation function is equal to or smaller than the threshold (=0.6) and set the voiced frame otherwise. The error-correction coding/bit packing unit 70 constitutes a speech information bit stream g4 according to the bit allocation show in Table 3. The speech information bit stream g4 consists of 54 bits per frame. The produced speech information bit stream g4 is transmitted to a receiver via a modulator and a wireless device in case of the radio communications.

In Table 3, the pitch and overall voiced/unvoiced information is quantized to 7 bits. The quantization is performed in the following manner.

Among 7-bit codes (i.e., a total of 128 codewords), the codeword having 0 in all of the 7 bits and seven codewords having 1 in only one of the 7 bits are allocated to the unvoiced state. The codeword having 1 in only 2 bits of the 7 bits is allocated to erasure. Other codewords are used for the voiced state and allocated to the pitch period information (i.e., the output s3 of the third quantizer 57). Regarding the voicing information of respective frequency bands, 1 is allocated for the voiced state and 0 is allocated for the unvoiced state in each of respective outputs b4, c4, d4 and e4. A total of four bits representing the voicing information of respective frequency bands constitute the voicing information f4 to be transmitted. Furthermore, as understood from Table 3, when the concerned frame is the unvoiced frame, the error-correction code of 13 bits is transmitted, instead of transmitting the harmonics amplitude k3, the respective frequency bands' voicing information f4, and the aperiodic flag p3. In this case, the error correction is applied to the specific bits having important role in the acoustic sense. Furthermore, the sync bit of 1 bit is added to each frame.

TABLE 3

2.4 kbps MELP system's Bit Allocation

| parameter | voiced frame | unvoiced frame |
|---|---|---|
| LSF parameter | 25 | 25 |
| harmonics amplitude | 8 | — |
| gain (2 times)/frame | 8 | 8 |
| pitch & overall voiced/unvoiced information | 7 | 7 |
| respective frequency bands' voicing information | 4 | — |
| aperiodic flag | 1 | — |
| error protection | — | 13 |
| sync bit | 1 | 1 |
| total bit/22.5 ms frame | 54 | 54 |

Next, a circuit arrangement of a MELP type speech decoder will be explained with reference to FIG. 22.

A bit separating/error correcting decoder 81 receives a speech information bit stream a5 consisting of 54 bits for each frame and obtains the pitch and overall voiced/unvoiced information. When the received frame is the unvoiced frame, the bit separating/error correcting decoder 81 applies the error correction decoding processing to the error protection bits. Furthermore, when the pitch and overall voiced/unvoiced information indicates the erasure, each parameter is replaced by the corresponding value of the previous frame. Then, the bit separating/error correcting decoder 81 outputs the separated information bits: i.e., pitch and overall voiced/unvoiced information b5; aperiodic flag d5; harmonics amplitude index e5; respective frequency bands' voicing information g5; LSF parameter index j5; and gain information m5. The respective frequency bands' voicing information g5 is a 5-bit flag representing the voicing information of respective sub-bands 0–500 Hz, 500–1,000 Hz, 1,000–2,000 Hz, 2,000–3,000 Hz, 3,000–4,000 Hz. The voicing information for the sub-band 0–500 Hz is the overall voiced/unvoiced information obtained from the pitch and overall voiced/unvoiced information.

A pitch decoder 82 decodes the pitch period when the pitch and overall voiced/unvoiced information indicates the voiced state, and sets 50.0 as the pitch period when the pitch and overall voiced/unvoiced information indicates the unvoiced state. The pitch decoder 82 outputs a decoded pitch period c5.

A jitter setter 102 receives the aperiodic flag d5 and outputs a jitter value g6 which is set to 0.25 when the aperiodic flag is ON and to 0 when the aperiodic flag is OFF. The jitter setter 102 produces the jitter value g6 of 0.25 when the above voiced/unvoiced information indicates the unvoiced state.

A harmonics decoder 83 decodes the harmonics amplitude index e5 and outputs a decoded $10^{th}$ order harmonics amplitude f5.

A pulse excitation filter coefficient calculator 84 receives the respective frequency bands' voicing information g5 and calculates and outputs an FIR filter coefficient h5 which assigns 1.0 to the gain of each voiced sub-band and 0 to the gain of each unvoiced sub-band. A noise excitation filter coefficient calculator 85 receives the respective frequency bands' voicing information g5 and calculates and outputs an FIR filter coefficient is which assigns 0 to the gain of each voiced sub-band and 1.0 to the gain of each unvoiced sub-band.

An LSF decoder 87 decodes the LSF parameter index j5 and outputs a decoded $10^{th}$ order LSF coefficient k5. A tilt correction coefficient calculator 86 calculates a tilt correction coefficient l5 based on the $10^{th}$ order LSF coefficient k5 sent from the LSF decoder 87.

A gain decoder 88 decodes the gain information m5 and outputs a decoded gain n5.

A parameter interpolator 89 linearly interpolates each of input parameters, i.e., pitch period c5, jitter value g6, $10^{th}$ order harmonics amplitude f5, FIR filter coefficient h5, FIR filter coefficient i5, tilt correction coefficient l5, $10^{th}$ order LSF coefficient k5, and gain n5, in synchronism with the pitch period. The parameter interpolator 89 outputs the interpolated outputs 05, p5, r5, s5, t5, u5, v5 and w5 corresponding to respective input parameters. The linear interpolation processing is performed in accordance with the following formula:

$$\text{interpolated parameter}=\text{current frame's parameter}\times\text{int}+\text{previous frame's parameter}\times(1.0-\text{int})$$

In this formula, the above input parameters c5, g6, f5, h5, i5, l5, k5, and n5 are the current frame's parameters. The above output parameters 05, p5, r5, s5, t5, uS, vS and w5 are the interpolated parameters. The previous frame's parameters are the parameters c5, g6, f5, h5, i5, l5, k5, and n5 in the previous frame which are stored. Furthermore, "int" is an interpolation coefficient which is defined by the following formula:

$$\text{int}=t0/180$$

where 180 is the sample number per speech decoding frame interval (22.5 ms), while "t0" is a start point of each pitch period in the decoded frame and is renewed by adding the pitch period in response to every decoding of the reproduced speech of one pitch period. When "t0" exceeds 180, it means that the decoding processing of the decoded frame is accomplished. Thus, "t0" is initialized by subtracting 180 from it upon accomplishment of the decoding processing of each fame.

A pitch period calculator 90 receives the interpolated pitch period o5 and the interpolated jitter value p5 and calculates a pitch period q5 according to the following formula:

pitch period q5=pitch period o5×(1.0−jitter value p5×random number)

where the random number falls within a range from −1.0 to 1.0.

According to the above formula, a significant jitter is added to the unvoiced or aperiodic frame because the jitter value 0.25 is set to the unvoiced or aperiodic frame. On the other hand, no jitter is added to the periodic frame because the jitter value 0 is set to the periodic frame. However, as the jitter value is interpolated for each pitch, the jitter value may be a value somewhere in a range from 0 to 0.25. This means that intermediate pitch sections may exist.

In this manner, generating the aperiodic pitch (i.e., jitter-added pitch) based on the aperiodic flag makes it possible to express an irregular (i.e., aperiodic) glottal pulse caused in the transitional period or unvoiced plosives. Thus, the tone noise can be reduced as shown in Table 2-②.

The pitch period q5, after being converted into an integer value, is supplied to a 1-pitch waveform decoder 101. The 1-pitch waveform decoder 101 decodes and outputs a reproduced speech f6 for every pitch period q5. Accordingly, all of blocks included in the 1-pitch waveform decoder 101 operate in synchronism with the pitch period q5.

A pulse excitation generator 91 receives the interpolated harmonics amplitude r5 and generates a pulse excitation x5 with a single pulse to which the harmonics information is added. Only one pulse excitation x5 is generated during one pitch period q5. A pulse filter 92 is an FIR filter with a coefficient equal to the interpolated pulse filter coefficient s5. The pulse filter 92 applies a filtering operation to the pulse excitation x5 so as to make only the voiced sub bands effective, and outputs the filtered pulse excitation y5. A noise generator 94 generates the white noise a6. A noise filter 93 is an FIR filter with a coefficient equal to the interpolated noise filter coefficient t5. The noise filter 93 applies a filtering operation to the noise excitation a6 so as to make only the unvoiced sub bands effective, and outputs the filtered noise excitation z5.

A mixed excitation generator 95 sums the filtered pulse excitation y5 and the filtered noise excitation z5 to generates a mixed excitation b6. The mixed excitation makes it possible to reduce the buzz sound as the voiced/unvoiced judgement is feasible for each of frequency bands as shown in Table 2-①.

A linear prediction coefficient calculator 98 calculates a linear prediction coefficient h6 based on the interpolated $10^{th}$ order LSF coefficient v5. An adaptive spectral enhancement filter 96 is an adaptive pole/zero filter with a coefficient obtained by applying the bandwidth expansion processing to the linear prediction coefficient h6. As shown in Table 2-③, this enhances the naturalness of the reproduced speech by sharpening the formant resonance and also by improving the similarity to the formant of the natural speech.

Furthermore, the adaptive spectral enhancement filter 96 corrects the tilt of the spectrum based on the interpolated tilt correction coefficient u5 so as to reduce the lowpass muffling effect, and outputs a resulting excitation signal c6.

An LPC synthesis filter 97 is an all-pole filter with a coefficient equal to the linear prediction coefficient h6. The LPC synthesis filter 97 adds the spectral envelope information to the excitation signal c6 produced from the adaptive spectral enhancement filter 96, and outputs a resulting signal d6. A gain adjuster 99 applies the gain adjustment to the output signal d6 of the LPC synthesis filter 97 by using the gain information w5, and outputs a gain-adjusted signal e6. A pulse dispersion filter 100 is a filter for improving the similarity of the pulse excitation waveform with respect to the glottal pulse waveform of the natural speech. The pulse dispersion filter 100 filters the output signal e6 of the gain adjuster 99 and outputs the reproduced speech f6 having improved naturalness. The effect of the pulse dispersion filter 100 is shown in Table 2-④.

As described above, when compared with the LPC system, the MELP system can provide a reproduced speech excellent in naturalness and also in intelligibility at the same bit rate (2.4 kbps).

Furthermore, to solve the above-described problem "A" of the LPC system, the above reference [6] proposes a decoder for a linear prediction analysis/synthesis system which does not require transmission of the voicing information of respective frequency bands used in the MELP system.

More specifically, the reference [6] proposes the decoder for a proposed linear prediction analysis/synthesis system which comprises a separating circuit which receives a digital speech signal having been analysis encoded by a linear prediction analysis/synthesis encoder. Furthermore, the separating circuit separates the parameters of linear prediction coefficient, voiced/unvoiced discrimination signal, excitation strength information, and pitch period information from the digital speech signal. A pitch pulse generator generates a pitch pulse controlled by the pitch period information. A noise generator generates the white noise. A synthesis filter outputs a speech signal decoded in accordance with the linear prediction coefficient using a mixed excitation of the pitch pulse generated from the pitch pulse generator and the white noise generated from the noise generator.

In this decoder for the linear prediction analysis/synthesis system, a processing control circuit is provided to receive the linear prediction coefficient, the voiced/unvoiced discrimination signal, and the excitation strength information from the separating circuit. The processing control circuit obtains a spectral envelope on the frequency axis based on formant synthesizing of the voiced sound, and then compares the obtained spectral envelope with a predetermined threshold. Then, the processing control circuit outputs a pitch component function signal representing the frequency region where the level of the spectral envelope is larger than the threshold and also outputs a noise component function signal representing the frequency region where the level of the spectral envelope is smaller than the threshold. Furthermore, a first output control circuit multiplies the pitch component function signal with the output of the pitch pulse generator to generate a pitch pulse of a frequency region larger than the threshold. A second output control circuit multiplies the noise component function signal with the white noise of the white noise generator to generate the white noise of a frequency region smaller than the threshold. An adder is provided to add the output of the first output control circuit and the output of the second output control circuit to generates an excitation signal for the synthesis filter.

However, the above-described decoder for the proposed linear prediction analysis/synthesis system causes a problem in that the reproduced speech has noise-like sound quality (the reason will be described later), although it can reduce the problem of buzz sound caused in the above-described LPC system.

SUMMARY OF THE INVENTION

Skyrocketing spread of mobile communications is seriously requiring the expansion of user accommodation number or capacity. In other words, utilizing the limited frequency resource more effectively is a goal to be attained. Especially, the low-bit rating of the speech coding system is a key technique for solving this problem.

Accordingly, the present invention has an object to provide the speech coding and decoding method and apparatus capable of solving the above-described problems "A" and "B" of the LPC system at the bit rate lower than 2.4 kbps.

Furthermore, the present invention has another object to provide the speech coding and decoding method and apparatus capable of bringing the comparable effects to the MELP system without transmitting the respective frequency bands' voicing information or the aperiodic flag.

To accomplish this and other related objects, the present invention provides a first speech decoding method for reproducing a speech signal from a speech information bit stream which is a coded output of the speech signal encoded by a linear prediction analysis and synthesis type speech encoder. The first speech decoding method comprises the steps of separating spectral envelope information, voiced/unvoiced discriminating information, pitch period information and gain information from the speech information bit stream and decoding each separated information, and generating a reproduced speech by summing the spectral envelope information and the gain information to a resultant excitation signal. When the voiced/unvoiced discriminating information indicates a voiced state, a spectral envelope value on a frequency axis is compared with a predetermined threshold to identify a voiced region which is a frequency region where the spectral envelope value is larger than or equal to the predetermined threshold and also to identify an unvoiced region which is a remaining frequency region. The spectral envelope value is calculated based on the spectral envelope information. A pitch pulse generated based on the pitch period information is used as a voiced regional excitation signal, and a mixed signal of the pitch pulse and a white noise mixed at a predetermined ratio is used as an unvoiced regional excitation signal. The above resultant excitation signal is formed by summing the voiced regional excitation signal and the unvoiced regional excitation signal. When the voiced/unvoiced discriminating information indicates an unvoiced state, the above resultant excitation signal is formed based on the white noise.

With this method, it becomes possible to solve the above-described problem "A" of the LPC system without transmitting the additional information bits.

Furthermore, the present invention provides a second speech decoding method for reproducing a speech signal from a speech information bit stream which is a coded output of the speech signal encoded by a linear prediction analysis and synthesis type speech encoder. The second speech decoding method comprises a step of separating spectral envelope information, voiced/unvoiced discriminating information, pitch period information and gain information from the speech information bit stream and decoding each separated information, a step of setting voicing strength information to 1.0 when the voiced/unvoiced discriminating information indicates a voiced state and to 0 when the voiced/unvoiced discriminating information indicates an unvoiced state, a step of linearly interpolating the spectral envelope information, the pitch period information, the gain information, and the voicing strength information in synchronism with a pitch period, a step of forming a first mixed excitation signal by mixing a pitch pulse and a white noise at a ratio corresponding to the interpolated voicing strength information, the pitch pulse being produced based on the interpolated pitch period information, a step of comparing a spectral envelope value on a frequency axis with a predetermined threshold to identify a voiced region which is a frequency region where the spectral envelope value is larger than or equal to the predetermined threshold and also to identify an unvoiced region which is a remaining frequency region, the spectral envelope value being calculated based on the interpolated spectral envelope information, a step of using the first mixed excitation signal as a voiced regional excitation signal, and using a mixed signal of the first mixed excitation signal and a white noise mixed at a predetermined ratio as an unvoiced regional excitation signal, a step of forming a second mixed excitation signal by summing the voiced regional excitation signal and the unvoiced regional excitation signal, and a step of generating a reproduced speech by summing the interpolated spectral envelope information and the interpolated gain information to the second mixed excitation signal.

With this method, it becomes possible to solve the above-described problem "A" of the LPC system without transmitting the additional information bits.

Furthermore, the present invention provides a first speech coding method for obtaining voiced/unvoiced discriminating information, pitch period information and aperiodic pitch information from an input speech signal, the aperiodic flag indicating whether the pitch is a periodic pitch or an aperiodic pitch, and the input speech signal being a sampled signal divided into a speech coding frame having a predetermined time interval. The first speech coding method comprises a step of quantizing the pitch period information with a first predetermined level number to produce periodic pitch information in a speech coding frame where the aperiodic flag indicates a periodic pitch, a step of allocating a quantized level in accordance with each occurrence frequency with respect to respective pitch ranges and performing a quantization with a second predetermined level number to produce aperiodic pitch information in a speech coding frame where the aperiodic flag indicates an aperiodic pitch, a step of allocating a single codeword to a condition where the voiced/unvoiced discriminating information indicates an unvoiced state, a step of allocating a predetermined number of codewords corresponding to the first predetermined level number to the periodic pitch information while allocating a predetermined number of codewords corresponding to the second predetermined level number to the aperiodic pitch information in a condition where the voiced/unvoiced discriminating information indicates a voiced state, and a step of encoding the allocated single codeword or codewords into a codeword having a predetermined bit number.

Preferably, the predetermined bit number of the codeword is 7 bits. A codeword having 0 (or 1) in all of the 7 bits is allocated to the condition where the voiced/unvoiced discriminating information indicates an unvoiced state. A codeword having 0 (or 1) in 1 or 2 bits of the 7 bits is allocated to the aperiodic pitch information. And the periodic pitch information is allocated to other codewords.

With this method, it becomes possible to solve the above-described problem "B" of the LPC system without transmitting the additional information bits.

Furthermore, it becomes possible to realize a low-bit rate speech coding.

Furthermore, the present invention provides a speech coding and decoding method comprising the above-described first speech coding method and either of the above-described first and second speech decoding methods.

With this method, it becomes possible to solve the above-described problems "A" and "B" of the LPC system without transmitting the additional information bits.

Furthermore, the present invention provides a first speech coding apparatus, according to which a framing unit receives a quantized speech sample which is sampled at a predetermined sampling frequency and outputs a predetermined number of speech samples for each speech coding frame having a predetermined time interval. A gain calculator calculates a logarithm of an RMS value and outputs a resulting logarithmic RMS value. The RMS value serves as level information for one frame of speech sample. A first quantizer linearly quantizes the logarithmic RMS value and outputs a resulting quantized logarithmic RMS value. A linear prediction analyzer applies a linear prediction analysis to the one frame of speech sample and outputs a linear prediction coefficient of a predetermined order which serves as spectral envelope information. An LSF coefficient calculator converts the linear prediction coefficient into an LSF (i.e., Line Spectrum Frequencies) coefficient and outputs the LSF coefficient. A second quantizer quantizes the LSF coefficient and outputs a resulting quantized value as an LSF parameter index. A low pass filter filters the one frame of speech sample with a predetermined cutoff frequency and outputs a bandpass-limited input signal. A pitch detector obtains a pitch period from the bandpass-limited input signal based on calculation of a normalized auto-correlation function and outputs the pitch period and a maximum value of the normalized auto-correlation function. A third quantizer linearly quantizes the pitch period, after having been converted into a logarithmic value, with a first predetermined level number and outputs a resulting quantized value as a pitch period index. An aperiodic flag generator receives the maximum value of the normalized auto-correlation function and outputs an aperiodic flag being set to ON when the maximum value is smaller than a predetermined value and being set to OFF otherwise. An LPC analysis filter removes the spectral envelope information from the one frame of speech sample by using a coefficient equal to the linear prediction coefficient, and outputs a filtered result as a residual signal. A peakiness calculator receives the residual signal, calculates a peakiness value based on the residual signal, and outputs the calculated peakiness value. A correlation function corrector corrects the maximum value of the normalized auto-correlation function based on the peakiness value of the peakiness calculator and outputs a corrected maximum value of the normalized auto-correlation function. A voiced/unvoiced identifier generates a voiced/unvoiced flag which represents an unvoiced state when the corrected maximum value of the normalized auto-correlation function is equal to or smaller than a predetermined value and represents a voiced state otherwise. An aperiodic pitch index generator applies a nonuniform quantization with a second predetermined level number to the pitch period of a frame being aperiodic according to the aperiodic flag, and outputs an aperiodic pitch index. A periodic/aperiodic pitch and voiced/unvoiced information code generator receives the voiced/unvoiced flag, the aperiodic flag, the pitch period index, and the aperiodic pitch index and outputs a periodic/aperiodic pitch and voiced/unvoiced information code of a predetermined bit number by coding the voiced/unvoiced flag, the aperiodic flag, the pitch period index, and the aperiodic pitch index. And, a bit packing unit receives the quantized logarithmic RMS value, the LSF parameter index, and the periodic/aperiodic pitch and voiced/unvoiced information code, and outputs a speech information bit stream by performing a bit packing for each frame.

Furthermore, the present invention provides a first speech decoding apparatus, according to which a bit separator separates the speech information bit stream of each frame produced by a speech coding apparatus in accordance with respective parameters, and outputs a periodic/aperiodic pitch and voiced/unvoiced information code, a quantized logarithmic RMS value, and an LSF parameter index. A voiced/unvoiced information and pitch period decoder receives the periodic/aperiodic pitch and voiced/unvoiced information code and outputs a pitch period and a voicing strength, in such a manner that the pitch period is set to a predetermined value and the voicing strength is set to 0 when a current frame is in an unvoiced state, while the pitch period is decoded in accordance with a coding regulation for the pitch period and the voicing strength is set to 1.0 when the current frame is in either a periodic state or aperiodic state. A jitter setter receives the periodic/aperiodic pitch and voiced/unvoiced information code and outputs a jitter value which is set to a predetermined value when the current frame is in the unvoiced state or in the aperiodic state and is set to 0 when the current frame is in the periodic state. An LSF decoder decodes the LSF coefficient of a predetermined order from the LSF parameter index and outputs a decoded LSF coefficient. A tilt correction coefficient calculator calculates a tilt correction coefficient from the decoded LSF coefficient, and outputs a calculated tilt correction coefficient. A gain decoder decodes the quantized logarithmic RMS value and outputs a gain. A parameter interpolator linearly interpolates each of the pitch period, the voicing strength, the jitter value, the LSF coefficient, the tilt correction coefficient, and the gain in synchronism with the pitch period, and outputs an interpolated pitch period, an interpolated voicing strength, an interpolated jitter value, an interpolated LSF coefficient, an interpolated tilt correction coefficient, and an interpolated gain. A pitch period calculator receives the interpolated pitch period and the interpolated jitter value to add jitter to the interpolated pitch period, and outputs a pitch period (hereinafter, referred to as integer pitch period) converted into an integer value. And, a 1-pitch waveform decoder decodes a reproduced speech corresponding to the integer pitch period in synchronism with the integer pitch period. According to this 1-pitch waveform decoder, a single pulse generator generates a single pulse signal within a duration of the integer pitch period. A noise generator generates a white noise having an interval equivalent to the integer pitch period. A first mixed excitation generator synthesizes the single pulse signal and the white noise based on the interpolated voicing strength to output a first mixed excitation signal. A linear prediction coefficient calculator calculates a linear prediction coefficient based on the interpolated LSF coefficient. A spectral envelope shape calculator obtains spectral envelope shape information of the reproduced speech based on the linear prediction coefficient, and outputs the obtained spectral envelope shape information. A mixed excitation filtering unit compares a value of the spectral envelope shape information with a predetermined threshold to identify a voiced region which is a frequency region where the value of the spectral envelope shape information is larger than or equal to the predetermined threshold and also to identify an unvoiced region which is a remaining frequency region. Then, the mixed excitation filtering unit outputs a first DFT coefficient string and a second DFT coefficient string. The first DFT coefficient string includes 0 values corresponding to the unvoiced region among DFT coefficients of the first mixed excitation information, while the second DFT coefficient string includes 0 values corresponding to the voiced region among the DFT coefficients of the first mixed excitation information. A noise excitation filtering unit outputs a DFT coefficient string including 0 values corresponding to the voiced region among DFT coefficients of the white noise. A second mixed excitation generator mixes the second DFT coefficient string of the mixed excitation filtering unit and the DFT coefficient string of the noise excitation filtering unit at a predetermined ratio, and outputs a resulting DFT coefficient string. A third mixed excitation generator sums the DFT coefficient string produced from the second mixed excitation generator and the first DFT coefficient string produced from the mixed excitation filtering unit, and applies an inverse Discrete Fourier transform to the summed-up DFT coefficient string to output an obtained result as a mixed excitation signal. A switcher receives the interpolated voicing strength to select the white noise when the interpolated voicing strength is 0 and also to select the mixed excitation signal produced from the third mixed excitation generator when the interpolated voicing strength is not 0, and outputs the selected one as a mixed excitation signal. An adaptive spectral enhancement filter outputs an excitation signal having an improved spectrum as a result of a filtering of the mixed excitation signal. The adaptive spectral enhancement filter is a cascade connection of an adaptive pole/zero filter with a coefficient obtained by applying the bandwidth expansion processing to the linear prediction coefficient and a spectral tilt correcting filter with a coefficient equal to the interpolated tilt correction coefficient. An LPC synthesis filter adds spectral envelope information to an excitation signal improved in the spectrum and outputs a signal accompanied with the spectral envelope information. The LPC synthesis filter is an all-pole filter using a coefficient equal to the linear prediction coefficient. A gain adjuster applies gain adjustment to the signal accompanied with the spectral envelope information by using the gain and outputs a reproduced speech signal. And, a pulse dispersion filter applies pulse dispersion processing to the reproduced speech signal, and outputs a pulse dispersion processed reproduced speech signal.

Moreover, the present invention provides a third speech decoding method for reproducing a speech signal from a speech information bit stream which is a coded output of the speech signal encoded by a linear prediction analysis and synthesis type speech encoder. The third speech decoding method comprises a step of separating spectral envelope information, voiced/unvoiced discriminating information, pitch period information and gain information from the speech information bit stream and decoding each separated information, a step of obtaining a spectral envelope amplitude from the spectral envelope information, and identifying a frequency band having a largest spectral envelope amplitude among a plurality of frequency bands divided on a frequency axis, a step of determining a mixing ratio for each of the plurality of frequency bands based on the identified frequency band and the voiced/unvoiced discriminating information, the mixing ratio being used in mixing a pitch pulse generated in response to the pitch period information and white noise, a step of producing a mixing signal for each of the plurality of frequency bands based on the determined mixing ratio, and then producing a mixed excitation signal by summing all of the mixing signals of the plurality of frequency bands, and a step of producing a reproduced speech by adding the spectral envelope information and the gain information to the mixed excitation signal.

With this method, it becomes possible to solve the above-described problem "A" of the LPC system without transmitting the additional information bits.

Furthermore, the present invention provides a fourth speech decoding method for reproducing a speech signal from a speech information bit stream, including spectral envelope information, low-frequency band voiced/unvoiced discriminating information, high-frequency band voiced/unvoiced discriminating information, pitch period information and gain information, which is a coded output of the speech signal encoded by a linear prediction analysis and synthesis type speech encoder. The fourth speech decoding method comprises a step of separating the spectral envelope information, low-frequency band voiced/unvoiced discriminating information, high-frequency band voiced/unvoiced discriminating information, pitch period information and gain information from the speech information bit stream and decoding each separated information, a step of determining a mixing ratio of the low-frequency band based on the low-frequency band voiced/unvoiced discriminating information, the mixing ratio being used in mixing a pitch pulse generated in response to the pitch period information and white noise for the low-frequency band, and producing a mixing signal for the low-frequency band, a step of obtaining a spectral envelope amplitude from the spectral envelope information, and identifying a frequency band having a largest spectral envelope amplitude among a plurality of high-frequency bands divided on a frequency axis, a step of determining a mixing ratio for each of the plurality of high-frequency bands based on the identified frequency band and the high-frequency band voiced/unvoiced discriminating information, the mixing ratio being used in mixing a pitch pulse generated in response to the pitch period information and white noise for each of the high-frequency bands, and producing a mixing signal of each of the plurality of high-frequency bands, and then producing a mixing signal for the high-frequency band corresponding to a summation of all of the mixing signals of the plurality of high-frequency bands, a step of producing a mixed excitation signal by summing the mixing signal for the low-frequency band and the mixing signal for the high-frequency band, and a step of producing a reproduced speech by adding the spectral envelope information and the gain information to the mixed excitation signal.

With this method, it becomes possible to solve the above-described problem "A" of the LPC system and improve the sound quality of the reproduced speech.

Furthermore, the present invention provides a fifth speech decoding method for reproducing a speech signal from a speech information bit stream, including spectral envelope information, low-frequency band voiced/unvoiced discriminating information, high-frequency band voiced/unvoiced discriminating information, pitch period information and gain information, which is a coded output of the speech signal encoded by a linear prediction analysis and synthesis type speech encoder. The fifth speech decoding method comprises a step of separating each of the spectral envelope information, the low-frequency band voiced/unvoiced discriminating information, the high-frequency band voiced/unvoiced discriminating information, the pitch period information and the gain information from the speech information bit stream and decoding each separated information, a step of determining a mixing ratio of the low-frequency band based on the low-frequency band voiced/unvoiced discriminating information, the mixing ratio being used in mixing a pitch pulse generated in response to the pitch period information being linearly interpolated in synchronism with the pitch period and white noise for the low-frequency band, a step of obtaining a spectral envelope amplitude from the spectral envelope information, and identifying a frequency band having a largest spectral envelope amplitude among a plurality of high-frequency bands divided on a frequency axis, a step of determining a mixing ratio for each of the plurality of high-frequency bands based on the identified frequency band and the high-frequency band voiced/unvoiced discriminating information, the mixing ratio being used in mixing a pitch pulse in response to the pitch period information being linearly interpolated in synchronism with the pitch period and white noise for each of the plurality of high-frequency bands, a step of linearly interpolating the spectral envelope information, the pitch period information, the gain information, the mixing ratio of the low-frequency band, the mixing ratio of each of the plurality of high-frequency bands, in synchronism with the pitch period, a step of producing a mixing signal for the low-frequency band by mixing the pitch pulse and the white noise with reference to the interpolated mixing ratio of the low-frequency band, a step of producing a mixing signal of each of the plurality of high-frequency bands by mixing the pitch pulse and the white noise with reference to the interpolated mixing ratio for each of the plurality of high-frequency bands, and then producing a mixing signal for the high-frequency band corresponding to a summation of all of the mixing signals of the plurality of high-frequency bands, a step of producing a mixed excitation signal by summing the mixing signal for the low-frequency band and the mixing signal for the high-frequency band, and a step of producing a reproduced speech by adding the interpolated spectral envelope information and the interpolated gain information to the mixed excitation signal.

With this method, it becomes possible to solve the above-described problem "A" of the LPC system and improve the sound quality of the reproduced speech.

Preferably, the plurality of high-frequency bands are separated into three frequency bands. When the high-frequency band voiced/unvoiced discriminating information indicates a voiced state, the mixing ratio of each of the three high-frequency bands is determined in the following manner: when the spectral envelope amplitude is maximized in the first or second lowest frequency band, the ratio of pitch pulse (hereinafter, referred to as "voicing strength") monotonously decreases with increasing frequency of each of the plurality of high-frequency bands; and when the spectral envelope amplitude is maximized in the highest frequency band, the ratio of pitch pulse for the second lowest frequency band is smaller than the voicing strength for the first lowest frequency band while the voicing strength for the highest frequency band is larger than the ratio of pitch pulse for the second lowest frequency band.

Preferably, the plurality of high-frequency bands are separated into three frequency bands. The mixing ratio of each of the three high-frequency bands, when the high-frequency band voiced/unvoiced discriminating information indicates a voiced state, is determined in such a manner that a voicing strength of one of three frequency bands, when the spectral envelope amplitude is maximized in the one of three frequency bands, is larger than a corresponding voicing strength of the one of three frequency bands in a case where the spectral envelope amplitude of other two frequency bands is maximized.

Preferably, the plurality of high-frequency bands are separated into three frequency bands. The mixing ratio of each of the three high-frequency bands, when the high-frequency band voiced/unvoiced discriminating information indicates an unvoiced state, is determined in such a manner that a voicing strength of one of three frequency bands, when the spectral envelope amplitude is maximized in the one of three frequency bands, is smaller than a corresponding voicing strength of the one of three frequency bands in a case where the spectral envelope amplitude of other two frequency bands is maximized.

Furthermore, the present invention provides a second speech coding apparatus, according to which a framing unit receives a quantized speech sample which is sampled at a predetermined sampling frequency and outputs a predetermined number of speech samples for each speech coding frame having a predetermined time interval. A gain calculator calculates a logarithm of an RMS value and outputs a resulting logarithmic RMS value. The RMS value serves as level information for one frame of speech sample. A first quantizer linearly quantizes the logarithmic RMS value and outputs a resulting quantized logarithmic RMS value. A linear prediction analyzer applies a linear prediction analysis to the one frame of speech sample and outputs a linear prediction coefficient of a predetermined order which serves as spectral envelope information. An LSF coefficient calculator converts the linear prediction coefficient into an LSF (i.e., Line Spectrum Frequencies) coefficient and outputs the LSF coefficient. A second quantizer quantizes the LSF coefficient and outputs a resulting quantized value as an LSF parameter index. A low pass filter filters the one frame of speech sample with a predetermined cutoff frequency and outputs a low frequency band input signal. A pitch detector obtains a pitch period from the low frequency band input signal based on calculation of a normalized auto-correlation function and outputs the pitch period and a maximum value of the normalized auto-correlation function. A third quantizer linearly quantizes the pitch period, after having been converted into a logarithmic value, with a first predetermined level number and outputs a resulting quantized value as a pitch period index. An aperiodic flag generator receives the maximum value of the normalized auto-correlation function and outputs an aperiodic flag being set to ON when the maximum value is smaller than a predetermined value and being set to OFF otherwise. An LPC analysis filter removes the spectral envelope information from the one frame of speech sample by using a coefficient equal to the linear prediction coefficient, and outputs a filtered result as a residual signal. A peakiness calculator receives the residual signal, calculates a peakiness value based on the residual signal, and outputs the calculated peakiness value. A correlation function corrector corrects the maximum value of the normalized auto-correlation function based on the peakiness value of the peakiness calculator and outputs a corrected maximum value of the normalized auto-correlation function. A first voiced/unvoiced identifier generates a voiced/unvoiced flag which represents an unvoiced state when the corrected maximum value of the normalized auto-correlation function is equal to or smaller than a predetermined value and represents a voiced state otherwise. An aperiodic pitch index generator applies a nonuniform quantization with a second predetermined level number to the pitch period of a frame being aperiodic according to the aperiodic flag and outputs an aperiodic pitch index. A periodic/aperiodic pitch and voiced/unvoiced information code generator receives the voiced/unvoiced flag, the aperiodic flag, the pitch period index, and the aperiodic pitch index and outputs a periodic/aperiodic pitch and voiced/unvoiced information code of a predetermined bit number by coding the voiced/unvoiced flag, the aperiodic flag, the pitch period index, and the aperiodic pitch index. A high pass filter filters the one frame of speech sample with a predetermined cutoff frequency and outputs a high frequency band input signal. A correlation function calculator calculates a normalized auto-correlation function at a delay amount corresponding to the pitch period based on the high frequency band input signal. A second voiced/unvoiced identifier generates a high-frequency band voiced/unvoiced flag which represents an unvoiced state when a maximum value of the normalized auto-correlation function generated from the correlation function calculator is equal to or smaller than a predetermined value and represents a voiced state otherwise. And, a bit packing unit receives the quantized logarithmic RMS value, the LSF parameter index, and the periodic/aperiodic pitch and voiced/unvoiced information code and the high-frequency band voiced/unvoiced flag, and outputs a speech information bit stream by performing a bit packing for each frame.

Furthermore, the present invention provides a second speech decoding apparatus decoding the speech information bit stream of each frame encoded by a speech coding apparatus. The second speech decoding apparatus comprises a bit separator separates the speech information bit stream into respective parameters, and outputs a periodic/aperiodic pitch and voiced/unvoiced information code, a quantized logarithmic RMS value, an LSF parameter index, and a high-frequency band voiced/unvoiced flag. A voiced/unvoiced information and pitch period decoder receives the periodic/aperiodic pitch and voiced/unvoiced information code and outputs a pitch period and a voiced/unvoiced flag, in such a manner that the pitch period is set to a predetermined value and the voiced/unvoiced flag is set to 0 when a current frame is in an unvoiced state, while the pitch period is decoded in accordance with a coding regulation for the pitch period and the voiced/unvoiced flag is set to 1.0 when the current frame is in either a periodic state or aperiodic state. A jitter setter receives the periodic/aperiodic pitch and voiced/unvoiced information code and outputs a jitter value which is set to a predetermined value when the current frame is the unvoiced state or the aperiodic state and is set to 0 when the current frame is the periodic state. An LSF decoder decodes a predetermined order of LSF coefficient from the LSF parameter index and outputs a decoded LSF coefficient. A tilt correction coefficient calculator calculates a tilt correction coefficient from the decoded LSF coefficient, and outputs a calculated tilt correction coefficient. A gain decoder decodes the quantized logarithmic RMS value and outputs a decoded gain. A first linear prediction coefficient calculator converts the decoded LSF coefficient into a linear prediction coefficient and outputs the resulting linear prediction coefficient. A spectral envelope amplitude calculator calculates a spectral envelope amplitude based on the linear prediction coefficient produced from the first linear prediction coefficient calculator. A pulse excitation/noise excitation mixing ratio calculator receives the voiced/unvoiced flag, the high-frequency band voiced/unvoiced flag, and the spectral envelope amplitude, and outputs determined mixing ratio information used in mixing a pulse excitation and white noise for each of a plurality of frequency bands (hereinafter, referred to as sub-bands) divided on a frequency axis. A parameter interpolator linearly interpolates each of the pitch period, the mixing ratio information, the jitter value, the LSF coefficient, the tilt correction coefficient, and the gain in synchronism with the pitch period, and outputs an interpolated pitch period, an interpolated mixing ratio information, an interpolated jitter value, an interpolated LSF coefficient, an interpolated tilt correction coefficient, and an interpolated gain. A pitch period calculator receives the interpolated pitch period and the interpolated jitter value to add jitter to the interpolated pitch period, and outputs a pitch period (hereinafter, referred to as integer pitch period) converted into an integer value. And, a 1-pitch waveform decoder decodes a reproduced speech corresponding to the integer pitch period in synchronism with the integer pitch period. According to this 1-pitch waveform decoder, a single pulse generator generates a single pulse signal within a duration of the integer pitch period. A noise generator generates a white noise having an interval equivalent to the integer pitch period. A mixed excitation generator mixes the single pulse signal and the white noise for each sub-band based on the interpolated mixing ratio information, and then synthesizes a mixed excitation signal equivalent to a summation of all of the produced mixing signals of the sub-bands. A second linear prediction coefficient calculator calculates a linear prediction coefficient based on the interpolated LSF coefficient. An adaptive spectral enhancement filter outputs an excitation signal having an improved spectrum as a result of a filtering of the mixed excitation signal. The adaptive spectral enhancement filter is a cascade connection of an adaptive pole/zero filter with a coefficient obtained by applying the bandwidth expansion processing to the linear prediction coefficient and a spectral tilt correcting filter with a coefficient equal to the interpolated tilt correction coefficient. An LPC synthesis filter adds spectral envelope information to an excitation signal improved in the spectrum and outputs a signal accompanied with the spectral envelope information. The LPC synthesis filter is an all-pole filter with a coefficient equal to the linear prediction coefficient. A gain adjuster applies gain adjustment to the signal accompanied with the spectral envelope information by using the gain and outputs a reproduced speech signal. And, a pulse dispersion filter applies pulse dispersion processing to the reproduced speech signal and outputs a pulse dispersion processed reproduced speech signal.

BRIEF DESCRIPTION OF THE DRAWINGS

The above and other objects, features and advantages of the present invention will become more apparent from the following detailed description which is to be read in conjunction with the accompanying drawings, in which:

FIG. 1 is a block diagram showing the circuit arrangement of a first embodiment of a speech encoder employing the speech coding method of the present invention;

FIG. 9 is a block diagram showing the circuit arrangement of a second embodiment of a speech encoder employing the speech coding method of the present invention;

DESCRIPTION OF THE PREFERRED EMBODIMENTS

First Embodiment

Figure 2:
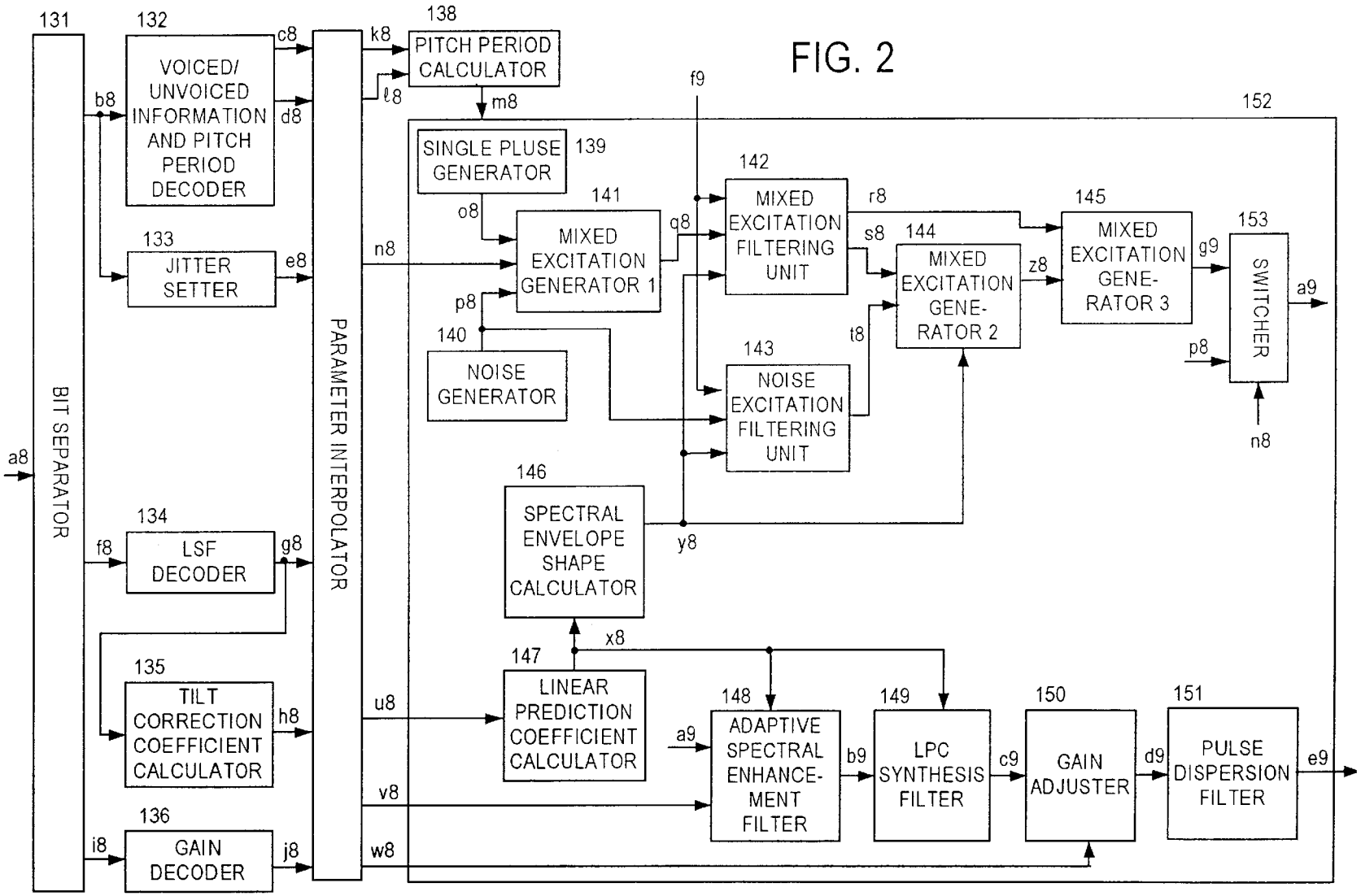
FIG. 2 is a block diagram showing the circuit arrangement of a first embodiment of a speech decoder employing the speech decoding method of the present invention.

Hereinafter, the speech coding and decoding method and apparatus in accordance with a first embodiment of the present invention will be explained with reference to FIGS. 1 to 8. Although the following preferred embodiment is explained by using practical values, it is needless to say that the present invention can be realized by using other appropriate values.

FIG. 1 is a block diagram showing the circuit arrangement of a speech encoder employing the speech coding method of the present invention.

A framing unit 111 is a buffer which stores an input speech sample a7 having being bandpass-limited to the frequency range of 100–3,800 Hz and sampled at the frequency of 8 kHz and then quantized to the accuracy of at least 12 bits. The framing unit 111 fetches the speech samples (160 samples) for every single speech coding frame (20 ms), and sends an output b7 to a speech coding processing section.

Hereinafter, the processing performed for every single speech coding frame will be explained.

A gain calculator 112 calculates a logarithm of an RMS value serving as the level information of the received speech b7, and outputs a resulting logarithmic RMS value c7. A first quantizer 113 linearly quantizes the logarithmic RMS value c7 to 5 bits, and outputs a resulting quantized data d7 to a bit packing unit 125.

A linear prediction analyzer 114 performs the linear prediction analysis on the output b7 of the framing unit 111 by using the Durbin-Levinson method, and outputs a $10^{th}$ order linear prediction coefficient e7 which serves as spectral envelope information. An LSF coefficient calculator 115 converts the $10^{th}$ order linear prediction coefficient e7 into a $10^{th}$ order LSF (i.e., Line Spectrum Frequencies) coefficient f7. A second quantizer 116 quantizes the $10^{th}$ order LSF coefficient f7 to 25 bits by using a multistage (four stages) vector quantization. The second quantizer 116 sends a resulting LSF parameter index g7 to the bit packing unit 125.

A low pass filter (LPF) 120 applies the filtering operation to the output b7 of the framing unit 111 at the cutoff frequency 1,000 Hz, and output a filtered output k7. A pitch detector 121 obtains a pitch period from the filtered output k7, and output an obtained pitch period m7. The pitch period is given or defined as a delay amount which maximizes a normalized auto-correlation function. The pitch detector 121 outputs a maximum value l7 of the normalized auto-correlation function at this moment. The maximum value l7 of the normalized auto-correlation function serves as information representing the periodic strength of the input signal b7. This information is used in a later-described aperiodic flag generator 122. Furthermore, the maximum value l7 of the normalized auto-correlation function is corrected in a later-described correlation function corrector 119. Then, a corrected maximum value j7 of the normalized auto-correlation function is sent to a voiced/unvoiced identifier 126 to make the voiced/unvoiced judgement. When the corrected maximum value j7 of the normalized auto-correlation function is equal to or smaller than a predetermined threshold (e.g., 0.6), it is judged that a current frame is an unvoiced state. Otherwise, it is judged that the current frame is a voiced state. The voiced/unvoiced identifier 126 outputs a voiced/unvoiced flag s7 representing the result in the voiced/unvoiced judgement.

A third quantizer 123 receives the pitch period m7 and converts it into a logarithmic value, and then linearly quantizes the logarithmic value by using 99 levels. A resulting pitch index o7 is sent to a periodic/aperiodic pitch and voiced/unvoiced information code generator 127.

Figure 3:
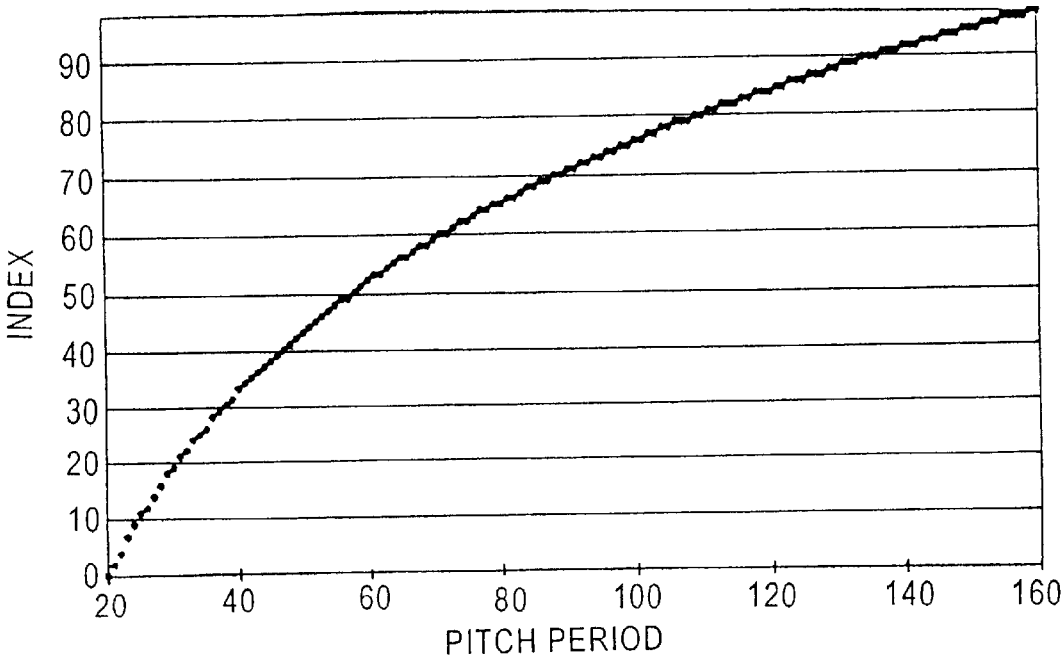
FIG. 3 is a graph showing the relationship between the pitch period and the index.

FIG. 3 shows the relationship between the pitch period (ranging from 20 to 160 samples) entered into the third quantizer 123 and the index value produced from the third quantizer 123.

The aperiodic flag generator 122 receives the maximum value l7 of the normalized auto-correlation function, and outputs an aperiodic flag n7 of 1 bit to an aperiodic pitch index generator 124 and also to the periodic/aperiodic pitch and voiced/unvoiced information code generator 127. More specifically, the aperiodic flag n7 is set to ON when the maximum value l7 of the normalized auto-correlation function is smaller than a predetermined threshold (e.g., 0.5), and is set to OFF otherwise. When the aperiodic flag n7 is ON, it means that the current frame is an aperiodic excitation.

An LPC analysis filter 117 is an all-zero filter with a coefficient equal to the $10^{th}$ order linear prediction coefficient r7, which removes the spectrum envelope information from the input speech b7 and outputs a residual signal h7. A peakiness calculator 118 receives the residual signal h7 to calculate a peakiness value and outputs a calculated peakiness value i7. The calculation method of the peakiness value is substantially the same as that explained in the above-described MELP system.

The correlation function corrector 119 receives the peakiness value i7 from the peakiness calculator 118, and sets the maximum value l7 of the normalized auto-correlation function to 1.0 (=voiced state) when the peakiness value i7 is larger than a predetermined value (e.g., 1.34). Thus, the corrected maximum value j7 of the normalized auto-correlation function is produced from the correlation function corrector 119. Furthermore, the correlation function corrector 119 directly outputs the non-corrected maximum value l7 of the normalized auto-correlation function when the peakiness value i7 is not larger than the above value.

The above-described calculation of the peakiness value and correction of the correlation function is the processing for detecting an aperiodic pulse frame and unvoiced plosives and for correcting the maximum of the normalized auto-correlation function to 1.0 (=voiced state). The unvoiced plosives are the signal having a locally appearing spike (i.e., a sharp peak) with the remaining white noise-like portion. Thus, at the timing before the correction, there is a large possibility that its normalized auto-correlation function becomes a value smaller than 0.5. In other words, there is a large possibility that the aperiodic flag is set to ON. On the other hand, the peakiness value becomes large. Hence, if the unvoiced plosive is detected based on the peakiness value, the normalized auto-correlation function can be corrected to 1.0. It will be later judged to be the voiced state in the voiced/unvoiced judgement performed in the voiced/unvoiced identifier 126. In the decoding operation, the sound quality of the unvoiced plosives can be improved by using the aperiodic pulse excitation. Similarly, it is possible to improve the sound quality of the aperiodic pulse string frame which is often found in the transitional period.

The aperiodic pitch index generator 124 applies a non-uniform quantization with 28 levels to the pitch period m7 of an periodic frame and outputs an aperiodic pitch index p7.

This processing will be explained in more detail hereinafter.

Figure 4:
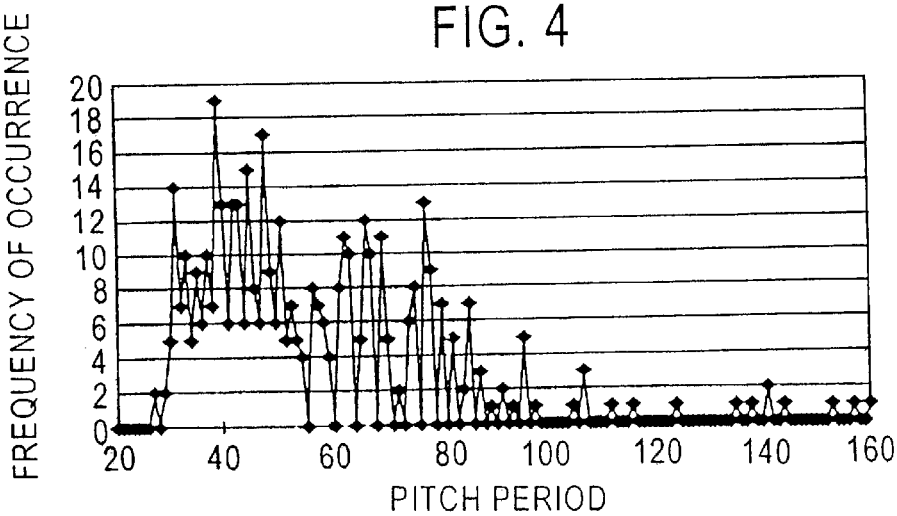
FIG. 4 is a graph showing the frequency of occurrence in relation to the pitch period.
Figure 5:
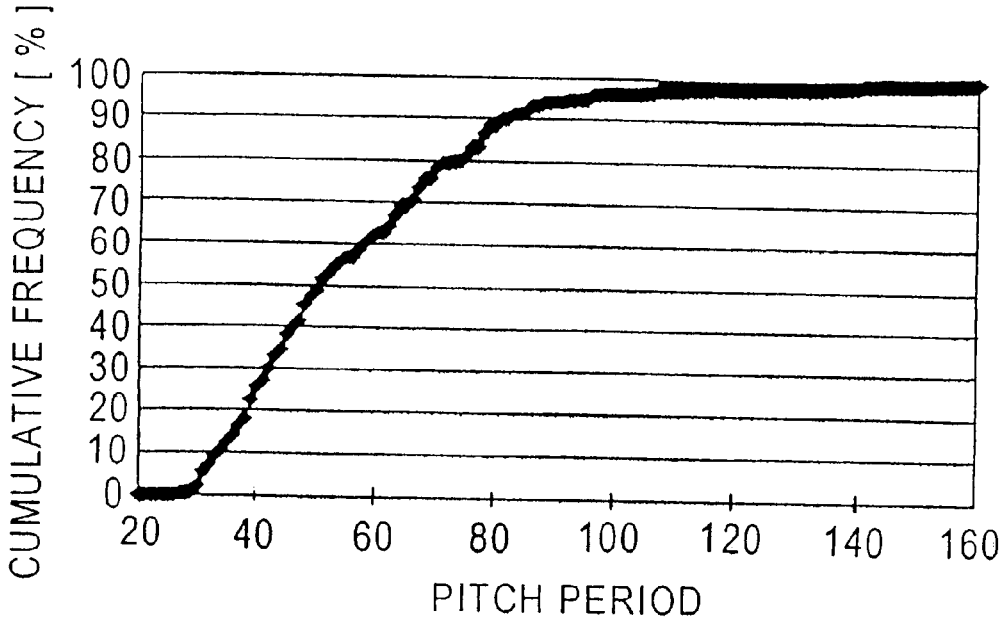
FIG. 5 is a graph showing the cumulative frequency in relation to the pitch period.

FIG. 4 shows the frequency distribution of the pitch period with respect to a frame (corresponding to the transitional period or the unvoiced plosives) having the voiced/unvoiced flag s7 indicating the voiced state and the aperiodic flag n7 indicating ON. FIG. 5 shows its cumulative frequency distribution. FIGS. 4 and 5 show the measurement result of a total of 112.12[s] (5,606 frames) speech data collected from four male speakers and four female speakers (6 speech samples/person). The frames satisfying the above-described conditions (voiced/unvoiced flag s7=voiced state, and aperiodic flag n7=ON) are 425 frames of 5,606 frames. From FIG. 4, it is understood that the frames satisfying the above conditions (hereinafter, referred to aperiodic frame) has the pitch period distribution concentrated in the region of 25 to 100. Accordingly, it becomes possible to realize a highly efficient data transmission by performing the non-uniform quantization based on the measured frequency (frequency of occurrence). Namely, the pitch period is quantized finely when the frequency of occurrence is large, while the pitch period is quantized roughly when the frequency of occurrence is small.

Furthermore, in the decoder, the pitch period of the aperiodic frame is calculated by the following formula.

$$\text{pitch period of aperiodic frame} = \text{transmitted pitch period} \times (1.0 + 0.25 \times \text{random number})$$

In the above formula, the transmitted pitch period is a pitch period transmitted by the aperiodic pitch index produced from the aperiodic pitch index generator 124. A significant jitter is added for each pitch period by multiplying (1.0+0.25×random number). Accordingly, the added jitter amount becomes large when the pitch period is large. Thus, the rough quantization is allowed.

Table 4 shows an example of the quantization table for the pitch period of the aperiodic frame according to the above consideration. According to Table 4, the region of input pitch period 20–24 is quantized to 1 level. The region of input pitch period 25–50 is quantized to a total of 13 levels (by the increments of 2 step width). The region of input pitch period 51–95 is quantized to a total of 9 levels (by the increments of 5 step width). The region of input pitch period 96–135 is quantized to a total of 4 levels (by the increments of 10 step width). And, the range of pitch period 136–160 is quantized to 1 level. As a result, quantized indexes (aperiodic 0 to 27) are outputted.

The above quantization for the pitch period of the aperiodic frame only requires 28 levels by considering the frequency of occurrence as well as the decoding method, whereas the ordinary quantization for the pitch period requires 64 levels or more.

TABLE 4

Quantization Table for Pitch Period of Aperiodic Frame

| pitch period of a-periodic frame | quantized pitch period of aperiodic frame | index | pitch period of aperiodic frame | quantized pitch period of aperiodic frame | index |
|---|---|---|---|---|---|
| 20–24 | 24 | aperiodic 0 | 51–55 | 55 | aperiodic 14 |
| 25, 26 | 26 | aperiodic 1 | 56–60 | 60 | aperiodic 15 |
| 27, 28 | 28 | aperiodic 2 | 61–65 | 65 | aperiodic 16 |
| 29, 30 | 30 | aperiodic 3 | 66–70 | 70 | aperiodic 17 |
| 31, 32 | 32 | aperiodic 4 | 71–75 | 75 | aperiodic 18 |
| 33, 34 | 34 | aperiodic 5 | 76–80 | 80 | aperiodic 19 |
| 35, 36 | 36 | aperiodic 6 | 81–85 | 85 | aperiodic 20 |
| 37, 38 | 38 | aperiodic 7 | 86–90 | 90 | aperiodic 21 |
| 39, 40 | 40 | aperiodic 8 | 91–95 | 95 | aperiodic 22 |
| 41, 42 | 42 | aperiodic 9 | 96–105 | 100 | aperiodic 23 |
| 43, 44 | 44 | aperiodic 10 | 106–115 | 110 | aperiodic 24 |
| 45, 46 | 46 | aperiodic 11 | 116–125 | 120 | aperiodic 25 |
| 47, 48 | 48 | aperiodic 12 | 126–135 | 130 | aperiodic 26 |
| 49, 50 | 50 | aperiodic 13 | 136–160 | 140 | aperiodic 27 |

The periodic/aperiodic pitch and voiced/unvoiced information code generator 127 receives the voiced/unvoiced flag s7, the aperiodic flag n7, the pitch index o7, and the aperiodic pitch index p7, and outputs a periodic/aperiodic pitch and voiced/unvoiced information code t7 of 7 bits (128 levels).

The coding processing of the periodic/aperiodic pitch and voiced/unvoiced information code generator 127 is performed in the following manner.

When the voiced/unvoiced flag s7 indicates the unvoiced state, the codeword having 0 in all of the 7 bits is allocated. When the voiced/unvoiced flag s7 indicates the voiced state, the remaining (i.e., 127 kinds of) codewords are allocated to the pitch index o7 and the aperiodic pitch index p7 based on the aperiodic flag n7. More specifically, when the aperiodic flag n7 is ON, a total of 28 codewords each having 1 in only one or two of the 7 bits are allocated to the aperiodic pitch index p7 (=aperiodic 0 to 27). The remaining (a total of 99) codewords are allocated to the periodic pitch index o7 (=periodic 0 to 98).

Table 5 is a periodic/aperiodic pitch and voiced/unvoiced information code producing table.

The voiced/unvoiced information may contain erroneous content due to transmission error. If an unvoiced frame is erroneously decoded as a voiced frame, the sound quality of reproduced speech is remarkably worsened because a periodic excitation is usually used for the voiced frame. However, the present invention produces the excitation signal based on an aperiodic pitch pulse by allocating the aperiodic pitch index p7 (=aperiodic 0 to 27) to the total of 28 codewords each having 1 in only one or two of the 7 bits. Thus, it becomes possible to reduce the influence of transmission error even when the unvoiced codeword (0×0) includes the transmission error of 1 or 2 bits.

Furthermore, although the above-described MELP system uses 1 bit to transmit the aperiodic flag, the present invention does not use this bit. Thus, it becomes possible to reduce the total number of bits required in the data transmission.

TABLE 5

Periodic/Aperiodic Pitch and Voiced/Unvoiced Information Code Producing Table

| code | index |
|---|---|
| 0x0 | unvoiced |
| 0x1 | aperiodic 0 |
| 0x2 | aperiodic 1 |
| 0x3 | aperiodic 2 |
| 0x4 | aperiodic 3 |
| 0x5 | aperiodic 4 |
| 0x6 | aperiodic 5 |
| 0x7 | periodic 0 |
| 0x8 | aperiodic 6 |
| 0x9 | aperiodic 7 |
| 0xA | aperiodic 8 |
| 0xB | periodic 1 |
| 0xC | aperiodic 9 |
| 0xD | periodic 2 |
| 0xE | periodic 3 |
| 0xF | periodic 4 |
| 0x10 | aperiodic 10 |
| 0x11 | aperiodic 11 |
| 0x12 | aperiodic 12 |
| 0x13 | periodic 5 |
| 0x14 | aperiodic 13 |
| 0x15 | periodic 6 |
| 0x16 | periodic 7 |
| 0x17 | periodic 8 |
| 0x18 | aperiodic 14 |
| 0x19 | periodic 9 |
| 0x1A | periodic 10 |
| 0x1B | periodic 11 |
| 0x1C | periodic 12 |
| 0x1D | periodic 13 |
| 0x1E | periodic 14 |
| 0x1F | periodic 15 |
| 0x20 | aperiodic 15 |
| 0x21 | aperiodic 16 |
| 0x22 | aperiodic 17 |
| 0x23 | periodic 16 |
| 0x24 | aperiodic 18 |
| 0x25 | periodic 17 |
| 0x26 | periodic 18 |
| 0x27 | periodic 19 |
| 0x28 | aperiodic 19 |
| 0x29 | periodic 20 |
| 0x2A | periodic 21 |
| 0x2B | periodic 22 |
| 0x2C | periodic 23 |
| 0x2D | periodic 24 |
| 0x2E | periodic 25 |
| 0x2F | periodic 26 |
| 0x30 | aperiodic 20 |
| 0x31 | periodic 27 |
| 0x32 | periodic 28 |
| 0x33 | periodic 29 |
| 0x34 | periodic 30 |
| 0x35 | periodic 31 |
| 0x36 | periodic 32 |
| 0x37 | periodic 33 |

TABLE 5-continued

Periodic/Aperiodic Pitch and Voiced/Unvoiced Information Code Producing Table

| code | index |
|---|---|
| 0x38 | periodic 34 |
| 0x39 | periodic 35 |
| 0x3A | periodic 36 |
| 0x3B | periodic 37 |
| 0x3C | periodic 38 |
| 0x3D | periodic 39 |
| 0x3E | periodic 40 |
| 0x3F | periodic 41 |
| 0x40 | aperiodic 21 |
| 0x41 | aperiodic 22 |
| 0x42 | aperiodic 23 |
| 0x43 | periodic 42 |
| 0x44 | aperiodic 24 |
| 0x45 | periodic 43 |
| 0x46 | periodic 44 |
| 0x47 | periodic 45 |
| 0x48 | aperiodic 25 |
| 0x49 | periodic 46 |
| 0x4A | periodic 47 |
| 0x4B | periodic 48 |
| 0x4C | periodic 49 |
| 0x4D | periodic 50 |
| 0x4E | periodic 51 |
| 0x4F | periodic 52 |
| 0x50 | aperiodic 26 |
| 0x51 | periodic 53 |
| 0x52 | periodic 54 |
| 0x53 | periodic 55 |
| 0x54 | periodic 56 |
| 0x55 | periodic 57 |
| 0x56 | periodic 58 |
| 0x57 | periodic 59 |
| 0x58 | periodic 60 |
| 0x59 | periodic 61 |
| 0x5A | periodic 62 |
| 0x5B | periodic 63 |
| 0x5C | periodic 64 |
| 0x5D | periodic 65 |
| 0x5E | periodic 66 |
| 0x5F | periodic 67 |
| 0x60 | aperiodic 27 |
| 0x61 | periodic 69 |
| 0x62 | periodic 69 |
| 0x63 | periodic 70 |
| 0x64 | periodic 71 |
| 0x65 | periodic 72 |
| 0x66 | periodic 73 |
| 0x67 | periodic 74 |
| 0x68 | periodic 75 |
| 0x69 | periodic 76 |
| 0x6A | periodic 77 |
| 0x6B | periodic 78 |
| 0x6C | periodic 79 |
| 0x6D | periodic 80 |
| 0x6E | periodic 81 |
| 0x6F | periodic 82 |
| 0x70 | periodic 83 |
| 0x71 | periodic 84 |
| 0x72 | periodic 85 |
| 0x73 | periodic 86 |
| 0x74 | periodic 87 |
| 0x75 | periodic 88 |
| 0x76 | periodic 89 |
| 0x77 | periodic 90 |
| 0x78 | periodic 91 |
| 0x79 | periodic 92 |
| 0x7A | periodic 93 |
| 0x7B | periodic 94 |
| 0x7C | periodic 95 |
| 0x7D | periodic 96 |
| 0x7E | periodic 97 |
| 0x7F | periodic 98 |

The bit packing unit 125 receives the quantized RMS value (i.e., gain information) d7, the LSF parameter index g7, and the periodic/aperiodic pitch and voiced/unvoiced information code t7, and outputs a speech information bit stream q7 by adding a sync bit (=1 bit). The speech information bit stream q7 includes 38 bits per frame (20 ms), as shown in Table 6. This embodiment can realize the speech coding speed equivalent to 1.9 kbps.

Furthermore, this embodiment does not transmit the harmonics amplitude information which is required in the MELP system. The reason is as follows. The speech coding frame interval (20 ms) is shorter than that (22.5 ms) of the MELP system. Accordingly, the period for obtaining the LSF parameter is shortened. The accuracy of spectrum expression can be enhanced. As a result, the harmonics amplitude information is not necessity.

TABLE 6

Invention System's Bit Allocation (1.9 kbps)

| parameter | bit number |
|---|---|
| LSF parameter | 25 |
| gain (one time)/frame | 5 |
| periodic/aperiodic pitch & voiced/unvoiced information code | 7 |
| sync bit | 1 |
| total bit/20 ms frame | 38 |

Next, the arrangement of a speech decoder employing the speech decoding method of the present invention will be explained with reference to FIG. 2.

A bit separator 131 receives a speech information bit stream a8 consisting of 38 bits for each frame and separates the input speech information bit stream a8 into a periodic/aperiodic pitch and voiced/unvoiced information code b8, a gain information i8, and an LSF parameter index f8.

A voiced/unvoiced information and pitch period decoder 132 receives the periodic/aperiodic pitch and voiced/unvoiced information code b8 to identify whether the current frame is the unvoiced state, the periodic state, or the aperiodic state based on the Table 5. When the current frame is the unvoiced state, the voiced/unvoiced information and pitch period decoder 132 outputs a pitch period c8 being set to a predetermined value (e.g., 50) and a voicing strength d8 being set to 0. When the current frame is the periodic or aperiodic state, the voiced/unvoiced information and pitch period decoder 132 outputs the pitch period c8 being processed by the decoding processing (by using Table 4 in case of the aperiodic state) and outputs the voicing strength d8 being set to 1.0.

A jitter setter 133 receives the periodic/aperiodic pitch and voiced/unvoiced information code b8 to identify whether the current frame is the unvoiced state, the periodic state, or the aperiodic state based on the Table 5. When the current frame is the unvoiced or aperiodic state, the jitter setter 133 outputs a jitter value e8 being set to a predetermined value (e.g., 0.25). When the current frame is the periodic state, the jitter setter 133 produces the jitter value e8 being set to 0.

An LSF decoder 134 decodes the LSF parameter index f8 and outputs a decoded $10^{th}$ order LSF coefficient g8. A tilt correction coefficient calculator 135 calculates a tilt correction coefficient h8 based on the $10^{th}$ order LSF coefficient g8 sent from the LSF decoder 134.

A gain decoder 136 decodes the gain information i8 and outputs a decoded gain j8.

A parameter interpolator 137 linearly interpolates each of input parameters, i.e., pitch period c8, voicing strength d8, jitter value e8, $10^{th}$ order LSF coefficient g8, tilt correction coefficient h8, and gain j8, in synchronism with the pitch period. The parameter interpolator 137 outputs the interpolated outputs k8, n8, l8, u8, v8, and w8 corresponding to respective input parameters. The linear interpolation processing is performed in accordance with the following formula:

interpolated parameter=current frame's parameter×int+previous frame's parameter×(1.0−int)

In this formula, the above input parameters c8, d8, e8, g8, h8, and j8 are the current frame's parameters. The above output parameters k8, n8, l8, u8, v8, and w8 are the interpolated parameters. The previous frame's parameters are the parameters c8, d8, e8, g8, h8, and j8 in the previous frame which are stored. Furthermore, "int" is an interpolation coefficient which is defined by the following formula:

int=t0/160 where 160 is the sample number per speech decoding frame interval (20 ms), while "t0" is a start point of each pitch period in the decoded frame and is renewed by adding the pitch period in response to every decoding of the reproduced speech of one pitch period. When "t0" exceeds 160, it means that the decoding processing of the decoded frame is accomplished. Thus, "t0" is initialized by subtracting 160 from it upon accomplishment of the decoding processing of each fame. When the interpolation coefficient "int" is fixed to 1.0, the linear interpolation processing is not performed in synchronism with the pitch period.

A pitch period calculator 138 receives the interpolated pitch period k8 and the interpolated jitter value l8 and calculates a pitch period m8 according to the following formula:

pitch period m8=pitch period k8×(1.0−jitter value 18×random number)

where the random number falls within a range from −1.0 to 1.0.

As the pitch period m8 has a fraction, the pitch period m8 is converted into an integer by counting the fraction over ½ as one and disregarding the rest. The pitch period m8 thus converted into an integer is referred to as "T," hereinafter. According to the above formula, a significant jitter is added to the unvoiced or aperiodic frame because a predetermined jitter value (e.g., 0.25) is set to the unvoiced or aperiodic frame. On the other hand, no jitter is added to the perfect periodic frame because the jitter value 0 is set to the perfect periodic frame. However, as the jitter value is interpolated for each pitch, the jitter value may be a value somewhere in a range from 0 to 0.25. This means that the pitch sections having intermediate jitter values may exist.

In this manner, generating the aperiodic pitch (i.e., jitter-added pitch) makes it possible to express an irregular (i.e., aperiodic) glottal pulse caused in the transitional period or by the unvoiced plosives as described in the explanation of the MELP system. Thus, the tone noise can be reduced.

A 1-pitch waveform decoder 152 decodes and outputs a reproduced speech e9 for every pitch period (T sample). Accordingly, all of blocks included in the 1-pitch waveform decoder 152 operate in synchronism with the pitch period T.

A first mixed excitation generator 141 receives a single pulse signal o8 produced from a single pulse generator 139 and a white noise p8 produced from a noise generator 140. One single pulse signal o8 is generated during the period of T sample. The sample value of others is 0. The first mixed excitation generator 141 synthesizes the single pulse signal o8 and the white noise p8 based on the interpolated voicing strength n8 (falling within a range of 0 to 1.0) according to the following formula, and outputs a first mixed excitation signal q8. In this case, the levels of the single pulse signal o8 and the white noise p8 are adjusted beforehand to become predetermined RMS values.

$1^{st}$ mixed excitation q8=single pulse signal o8×voicing strength n8+white noise p8×(1.0−voicing strength n8).

This processing suppresses abrupt change from the unvoiced excitation (i.e., white noise) to the voiced excitation (i.e., single pulse signal) or vice versa. Thus, it becomes possible to improve the quality of reproduced speech.

The produced first mixed excitation q8 is equal to the single pulse signal o8 when the voicing strength n8 is 1.0 (i.e., in the case of the perfect voiced frame), and is equal to the white noise p8 when the voicing strength n8 is 0 (i.e., in the case of the perfect unvoiced frame).

A linear prediction coefficient calculator 147 calculates a linear prediction coefficient x8 based on the interpolated $10^{th}$ order LSF coefficient u8. A spectral envelope shape calculator 146 obtains spectral envelope shape information y8 of the reproduced speech based on the linear prediction coefficient x8.

A practical example of this processing will be explained.

First, the transfer function of the LPC analysis filter is obtained by performing a T point DFT (Discrete Fourier Transform) on the linear prediction coefficient x8 and calculating the magnitude of the transformed value. Then, its inverse characteristics (corresponding to the spectral envelope shape of the reproduced speech) is obtained by inverting the obtained transfer function of the LPC analysis filter. Then, the obtained inverse characteristics is normalized and output as the spectral envelope shape information y8.

Figure 6A:
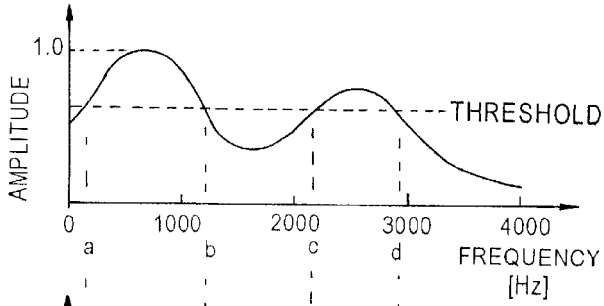
FIGS. 6A to 6F are views explaining the mixed excitation producing method in accordance with the decoding method of the present invention.

The spectral envelope shape information y8 is the information consisting of DFT coefficients representing the spectral envelope components of the reproduced speech ranging from 0 to 4,000 Hz as shown in FIG. 6A. The total number of DFr coefficients constituting the spectral envelope shape information y8 is T/2 when T is an even number and is (T−1)/2 when T is an odd number.

Figure 6B:
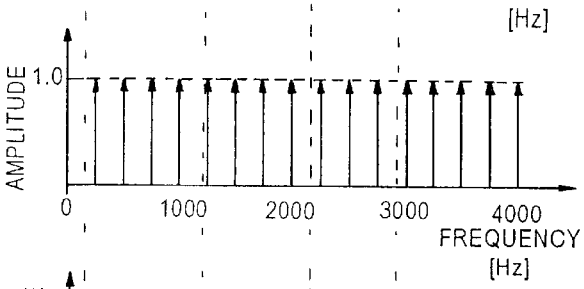
Figure 6C:
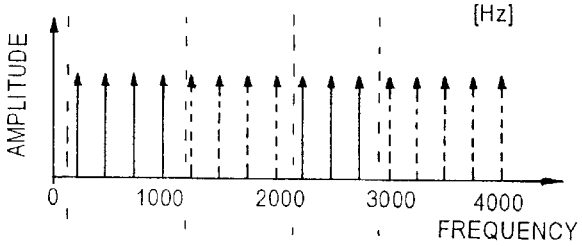

A mixed excitation filtering unit 142 receives the first mixed excitation q8 and performs the T point DFT on the received first mixed excitation q8 to obtain DFT coefficients. The total number of the obtained DFT coefficients is T/2 when T is an even number and is (T−1)/2 when T is an odd number, as shown in FIG. 6B. FIG. 6B shows a simplified case where the first mixed excitation q8 is a single pulse (=perfect voiced frame) and each DFT coefficient is 1.0. Next, the mixed excitation filtering unit 142 receives the spectral envelope shape information y8 and a threshold f9 to identify a voiced region (corresponding to the frequency regions a–b and c–d in FIG. 6A) where the DFT coefficient representing the spectral envelope shape information y8 is equal to or larger than the threshold. The remaining frequency region is referred to as unvoiced region. Then, the mixed excitation filtering unit 142 outputs a DFT coefficient string r8 including DFT coefficients of 0 corresponding to the unvoiced region and DFT coefficients of 1 corresponding to the voiced region identified as the DFT result of the first mixed excitation q8 (FIG. 6B). The solid lines shown in FIG. 6C represent the produced DFT coefficient string r8. An appropriate value of the threshold is in a range of 0.6 to 0.9. In this embodiment, the threshold is set to 0.8. Furthermore, the mixed excitation filtering unit 142 outputs another DFT coefficient string s8 including DFT coefficients of 0 corresponding to the voiced region and DFT coefficients of 1 corresponding to the unvoiced region identified as the DFT result of the first mixed excitation q8 (FIG. 6B). The dotted lines shown in FIG. 6C represent the produced DFT coefficient string s8. Namely, the mixed excitation filtering unit 142 separately produces the DFT coefficient strings r8 and s8: the DFT coefficient string r8 representing the frequency region (i.e., the voiced region) where the magnitude of the spectral envelope shape information y8 is equal to or larger than the threshold, and the DFT coefficient string s8 representing the frequency region (i.e., the unvoiced region) where the magnitude of the spectral envelope shape information y8 is smaller than the threshold.

Figure 6D:
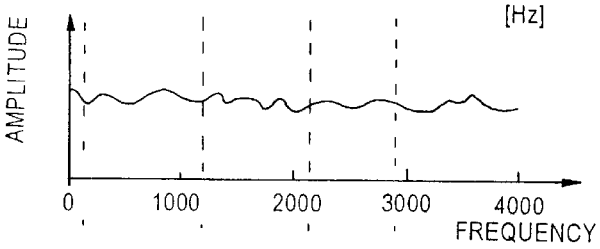
Figure 6E:
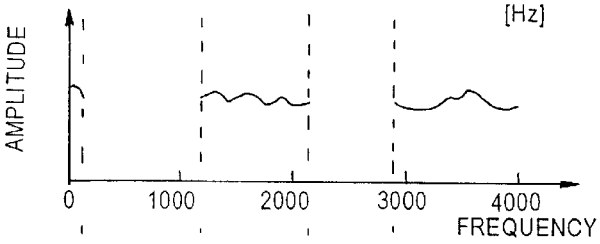

A noise excitation filtering unit 143 receives the white noise p8 and performs the T point DFT on the received white noise p8 to obtain DFT coefficients. The total number of the obtained DFT coefficients is T/2 when T is an even number and is (T−1)/2 when T is an odd number, as shown in FIG. 6D. Next, the noise excitation filtering unit 143 receives the spectral envelope shape information y8 and the threshold f9 to identify a frequency region (i.e., a voiced region) where the magnitude of the DFT coefficient representing the spectral envelope shape information y8 is equal to or larger than the threshold. And, the noise excitation filtering unit 143 outputs a DFT coefficient string t8 including DFT coefficients of 0 corresponding to the voiced region identified as the DFT result (FIG. 6D) of the white noise p8. FIG. 6E shows the produced DFT coefficient string t8.

A second mixed excitation generator 144 receives the DFT coefficient string s8 (i.e., dotted lines shown in FIG. 6C) and the DFT coefficient string t8 (i.e., FIG. 6E), and mixes the received strings s8 and t8 at a predetermined ratio to produce a resulting DFT coefficient string z8. According to this embodiment, the DFT coefficient string s8 and the DFT coefficient string t8 are mixed by the ratio of 6:4. In this mixing operation, it is preferable that the DFT coefficient string s8 is somewhere in the range from 0.5 to 0.7 while the DFT coefficient string t8 is somewhere in the range from 0.5 to 0.3.

Figure 6F:
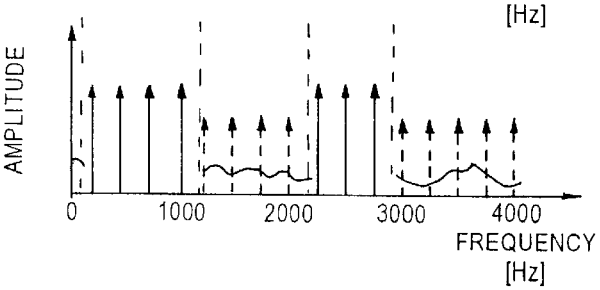

A third mixed excitation generator 145 receives the DFT coefficient string r8 and the DFT coefficient string z8 and sums them FIG. 6F shows a summed-up DFT coefficient result. Then, the third mixed excitation generator 145 performs the IDFT (i.e., Inverse Discrete Fourier Transform) to restore a time base waveform, thereby producing a mixed excitation signal g9.

In the case of the perfect unvoiced frame, as its voicing strength n8 is 0, the first mixed excitation q8 and the mixed excitation signal g9 become equal to the white noise p8. Accordingly, before performing the processing of producing the mixed excitation signal g9, a switcher 153 monitors the voicing strength n8. When the voicing strength n8 is 0 (=perfect unvoiced frame), the switcher 153 selects the white noise p8 as a mixed excitation signal a9. Otherwise, the switcher 153 selects the mixed excitation signal g9 as the mixed excitation signal a9. With this selecting operation, it becomes possible to reduce the substantial processing amount of the perfect unvoiced frame.

The effect of the above-described production of the mixed excitation using the spectral envelope shape calculator 146, the mixed excitation filtering unit 142, the noise excitation filtering unit 143, the second mixed excitation generator 144, and the third mixed excitation generator 145 will be explained hereinafter.

Figure 7:
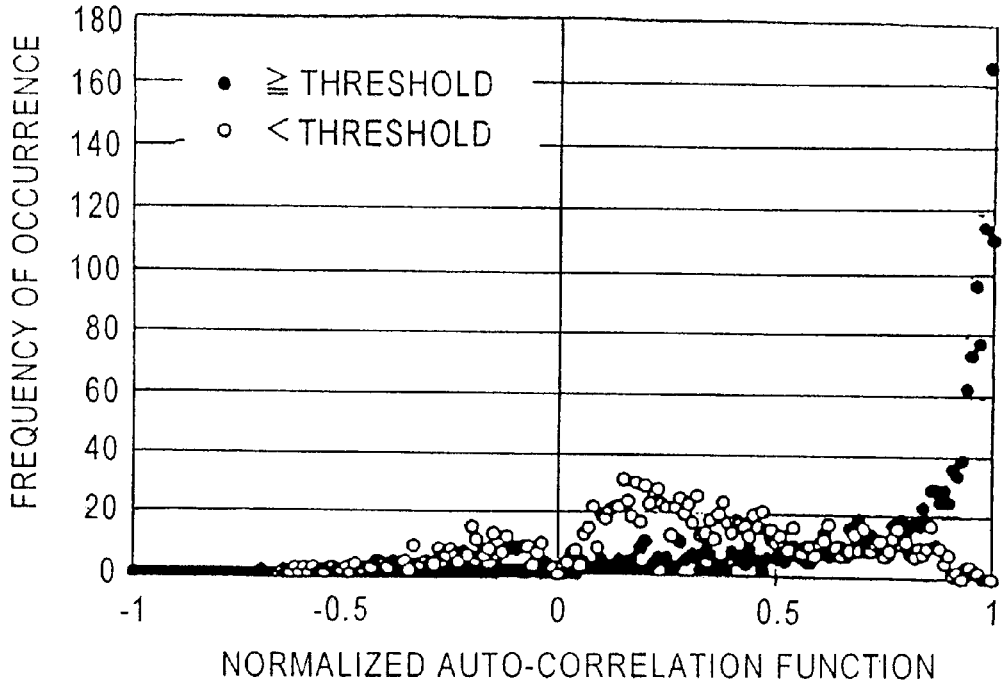
FIG. 7 is a graph showing the frequency of occurrence in relation to the normalized auto-correlation function.
Figure 8:
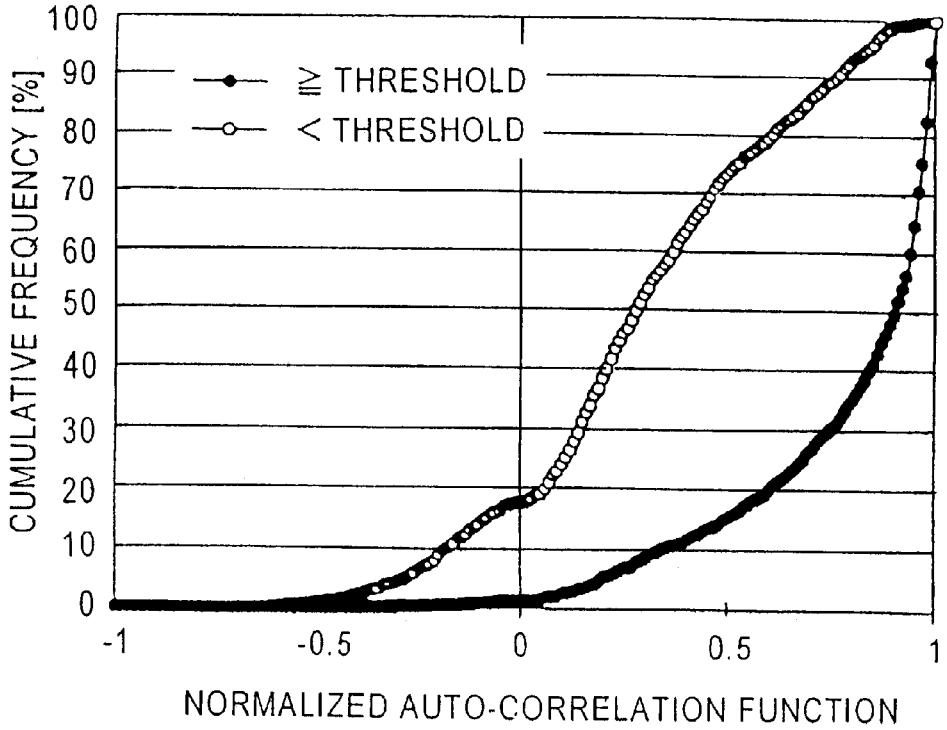
FIG. 8 is a graph showing the cumulative frequency in relation to the normalized auto-correlation function.

The spectral envelope shape is obtained from the input speech signal, and divided into the frequency components having the magnitude equal to or larger than the threshold and the frequency components having the magnitude not larger than the threshold. The normalized auto-correlation functions of their time base waveforms are obtained with the delay time of the pitch period. FIG. 7 shows the measured result of the frequency of occurrence in relation to the normalized auto-correlation function. FIG. 8 shows its cumulative frequency in relation to the normalized auto-correlation function. In this measurement, only the voiced frames (i.e., periodic and aperiodic frames) are regarded as effective. A total of 36.22[s] (1,811 frames) speech data, collected from four male speakers and four female speakers (2 speech samples/person), were used in this measurement. The effective frames (i.e., voiced frames) were 1,616 frames of 1,811 frames. The threshold used in this embodiment was 0.8.

As understood from FIGS. 7 and 8, the components whose magnitude in the spectral envelope shape is equal to or larger than the threshold are concentrated to or in the vicinity of 1.0 (i.e., maximum value) in the distribution of the normalized auto-correlation function. The components whose magnitude in the spectral envelope shape is smaller than the threshold have a peak of or near 0.25 and stretch widely in the distribution of the normalized auto-correlation function. As the normalized auto-correlation function becomes large, the periodic nature of the input speech becomes strong. On the other hand, as the normalized auto-correlation function becomes small, the periodic nature of the input speech becomes weak (i.e., becomes similar to the white noise).

Accordingly, to produce the mixed excitation, it is preferable to add the white noise to only the frequency region where the magnitude of the spectral envelope shape is smaller than the threshold.

Through this processing, it becomes possible to reduce the buzz sound, i.e., the problem "A" of the above-described LPC system, without requiring the transmission of the voiced information of respective frequency bands which is required in the MELP system.

The method proposed in the reference [6] (i.e., the decoder for a proposed linear predictive analysis/synthesis system) can reduce the problem "A" (i.e., buzz sound) of the above-described LPC system. However, this method has the problem such that the quality of reproduced sound has noise-like sound quality. The reason is as follows.

In FIG. 8, in the case of frequency components (indicated by ○) having the magnitude of the spectrum envelope shape smaller than the threshold, approximately 20% thereof has the normalized auto-correlation function being equal to or larger than 0.6. accordingly, if the frequency region having the magnitude of the spectrum envelope shape smaller than the threshold is completely replaced by the white noise in all of the frames, the noise-like nature of the reproduced speech will increase. Thus, the sound quality will be worsened. In this respect, the above-described coding/decoding method of the present invention can solve this problem.

An adaptive spectral enhancement filter 148 is an adaptive pole/zero filter with a coefficient obtained by applying the bandwidth expansion processing to the linear prediction coefficient x8. As shown in Table 2-③, this enhances the naturalness of the reproduced speech by sharpening the formant resonance and also by improving the similarity to the formant of the natural speech. Furthermore, the adaptive spectral enhancement filter 148 corrects the tilt of the spectrum based on the interpolated tilt correction coefficient v8 so as to reduce the lowpass muffling effect.

The adaptive spectral enhancement filter 148 filters the output a9 of the switcher 153, and outputs a filtered excitation signal b9.

An LPC synthesis filter 149 is an all-pole filter with a coefficient equal to the linear prediction coefficient x8. The LPC synthesis filter 149 adds the spectral envelope information to the excitation signal b9 produced from the adaptive spectral enhancement filter 149, and outputs a resulting signal c9. A gain adjuster 150 applies the gain adjustment to the output signal c9 of the LPC synthesis filter 149 by using the gain information w8, and outputs an adjusted signal d9. A pulse dispersion filter 151 is a filter for improving the similarity of the pulse excitation waveform with respect to the glottal pulse waveform of the natural speech. The pulse dispersion filter 151 filters the output signal d9 of the gain adjuster 150 and outputs a reproduced speech e9 having improved naturalness. The effect of the pulse dispersion filter 151 is shown in Table 2-④.

The above-described speech coding apparatus and speech decoding apparatus of the present invention can be easily realized by a DSP (i.e., Digital Signal Processor).

Furthermore, the previously described speech decoding method of the present invention can be realized even in the LPC system using the conventional speech encoder.

Furthermore, the number of the above-described quantization levels, the bit number of codewords, the speech coding frame interval, the order of the linear prediction coefficient or the LSF coefficient, and the cutoff frequency of each filter are not limited to the disclosed specific values and therefore can be modified appropriately.

As described above, by using the speech coding and decoding method and apparatus of the first embodiment, it becomes possible to reduce the buzz sound and the tone noise without transmitting the additional information bits. Thus, the present invention can improve the sound quality by solving the problems in the conventional LPC system, i.e., deterioration of the sound quality due to the buzz sound and the tone noise. Furthermore, the present invention can reduce the coding speed compared with that of the conventional MELP system. Accordingly, in the radio communications, it becomes possible to more effectively utilize the limited frequency resource.

Second Embodiment

Hereinafter, the speech coding and decoding method and apparatus in accordance with a second embodiment of the present invention will be explained with reference to FIGS. 9 to 17. Although the following preferred embodiment is explained by using practical values, it is needless to say that the present invention can be realized by using other appropriate values.

FIG. 9 is a block diagram showing the circuit arrangement of a speech encoder employing the speech coding method of the present invention.

A framing unit 1111 is a buffer which stores an input speech sample a7' having being bandpass-limited to the frequency range of 100–3,800 Hz and sampled at the frequency of 8 kHz and then quantized to the accuracy of at least 12 bits. The framing unit 1111 fetches the speech samples (160 samples) for every single speech coding frame (20 ms), and sends an output b7' to a speech coding processing section.

Hereinafter, the processing performed for every single speech coding frame will be explained.

A gain calculator 1112 calculates a logarithm of an RMS value serving as the level information of the received speech b7', and outputs a resulting logarithmic RMS value c7'. A first quantizer 1113 linearly quantizes the logarithmic RMS value c7' to 5 bits, and outputs a resulting quantized data d7' to a bit packing unit 1125.

A linear prediction analyzer 1114 performs the linear prediction analysis on the output b7' of the framing unit 1111 by using the Durbin-Levinson method, and outputs a $10^{th}$ order linear prediction coefficient e7' which serves as spectral envelope information. An LSF coefficient calculator 1115 converts the $10^{th}$ order linear prediction coefficient e7' into a $10^{th}$ order LSF (i.e., Line Spectrum Frequencies) coefficient f7'.

A second quantizer 1116 quantizes the $10^{th}$ order LSF coefficient f7' to 19 bits by selectively using the non-memory vector quantization based on a multistage (three stages) vector quantization and the predictive (memory) vector quantization. The second quantizer 1116 sends a resulting LSF parameter index g7' to the bit packing unit 1125. For example, the second quantizer 1116 enters the received $10^{10}$ order LSF coefficient f7' to a three-stage non-memory vector quantizer of 7-, 6- and 5-bits and to a three-stage predictive vector quantizer of 7-, 6- and 5-bits. Then, the second quantizer 1116 selects either of thus produced quantized values according to a distance calculation between them to the received $10^{th}$ order LSF coefficient f7', and outputs a switch bit (1 bit) representing the selection result. Details of such a quantizer is disclosed in the reference, by T. Eriksson, J. Linden and J. Skoglund, titled "EXPLOITING INTERFRAME CORRELATION IN SPECTRAL QUANTIZATION A STUDY OF DIFFERENT MEMORY VQ SCHEMES." Proc. ICASSP, pp 765–768, 1995.

A low pass filter (LPF) 1120 applies the filtering operation to the output b7' of the framing unit 1111 at the cutoff frequency 1,000 Hz, and outputs a filtered output k7'. A pitch detector 1121 obtains a pitch period from the filtered output k7', and outputs an obtained pitch period m7'. The pitch period is given or defined as a delay amount which maximizes a normalized auto-correlation function. The pitch detector 1121 outputs a maximum value l7' of the normalized auto-correlation function at this moment. The maximum value l7' of the normalized auto-correlation function serves as information representing the periodic strength of the input signal b7'. This information is used in a later-described aperiodic flag generator 1122. Furthermore, the maximum value l7' of the normalized auto-correlation function is corrected in a later-described correlation function corrector 1119. Then, a corrected maximum value j7' of the normalized auto-correlation function is sent to a first voiced/unvoiced identifier 1126 to make the voiced/unvoiced judgement. When the corrected maximum value j7' of the normalized auto-correlation function is equal to or smaller than a predetermined threshold (e.g., 0.6), it is judged that a current frame is an unvoiced state. Otherwise, it is judged that the current frame is a voiced state. The first voiced/unvoiced identifier 1126 outputs a voiced/unvoiced flag s7' representing the result in the voiced/unvoiced judgement. The voiced/unvoiced flag s7' is equivalent to the voiced/unvoiced discriminating information for the low frequency band.

A third quantizer 1123 receives the pitch period m7' and converts it into a logarithmic value, and then linearly quantizes the logarithmic value by using 99 levels. A resulting pitch index o7' is sent to a periodic/aperiodic pitch and voiced/unvoiced information code generator 1127.

Figure 11:
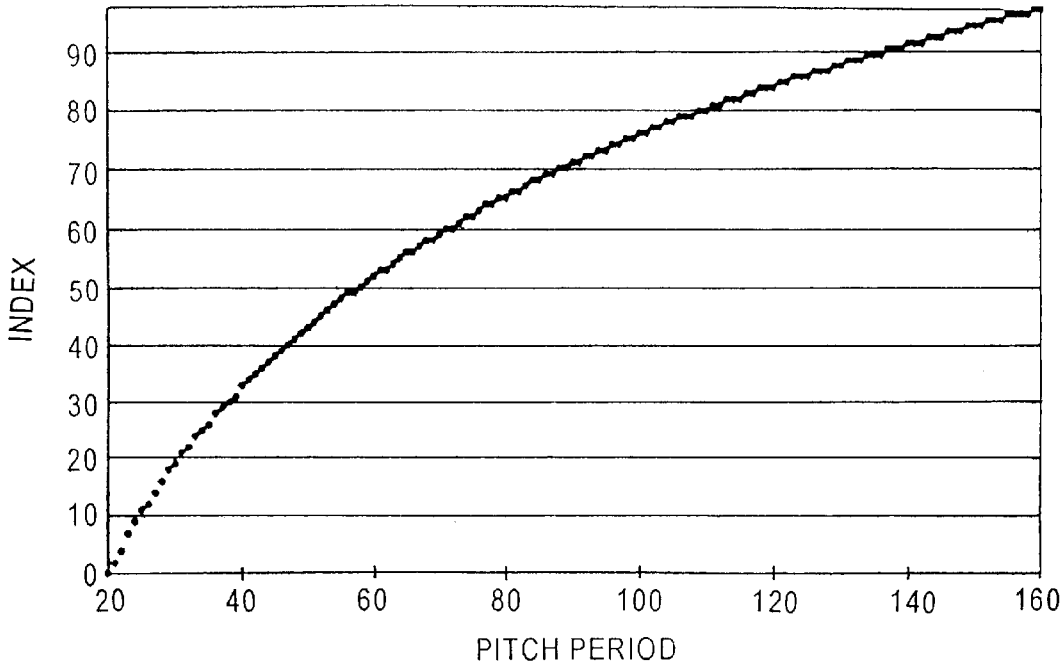
FIG. 11 is a graph showing the relationship between the pitch period and the index.

FIG. 11 shows the relationship between the pitch period (ranging from 20 to 160 samples) entered into the third quantizer 1123 and the index value produced from the third quantizer 1123.

The aperiodic flag generator 1122 receives the maximum value l7' of the normalized auto-correlation function, and outputs an aperiodic flag n7' of 1 bit to an aperiodic pitch index generator 1124 and also to the periodic/aperiodic pitch and voiced/unvoiced information code generator 1127. More specifically, the aperiodic flag n7' is set to ON when the maximum value l7' of the normalized auto-correlation function is smaller than a predetermined threshold (e.g., 0.5), and is set to OFF otherwise. When the aperiodic flag n7' is ON, it means that the current frame is an aperiodic excitation.

An LPC analysis filter 1117 is an all-zero filter with a coefficient equal to the $10^{th}$ order linear prediction coefficient e7', which removes the spectrum envelope information from the input speech b7' and outputs a residual signal h7'. A peakiness calculator 1118 receives the residual signal h7' to calculate a peakiness value and outputs a calculated peakiness value i7'. The calculation method of the peakiness value is substantially the same as that explained in the above-described MELP system.

The correlation function corrector 1119 receives the peakiness value i7' from the peakiness calculator 1118, and sets the maximum value l7' of the normalized auto-correlation function to 1.0 (=voiced state) when the peakiness value i7' is larger than a predetermined value (e.g., 1.34). Thus, the corrected maximum value j7' of the normalized auto-correlation function is produced from the correlation function corrector 1119. Furthermore, the correlation function corrector 1119 directly outputs the non-corrected maximum value l7' of the normalized auto-correlation function when the peakiness value i7' is not larger than the above value.

The above-described calculation of the peakiness value and correction of the correlation function is the processing for detecting a jitter-including frame and unvoiced plosives and for correcting the maximum of the normalized auto-correlation function to 1.0 (=voiced state). The jitter-including frame or the unvoiced plosive has a locally appearing spike (i.e., a sharp peak) with the remaining white noise-like portion. Thus, at the timing before the correction, there is a large possibility that its normalized auto-correlation function becomes a value smaller than 0.5. In other words, there is a large possibility that the aperiodic flag is set to ON. On the other hand, the peakiness value becomes large. Hence, if the jitter-including frame or the unvoiced plosives is detected based on the peakiness value, the normalized auto-correlation function can be corrected to 1.0. It will be later judged to be the voiced state in the voiced/unvoiced judgement performed in the first voiced/unvoiced identifier 1126. In the decoding operation, the sound quality of the jitter-including frame or the unvoiced plosive can be improved by using the aperiodic pulse excitation.

Next, the aperiodic pitch index generator 1124 and the periodic/aperiodic pitch and voiced/unvoiced information code generator 1127 will be explained. By using these generators 1124 and 1127, the periodic/aperiodic discriminating information is transmitted to a later-described decoder. The decoder switches the periodic pulse/aperiodic pulse to reduce the tone noise, thereby solving the previously-described problem "B" of the LPC system.

The aperiodic pitch index generator 1124 applies a non-uniform quantization with 28 levels to the pitch period m7' of an periodic frame and outputs an aperiodic pitch index p7'.

This processing will be explained in more detail hereinafter.

Figure 12:
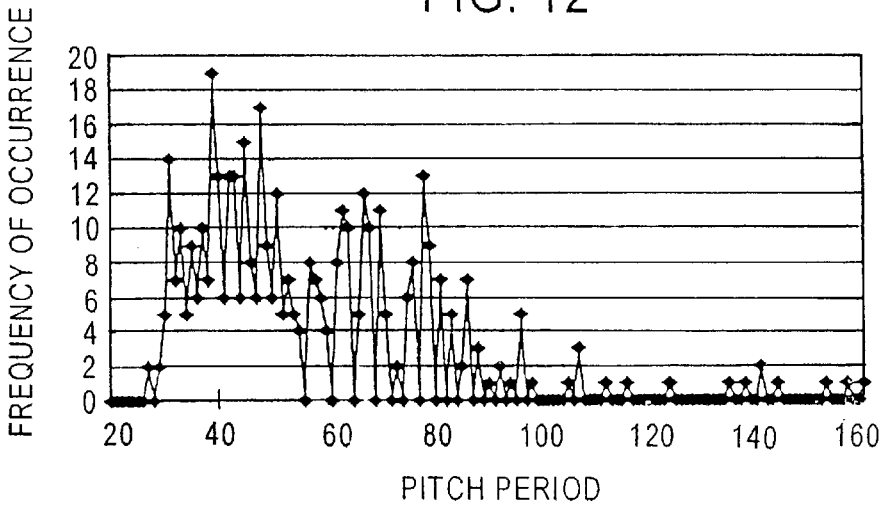
FIG. 12 is a graph showing the frequency of occurrence in relation to the pitch period.
Figure 13:
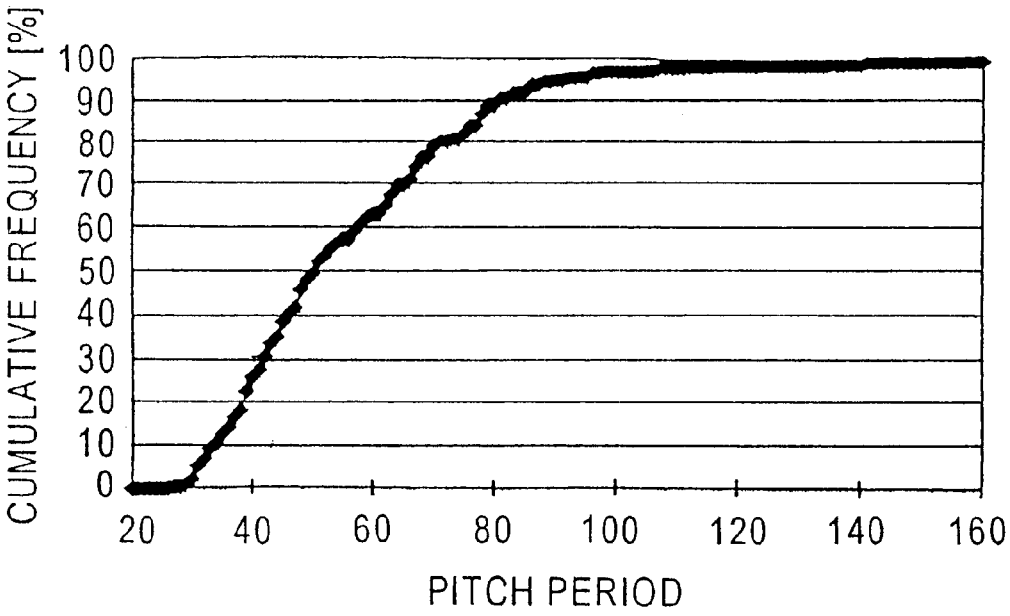
FIG. 13 is a graph showing the cumulative frequency in relation to the pitch period.

FIG. 12 shows the frequency distribution of the pitch period with respect to a frame (corresponding to the jitter-including frame in the transitional state or the unvoiced plosive frame) having the voiced/unvoiced flag s7' indicating the voiced state and the aperiodic flag n7' indicating ON. FIG. 13 shows its cumulative frequency distribution. FIGS. 12 and 13 show the measurement result of a total of 112.12[s] (5,606 frames) speech data collected from four male speakers and four female speakers (6 speech samples/person). The frames satisfying the above-described conditions (voiced/unvoiced flag s7'=voiced state, and aperiodic flag n7'=ON) are 425 frames of 5,606 frames. From FIGS. 12 and 13, it is understood that the frames satisfying the above conditions (hereinafter, referred to aperiodic frame) has the pitch period distribution concentrated in the region from 25 to 100. Accordingly, it becomes possible to realize a highly efficient data transmission by performing the non-uniform quantization based on the measured frequency (frequency of occurrence). Namely, the pitch period is quantized finely when the frequency of occurrence is large, while the pitch period is quantized roughly when the frequency of occurrence is small.

Furthermore, as described later, the pitch period of the aperiodic frame is calculated in the decoder by the following formula.

$$\text{pitch period of aperiodic frame} = \text{transmitted pitch period} \times (1.0 + 0.25 \times \text{random number})$$

In the above formula, the transmitted pitch period is a pitch period transmitted by the aperiodic pitch index produced from the aperiodic pitch index generator 1124. A significant jitter is added for each pitch period by multiplying (1.0+0.25×random number). Accordingly, the added jitter amount becomes large when the pitch period is large. Thus, the rough quantization is allowed.

Table 7 shows the example of the quantization table for the pitch period of the aperiodic frame according to the above consideration. According to Table 7, the region of input pitch period 20–24 is quantized to 1 level. The region of input pitch period 25–50 is quantized to a total of 13 levels (by the increments of 2 step width). The region of input pitch period 51–95 is quantized to a total of 9 levels (by the increments of 5 step width). The region of input pitch period 96–135 is quantized to a total of 4 levels (by the increments of 10 step width). And, the range of pitch period 136–160 is quantized to 1 level. As a result, quantized indexes (aperiodic 0 to 27) are outputted.

The above quantization for the pitch period of the aperiodic frame only requires 28 levels by considering the frequency of occurrence as well as the decoding method, whereas the ordinary quantization for the pitch period requires 64 levels or more.

TABLE 7

Quantization Table for Pitch Period of Aperiodic Frame

| pitch period of aperiodic frame | quantized pitch period of aperiodic frame | index |
|---|---|---|
| 20–24 | 24 | aperiodic 0 |
| 25, 26 | 26 | aperiodic 1 |
| 27, 28 | 28 | aperiodic 2 |
| 29, 30 | 30 | aperiodic 3 |
| 31, 32 | 32 | aperiodic 4 |
| 33, 34 | 34 | aperiodic 5 |
| 35, 36 | 36 | aperiodic 6 |
| 37, 38 | 38 | aperiodic 7 |
| 39, 40 | 40 | aperiodic 8 |
| 41, 42 | 42 | aperiodic 9 |

TABLE 7-continued

Quantization Table for Pitch Period of Aperiodic Frame

| pitch period of aperiodic frame | quantized pitch period of aperiodic frame | index |
|---|---|---|
| 43, 44 | 44 | aperiodic 10 |
| 45, 46 | 46 | aperiodic 11 |
| 47, 48 | 48 | aperiodic 12 |
| 49, 50 | 50 | aperiodic 13 |
| 51–55 | 55 | aperiodic 14 |
| 56–60 | 60 | aperiodic 15 |
| 61–65 | 65 | aperiodic 16 |
| 66–70 | 70 | aperiodic 17 |
| 71–75 | 75 | aperiodic 18 |
| 76–80 | 80 | aperiodic 19 |
| 81–85 | 85 | aperiodic 20 |
| 86–90 | 90 | aperiodic 21 |
| 91–95 | 95 | aperiodic 22 |
| 96–105 | 100 | aperiodic 23 |
| 106–115 | 110 | aperiodic 24 |
| 116–125 | 120 | aperiodic 25 |
| 126–135 | 130 | aperiodic 26 |
| 136–160 | 140 | aperiodic 27 |

The periodic/aperiodic pitch and voiced/unvoiced information code generator 1127 receives the voiced/unvoiced flag s7', the aperiodic flag n7', the pitch index o7', and the aperiodic pitch index p7', and outputs a periodic/aperiodic pitch and voiced/unvoiced information code t7' of 7 bits (128 levels).

The coding processing of the periodic/aperiodic pitch and voiced/unvoiced information code generator 1127 is performed in the following manner.

When the voiced/unvoiced flag s7' indicates the unvoiced state, the codeword having 0 in all of the 7 bits is allocated. When the voiced/unvoiced flag s7' indicates the voiced state, the remaining (i.e., 127 kinds of) codewords are allocated to the pitch index o7' and the aperiodic pitch index p7' based on the aperiodic flag n7'. More specifically, when the aperiodic flag n7' is ON, a total of 28 codewords each having 1 in only one or two of the 7 bits are allocated to the aperiodic pitch index p7' (=aperiodic 0 to 27). The remaining (a total of 99) codewords are allocated to the periodic pitch index o7' (=periodic 0 to 98).

Table 8 is the periodic/aperiodic pitch and voiced/unvoiced information code producing table.

The voiced/unvoiced information may contain erroneous content due to transmission error. If an unvoiced frame is erroneously decoded as a voiced frame, the sound quality of reproduced speech is remarkably worsened because a periodic excitation is usually used for the voiced frame. However, the present invention produces the excitation signal based on an aperiodic pitch pulse by allocating the aperiodic pitch index p7' (=aperiodic 0 to 27) to the total of 28 codewords each having 1 in only one or two of the 7 bits. Thus, it becomes possible to reduce the influence of transmission error even when the unvoiced codeword (0×0) includes the transmission error of 1 or 2 bits. It is also possible to allocate all 1 (0×7F) to the unvoiced codeword and allocate the codewords having 0 in only one or two of the 7 bits to the aperiodic pitch index.

Furthermore, although the above-described MELP system uses 1 bit to transmit the aperiodic flag, the present invention does not use this bit. Thus, it becomes possible to reduce the total number of bits required in the data transmission.

TABLE 8

| Periodic/Aperiodic Pitch and Voiced/Unvoiced Information Code Producing Table | |
|---|---|
| code | index |
| 0x0 | unvoiced |
| 0x1 | aperiodic 0 |
| 0x2 | aperiodic 1 |
| 0x3 | aperiodic 2 |
| 0x4 | aperiodic 3 |
| 0x5 | aperiodic 4 |
| 0x6 | aperiodic 5 |
| 0x7 | periodic 0 |
| 0x8 | aperiodic 6 |
| 0x9 | aperiodic 7 |
| 0xA | aperiodic 8 |
| 0xB | periodic 1 |
| 0xC | aperiodic 9 |
| 0xD | periodic 2 |
| 0xE | periodic 3 |
| 0xF | periodic 4 |
| 0x10 | aperiodic 10 |
| 0x11 | aperiodic 11 |
| 0x12 | aperiodic 12 |
| 0x13 | periodic 5 |
| 0x14 | aperiodic 13 |
| 0x15 | periodic 6 |
| 0x16 | periodic 7 |
| 0x17 | periodic 8 |
| 0x18 | aperiodic 14 |
| 0x19 | periodic 9 |
| 0x1A | periodic 10 |
| 0x1B | periodic 11 |
| 0x1C | periodic 12 |
| 0x1D | periodic 13 |
| 0x1E | periodic 14 |
| 0x1F | periodic 15 |
| 0x20 | aperiodic 15 |
| 0x21 | aperiodic 16 |
| 0x22 | aperiodic 17 |
| 0x23 | periodic 16 |
| 0x24 | aperiodic 18 |
| 0x25 | periodic 17 |
| 0x26 | periodic 18 |
| 0x27 | periodic 19 |
| 0x28 | aperiodic 19 |
| 0x29 | periodic 20 |
| 0x2A | periodic 21 |
| 0x2B | periodic 22 |
| 0x2C | periodic 23 |
| 0x2D | periodic 24 |
| 0x2E | periodic 25 |
| 0x2F | periodic 26 |
| 0x30 | aperiodic 20 |
| 0x31 | periodic 27 |
| 0x32 | periodic 28 |
| 0x33 | periodic 29 |
| 0x34 | periodic 30 |
| 0x35 | periodic 31 |
| 0x36 | periodic 32 |
| 0x37 | periodic 33 |
| 0x38 | periodic 34 |
| 0x39 | periodic 35 |
| 0x3A | periodic 36 |
| 0x3B | periodic 37 |
| 0x3C | periodic 38 |
| 0x3D | periodic 39 |
| 0x3E | periodic 40 |
| 0x3F | periodic 41 |
| 0x40 | aperiodic 21 |
| 0x41 | aperiodic 22 |
| 0x42 | aperiodic 23 |
| 0x43 | periodic 42 |
| 0x44 | aperiodic 24 |
| 0x45 | periodic 43 |
| 0x46 | periodic 44 |
| 0x47 | periodic 45 |
| 0x48 | aperiodic 25 |
| 0x49 | periodic 46 |

TABLE 8-continued

| Periodic/Aperiodic Pitch and Voiced/Unvoiced Information Code Producing Table | |
|---|---|
| code | index |
| 0x4A | periodic 47 |
| 0x4B | periodic 48 |
| 0x4C | periodic 49 |
| 0x4D | periodic 50 |
| 0x4E | periodic 51 |
| 0x4F | periodic 52 |
| 0x50 | aperiodic 26 |
| 0x51 | periodic 53 |
| 0x52 | periodic 54 |
| 0x53 | periodic 55 |
| 0x54 | periodic 56 |
| 0x55 | periodic 57 |
| 0x56 | periodic 58 |
| 0x57 | periodic 59 |
| 0x58 | periodic 60 |
| 0x59 | periodic 61 |
| 0x5A | periodic 62 |
| 0x5B | periodic 63 |
| 0x5C | periodic 64 |
| 0x5D | periodic 65 |
| 0x5E | periodic 66 |
| 0x5F | periodic 67 |
| 0x60 | aperiodic 27 |
| 0x61 | periodic 69 |
| 0x62 | periodic 69 |
| 0x63 | periodic 70 |
| 0x64 | periodic 71 |
| 0x65 | periodic 72 |
| 0x66 | periodic 73 |
| 0x67 | periodic 74 |
| 0x68 | periodic 75 |
| 0x69 | periodic 76 |
| 0x6A | periodic 77 |
| 0x6B | periodic 78 |
| 0x6C | periodic 79 |
| 0x6D | periodic 80 |
| 0x6E | periodic 81 |
| 0x6F | periodic 82 |
| 0x70 | periodic 83 |
| 0x71 | periodic 84 |
| 0x72 | periodic 85 |
| 0x73 | periodic 86 |
| 0x74 | periodic 87 |
| 0x75 | periodic 88 |
| 0x76 | periodic 89 |
| 0x77 | periodic 90 |
| 0x78 | periodic 91 |
| 0x79 | periodic 92 |
| 0x7A | periodic 93 |
| 0x7B | periodic 94 |
| 0x7C | periodic 95 |
| 0x7D | periodic 96 |
| 0x7E | periodic 97 |
| 0x7F | periodic 98 |

A high pass filter (i.e., HPF) 1128 applies the filtering operation to the output b7' of the framing unit 1111 at the cutoff frequency 1,000 Hz, and output a filtered output u7' of high-frequency components equal to or larger than 1,000 Hz. A correlation function calculator 1129 calculates a normalized auto-correlation function v7' of the filtered output u7' at a delay amount corresponding to the pitch period m7'. A second voiced/unvoiced identifier 1130 judges that a current frame is a voiced state when the normalized auto-correlation function v7' is equal to or smaller than a threshold (e.g., 0.5) and otherwise judges that the current frame is an unvoiced state. Based on this judgement, the second voiced/unvoiced identifier 1130 produces a high-frequency band voiced/unvoiced flag w7' which is equivalent to voiced/unvoiced discriminating information for the high frequency band.

The bit packing unit 1125 receives the quantized RMS value (i.e., gain information) d7', the LSF parameter index g7', the periodic/aperiodic pitch and voiced/unvoiced information code t7', and the high-frequency band voiced/unvoiced flag w7', and outputs a speech information bit stream q7'. The speech information bit stream q7' includes 32 bits per frame (20 ms), as shown in Table 9. This embodiment can realize the speech coding speed equivalent to 1.6 kbps.

Furthermore, this embodiment does not transmit the harmonics amplitude information which is required in the MELP system. The reason is as follows. The speech coding frame interval (20 ms) is shorter than that (22.5 ms) of the MELP system. Accordingly, the period for obtaining the LSF parameter is shortened. The accuracy of spectrum expression can be enhanced. As a result, the harmonics amplitude information is not necessity.

Although the HPF 1128, the correlation function calculator 1129 and the second voiced/unvoiced identifier 1130 cooperatively transmit the high-frequency band voiced/unvoiced flag w7', it is not always necessary to transmit the high-frequency band voiced/unvoiced flag w7'.

TABLE 9

Invention System's Bit Allocation (1.6 kbps)

| parameter | bit number |
|---|---|
| LSF parameter | 19 |
| gain (one time)/frame | 5 |
| periodic/aperiodic pitch & voiced/unvoiced information code | 7 |
| high frequency band voice/unvoiced flag | 1 |
| total bit/20 ms frame | 32 |

Next, the arrangement of a speech decoder employing the speech decoding method of the present invention will be explained with reference to FIG. 10, which is capable of decoding the speech information bit stream encoded by the above-described speech encoder.

A bit separator 1131 receives a speech information bit stream a8' consisting of 32 bits for each frame and separates the input speech information bit stream a8' into a periodic/aperiodic pitch and voiced/unvoiced information code b8', a high frequency band voiced/unvoiced flag f8', a gain information m8', and an LSF parameter index h8'.

A voiced/unvoiced information and pitch period decoder 1132 receives the periodic/aperiodic pitch and voiced/unvoiced information code b8' to identify whether the current frame is the unvoiced state, the periodic state, or the aperiodic state based on the Table 8. When the current frame is the unvoiced state, the voiced/unvoiced information and pitch period decoder 1132 outputs a pitch period c8' being set to a predetermined value (e.g., 50) and a voiced/unvoiced flag d8' being set to 0. When the current frame is the periodic or aperiodic state, the voiced/unvoiced information and pitch period decoder 1132 outputs the pitch period c8' being processed by the decoding processing (by using Table 7 in case of the aperiodic state) and outputs the voiced/unvoiced flag d8' being set to 1.0.

A jitter setter 1133 receives the periodic/aperiodic pitch and voiced/unvoiced information code b8' to identify whether the current frame is the unvoiced state, the periodic state, or the aperiodic state based on the Table 8. When the current frame is the unvoiced or aperiodic state, the jitter setter 1133 outputs a jitter value e8' being set to a predetermined value (e.g., 0.25). When the current frame is the periodic state, the jitter setter 1133 produces the jitter value e8' being set to 0.

An LSF decoder 1138 decodes the LSF parameter index h8' and outputs a decoded $10^{th}$ order LSF coefficient i8'.

A tilt correction coefficient calculator 1137 calculates a tilt correction coefficient j8' based on the $10^{th}$ order LSF coefficient i8' sent from the LSF decoder 1138.

A gain decoder 1139 decodes the gain information m8' and outputs a decoded gain information n8'.

A first linear prediction calculator 1136 converts the LSF coefficient i8' into a linear prediction coefficient k8'.

A spectral envelope amplitude calculator 1135 calculates a spectral envelope amplitude l8' based on the linear prediction coefficient k8'.

As described above, the voiced/unvoiced flag d8' is equivalent to the voiced/unvoiced discriminating information for the low frequency band, while the high frequency band voiced/unvoiced flag f8' is equivalent to the voiced/unvoiced discriminating information for the high frequency band.

Figure 14:
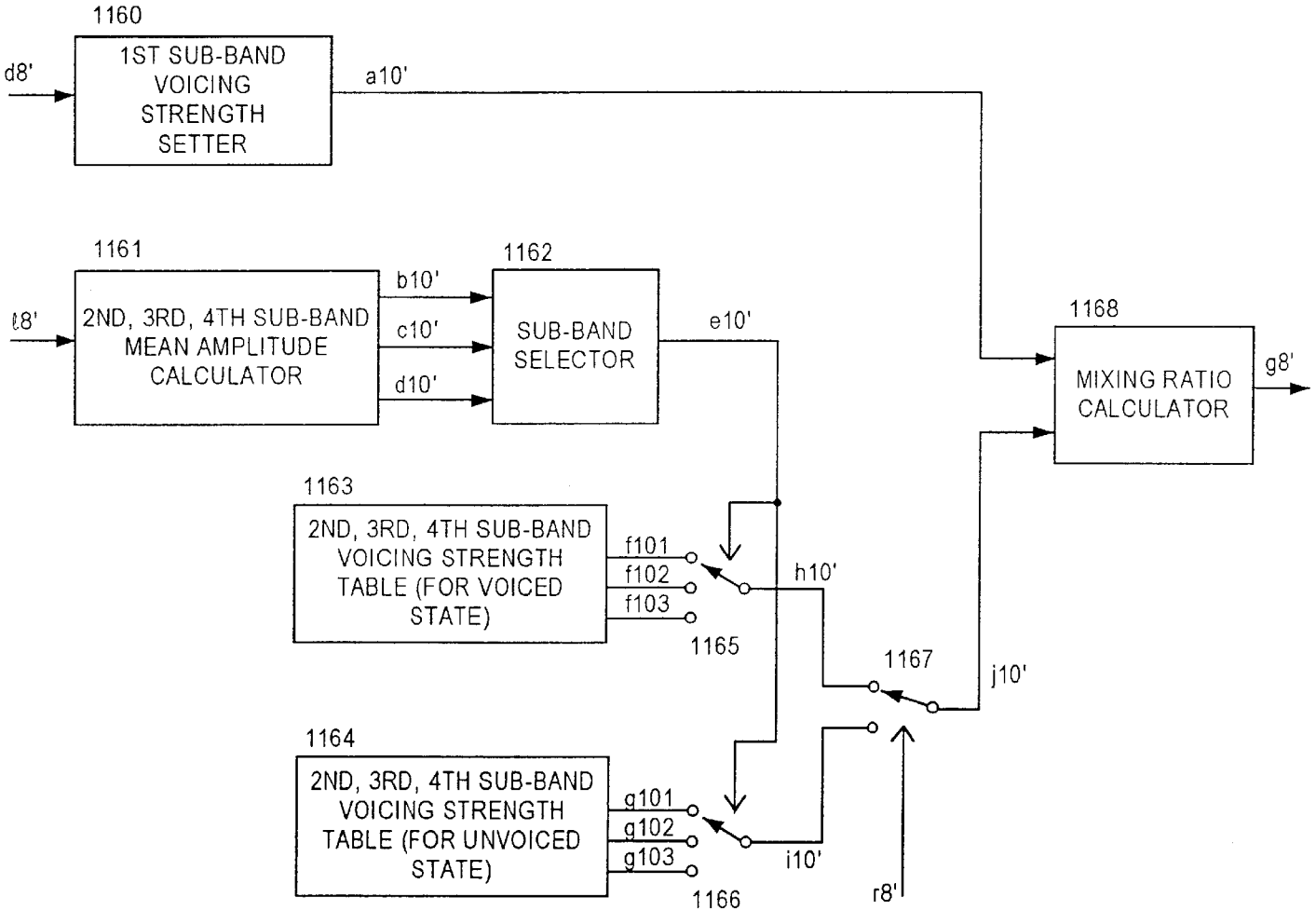
FIG. 14 is a block diagram showing the circuit arrangement of a pulse excitation/noise excitation mixing ratio calculator provided in the speech decoder of in accordance with the second embodiment of the present invention.

Next, the arrangement of a pulse excitation/noise excitation mixing ratio calculator 1134 will be explained with reference to FIG. 14.

Figure 10:
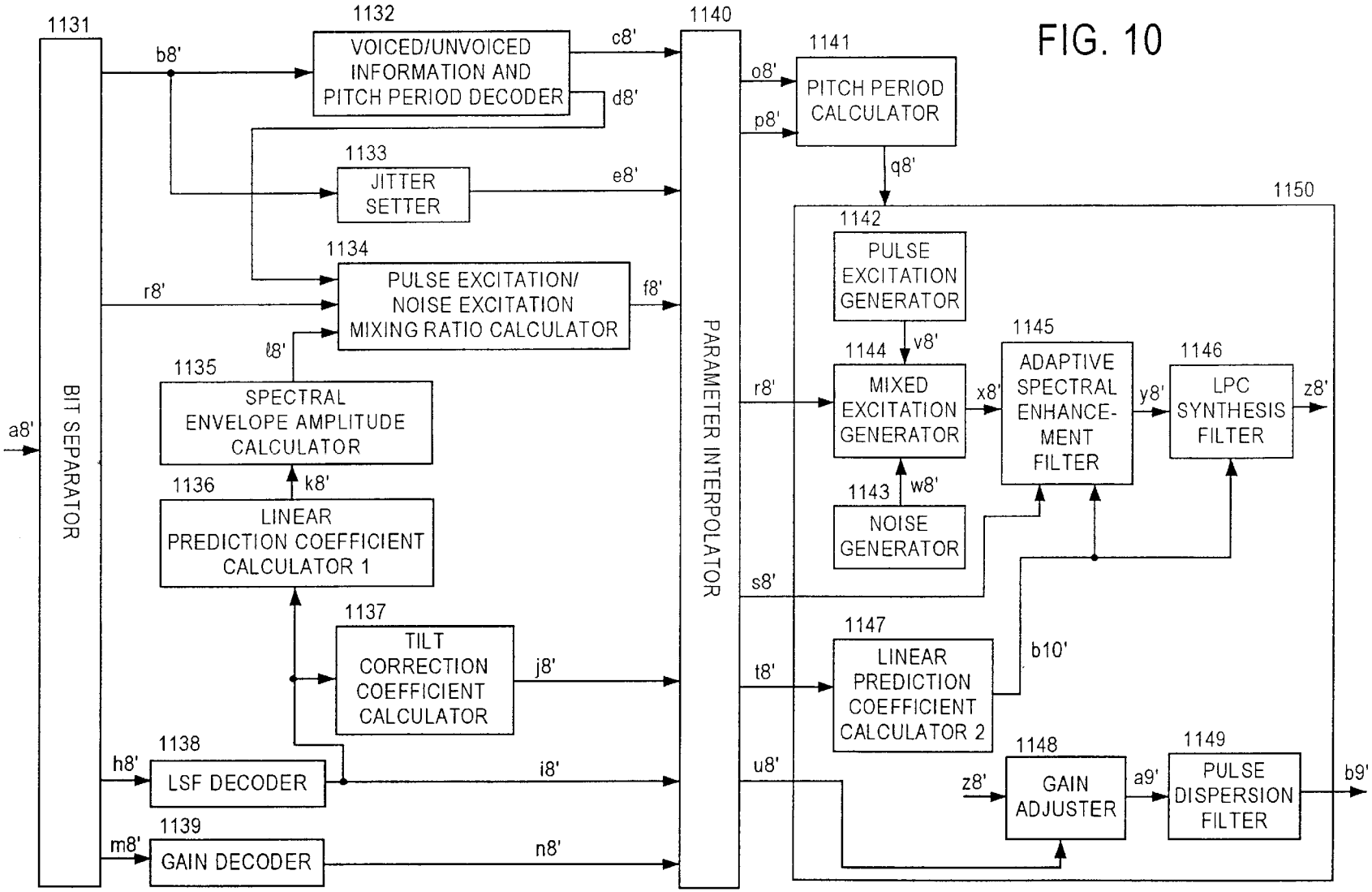
FIG. 10 is a block diagram showing the circuit arrangement of a second embodiment of a speech decoder employing the speech decoding method of the present invention.

The pulse excitation/noise excitation mixing ratio calculator 1134 receives the voiced/unvoiced flag d8', the spectral envelope amplitude l8', and the high frequency band voiced/unvoiced flag f8' shown in FIG. 10, and outputs a determined mixing ratio g8' in each frequency band (i.e., each sub-band).

According to the speech decoding method and its embodiment, the frequency region is divided into a total of four frequency bands. The mixing ratio of the pulse excitation to the noise excitation is determined for each frequency band to produce individual mixing signals for respective frequency bands. The mixed excitation signal is then produced by summing the produced mixing signals of respective frequency bands. The four frequency bands being set in this embodiment are $1^{st}$ sub band of 0–1,000 Hz, $2^{nd}$ sub-band of 1,000–2,000 Hz, $3^{rd}$ sub-band of 2,000–3,000 Hz, and $4^{th}$ sub-band of 3,000–4,000 Hz. The $1^{st}$ sub-band corresponds to the low frequency band, and the remaining $2^{nd}$ to $4^{th}$ sub-bands correspond to the high frequency band.

A $1^{st}$ sub-band voicing strength setter 1160 receives the voiced/unvoiced flag d8' to set a $1^{st}$ sub-band voicing strength a10' based on the voiced/unvoiced flag d8'. More specifically, the $1^{st}$ sub-band voicing strength setter 1160 sets the $1^{st}$ sub-band voicing strength a10' to 1.0 when the voiced/unvoiced flag d8' is 1.0, and sets the $1^{st}$ sub-band voicing strength a10' to 0 when the voiced/unvoiced flag d8' is 0.

A $2^{nd}/3^{rd}/4^{th}$ sub-band mean amplitude calculator 1161 receives the spectral envelope amplitude l8' to calculate a mean amplitude of the spectral envelope amplitude in each of the $2^{nd}$, $3^{rd}$ and $4^{th}$ sub-bands, and outputs the calculated mean amplitudes b10', c10' and d10'.

A sub-band selector 1162 receives the calculated mean amplitudes b10', c10' and d10' from the $2^{nd}/3^{rd}/4^{th}$ sub-band mean amplitude calculator 1161, and selects a sub-band number e10' indicating the sub-band having the largest mean spectral envelope amplitude.

A $2^{nd}/3^{rd}/4^{th}$ sub-band voicing strength table (for voiced state) 1163 stores a total of three 3-dimensional vectors f101, f102 and f103. Each of 3-dimensional vectors f101, f102 and f103 is constituted by the voicing strengths of the $2^{nd}$, $3^{rd}$, and $4^{th}$ sub-bands in the voiced frame.

A first switcher 1165 selectively outputs one vector h10' from the three 3-dimensional vectors f101, f102 and f103 in accordance with the sub-band number e10'.

Similarly, a $2^{nd}/3^{rd}/4^{th}$ sub-band voicing strength table (for unvoiced state) 1164 stores a total of three 3-dimensional vectors g101, g102 and g103. Each of 3-dimensional vectors g101, g102 and g103 is constituted by the voicing strengths of the $2^{nd}$, $3^{rd}$, and $4^{th}$ sub-bands in the unvoiced frame.

A second switcher 1166 selectively outputs one vector i10' from the three 3-dimensional vectors g101, g102 and g103 in accordance with the sub-band number e10'.

A third switcher 1167 receives the high frequency band voiced/unvoiced flag f8', and selects the vector h10' when the high frequency band voiced/unvoiced flag f8' indicates the voiced state and selects the vector i10' when the high frequency band voiced/unvoiced flag f8' indicates the unvoiced state. The third switcher 1167 outputs the selected vector as a $2^{nd}/3^{rd}/4^{th}$ sub-band voicing strength j10'.

As described above, the high-frequency band voiced/unvoiced flag w7' may not be transmitted. In such a case, the voiced/unvoiced flag d8' can be used instead of using the high-frequency band voiced/unvoiced flag w7'.

A mixing ratio calculator 1168 receives the $1^{st}$ sub-band voicing strength a10' and the $2^{nd}/3^{rd}/4^{th}$ sub-band voicing strength j10', and outputs the determined mixing ratio g8' in each frequency band. The mixing ratio g8' is constituted by sb1_p, sb2_p, sb3_p, and sb4_p representing the ratio of respective sub-bands' pulse excitations and sb1_n, sb2_n, sb3_n, and sb4_n representing the ratio of respective sub-bands' noise excitations. In the general expression sbx_y, "x" represents the sub-band number and "y" represents the excitation type: p=pulse excitation; and n=noise excitation. The $1^{st}$ sub-band voicing strength a10' and the $2^{nd}/3^{rd}/4^{th}$ sub-band voicing strength j10' are directly used as the values of sb1_p, sb2_p, sb3_p, and sb4_p. On the other hand, sbx_n (x=1, - - - , 4) is set to sbx_n=(1.0-sbx_p) (x=1, - - - , 4).

Next, the method of determining the $2^{nd}/3^{rd}/4^{th}$ sub-band voicing strength table (for voiced state) 1163 will be explained.

Figure 16:
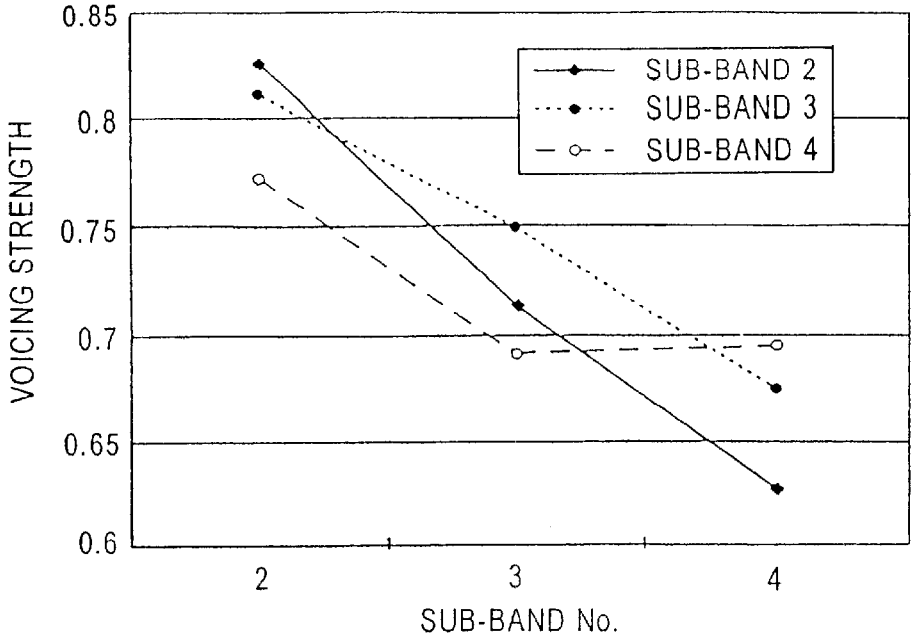
FIG. 16 is a graph explaining the voicing strength (in the voiced state) in the $2^{nd}$, $3^{rd}$, and $4^{th}$ sub-bands in accordance with the second embodiment of the present invention.

The values of this table are determined based on the voicing strength measuring result of the $2^{nd}$, $3^{rd}$, and $4^{th}$ sub-bands of the voiced frames shown in FIG. 16.

The measuring method of FIG. 16 is as follows.

The mean spectral envelope amplitude is calculated for the $2^{nd}$, $3^{rd}$, and $4^{th}$ sub-bands of each input speech frame (20 ms). The input frames are classified into three frame groups: i.e., a first frame group (referred to fg_sb2) consisting of the frames having the largest mean spectral envelope amplitude in the $2^{nd}$ sub-band, a second frame group (referred to fg_sb3) consisting of the frames having the largest mean spectral envelope amplitude in the $3^{rd}$ sub-band, and a third frame group (referred to fg_sb4) consisting of the frames having the largest mean spectral envelope amplitude in the $4^{th}$ sub-band. Next, the speech frames belonging to the frame group fg_sb2 are separated into sub-band signals corresponding to the $2^{nd}$, $3^{rd}$, and $4^{th}$ sub-bands. Then, a normalized auto-correlation function is obtained for each sub-band signal at the pitch period. Then, in each sub-band, an average of the calculated normalized auto-correlation functions is obtained.

The abscissa of FIG. 16 represents the sub-band number. As the normalized auto-correlation is a parameter showing the periodic strength of the input signal (i.e., the voice nature), the normalized auto-correlation represents the voicing strength. The ordinate of FIG. 16 represents the voicing strength (i.e., normalized auto-correlation) of each sub-band. In FIG. 16, a curve connecting ♦ points shows the measured result of the first frame group fg_sb2. A curve connecting ● points shows the measured result of the second frame group fg_sb3. And, a curve connecting ○ points shows the measured result of the third frame group fg_sb4. The input speech signals used in this measurement are collected from a speech database CD-ROM and FM broadcasting.

The measuring result of FIG. 16 shows the following tendency:

① In the ♦ or ● frames wherein the mean spectral envelope amplitude is maximized in the $2^{nd}$ or $3^{rd}$ sub-band, the voicing strength monotonously decreases with increasing sub-band frequency.

② In the ○ frames wherein the mean spectral envelope amplitude is maximized in the $4^{th}$ sub-band, the voicing strength does not monotonously decrease with increasing sub-band frequency. Instead, the voicing strength of the $4^{th}$ sub-band is relatively enhanced, and the voicing strength in the $2^{nd}$ and $3^{rd}$ sub-bands becomes weak (compared with the corresponding value of the ♦ or ● frames).

③ In the ♦ frames wherein the mean spectral envelope amplitude is maximized in the $2^{nd}$ sub-band, the voicing strength of the $2^{nd}$ sub-band is larger than the corresponding value of the ● or ○ frames. Similarly, in the ● frames wherein the mean spectral envelope amplitude is maximized in the $3^{rd}$ sub-band, the voicing strength of the $3^{rd}$ sub-band is larger than the corresponding value of the ● or ○ frames. Similarly, in the ○ frames wherein the mean spectral envelope amplitude is maximized in the $4^{th}$ sub-band, the voicing strength of the $4^{th}$ sub-band is larger than the corresponding value of the ♦ or ● frames.

Accordingly, the $2^{nd}/3^{rd}/4^{th}$ sub-band voicing strength table (for voiced state) 1163 stores the voicing strengths of the ♦-, ●- and ○-curves as the 3-dimensional vectors f101, f102 and f103, respectively. One of the memorized 3-dimensional vectors f101, f102 and f103 is selected based on the sub-band number e10 indicating the sub-band having the largest mean spectral envelope amplitude. Thus, it becomes possible to set an appropriate voicing strength in accordance with the spectral envelope amplitude. Table 10 shows the detailed contents of the $2^{nd}/3^{rd}/4^{th}$ sub-band voicing strength table (for voiced state) 1163.

TABLE 10

2nd/3rd/4th Sub-band Voicing Strength Table (for Voiced state)

| | voicing strength | | |
|---|---|---|---|
| vector number | 2nd sub-band | 3rd sub-band | 4th sub-band |
| f101 | 0.825 | 0.713 | 0.627 |
| f102 | 0.81 | 0.75 | 0.67 |
| f103 | 0.773 | 0.691 | 0.695 |

Figure 17:
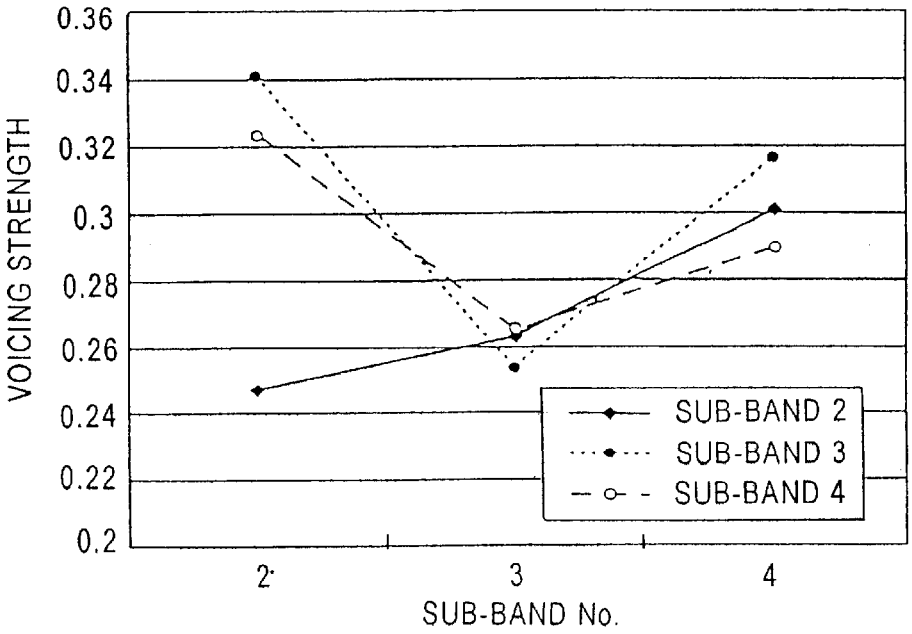
FIG. 17 is a graph explaining the voicing strength (in the unvoiced state) in the $2^{nd}$, $3^{rd}$, and $4^{th}$ sub-bands in accordance with the second embodiment of the present invention.
Figure 18:
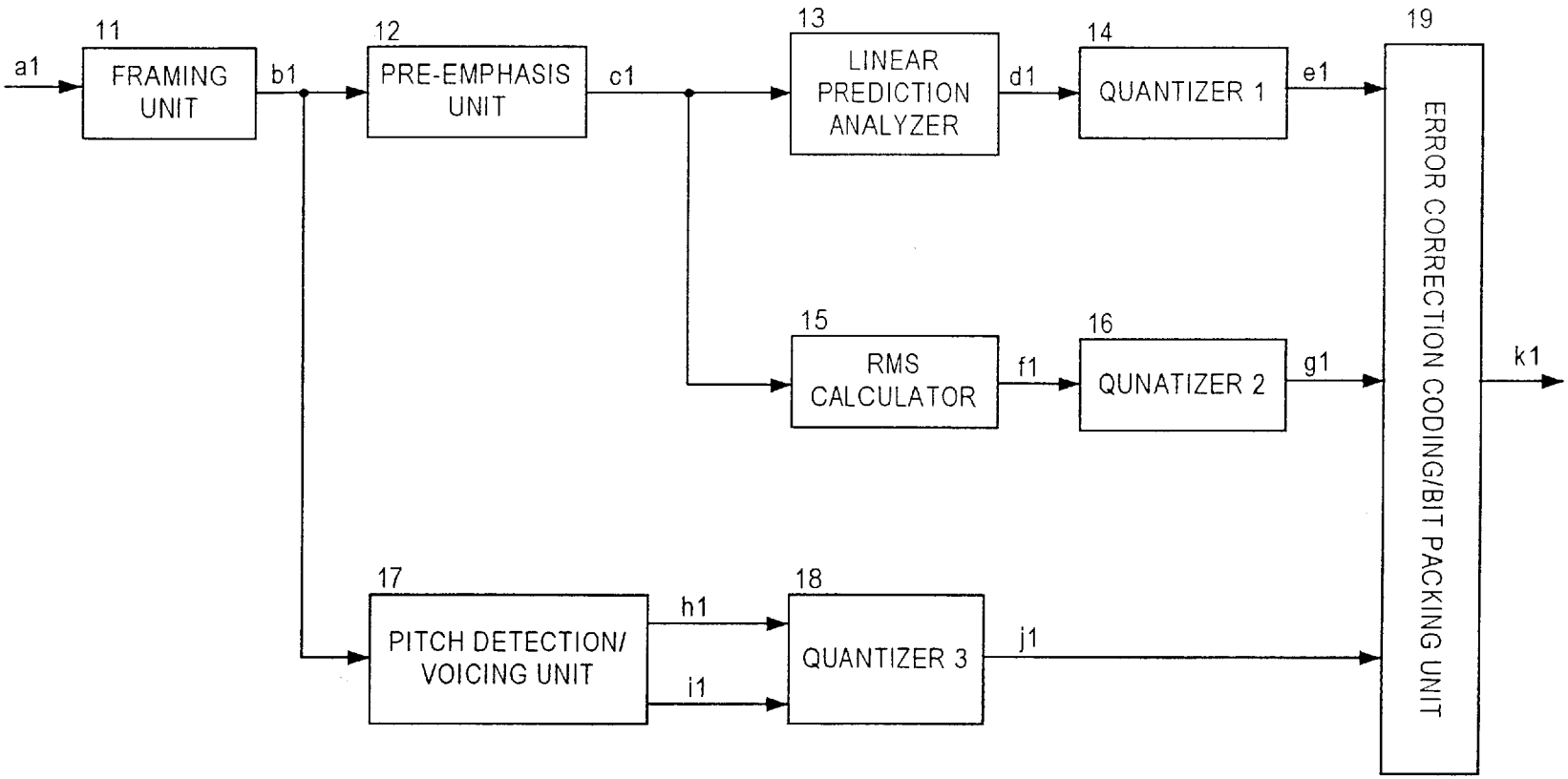
FIG. 18 (PRIOR ART)
FIG. 18 is a block diagram showing the circuit arrangement of a conventional speech encoder in the LPC system.
Figure 19:
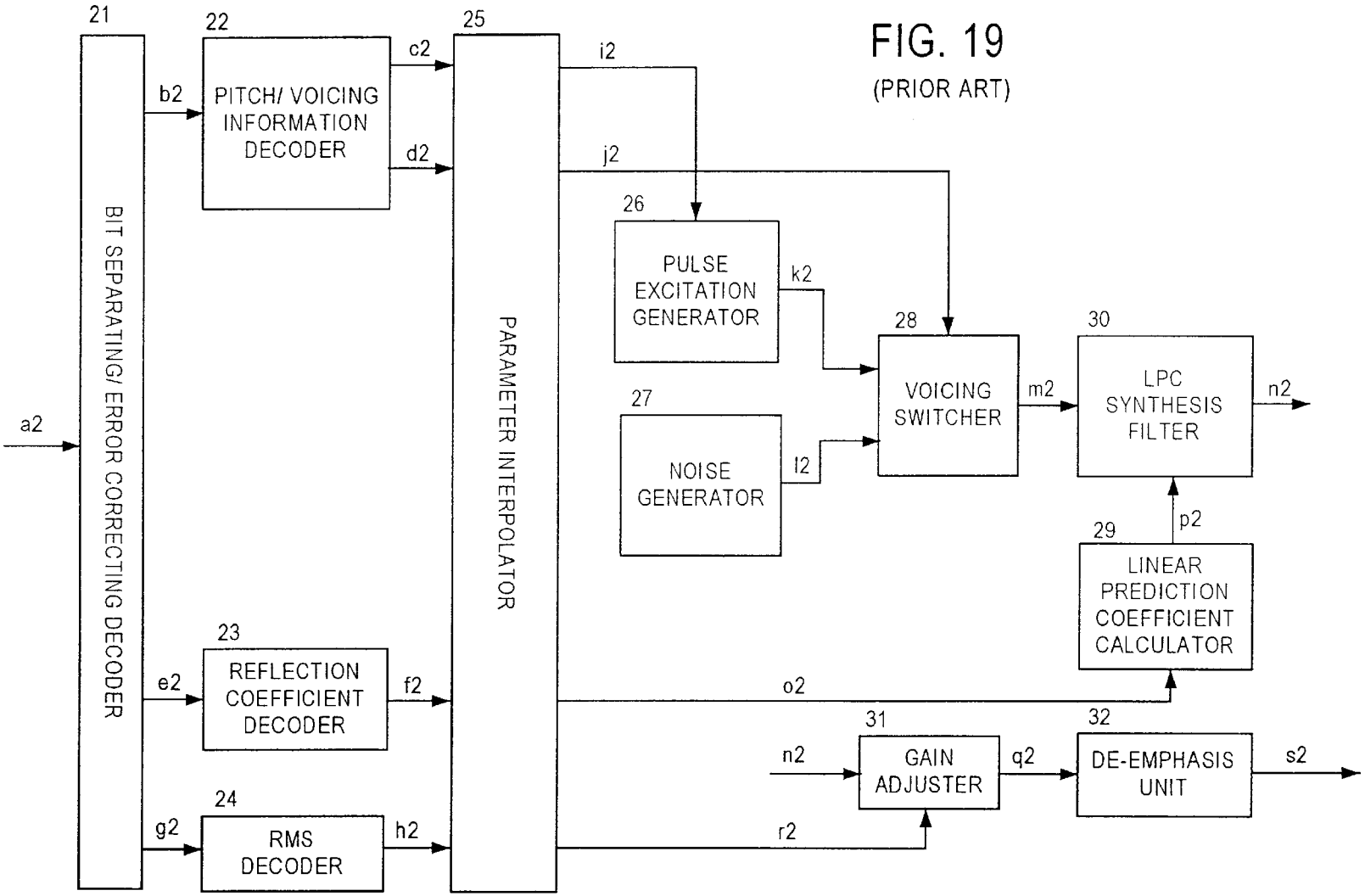
FIG. 19 (PRIOR ART)
FIG. 19 is a block diagram showing the circuit arrangement of a conventional speech decoder in the LPC system.
Figure 20:
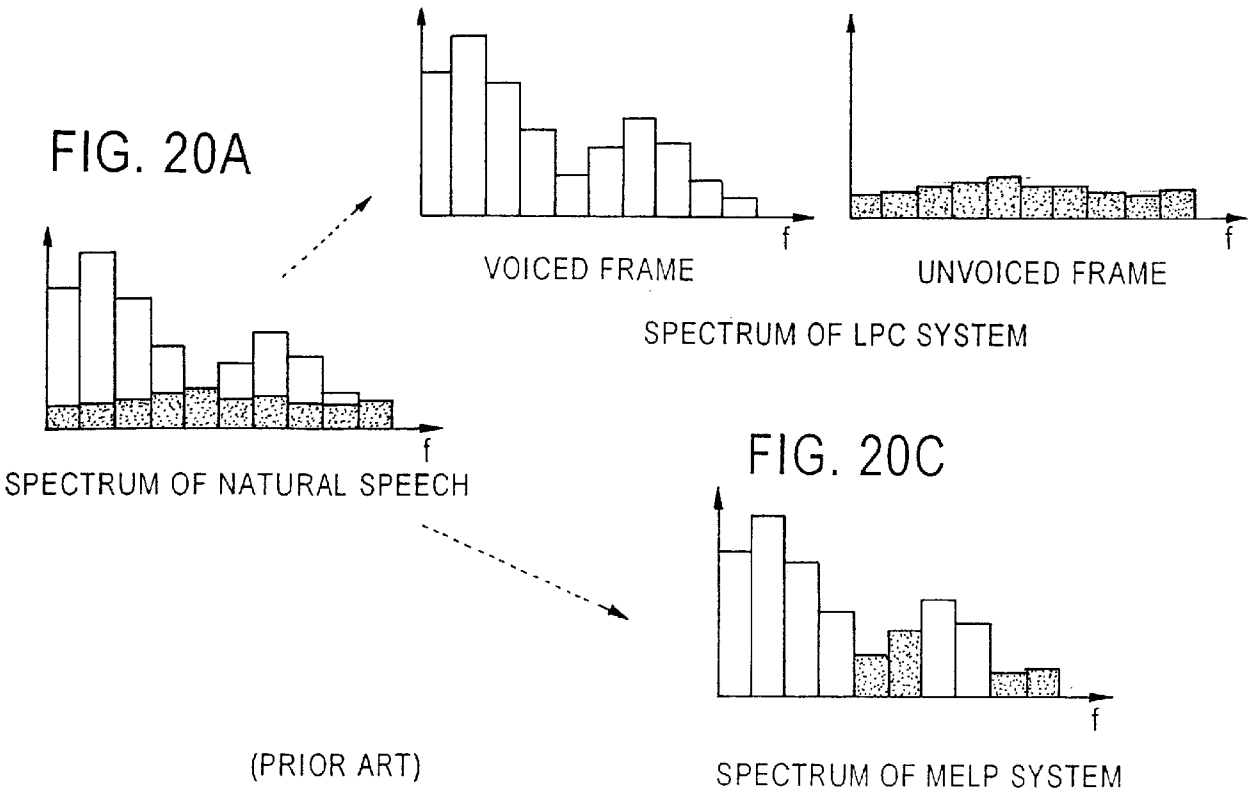
FIGS. 20A to 20C are views explaining the spectrums in the LPC system and the MELP system.
Figure 21:
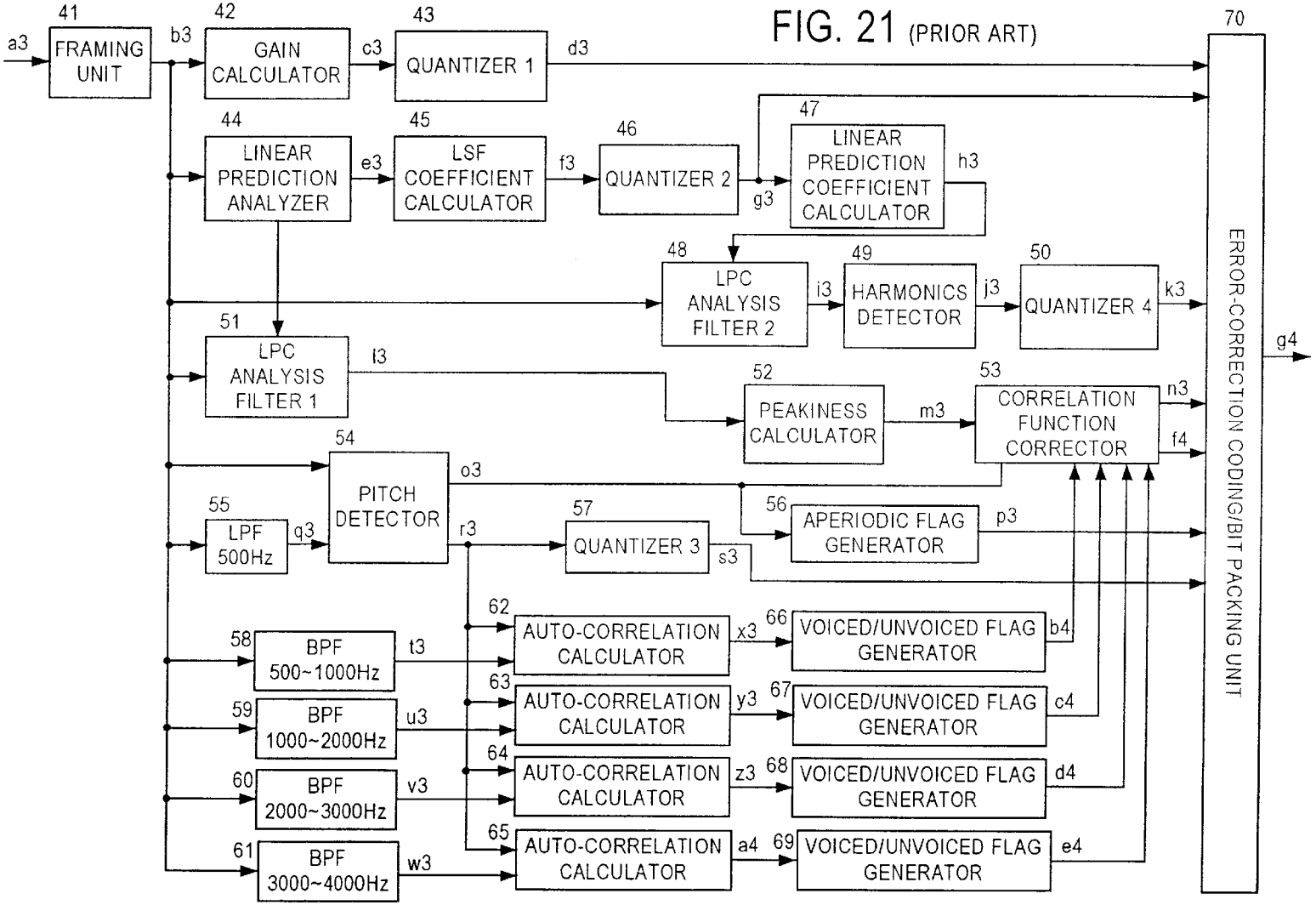
FIG. 21 (PRIOR ART)
FIG. 21 is a block diagram showing the circuit arrangement of a conventional speech encoder in the MELP system.
Figure 22:
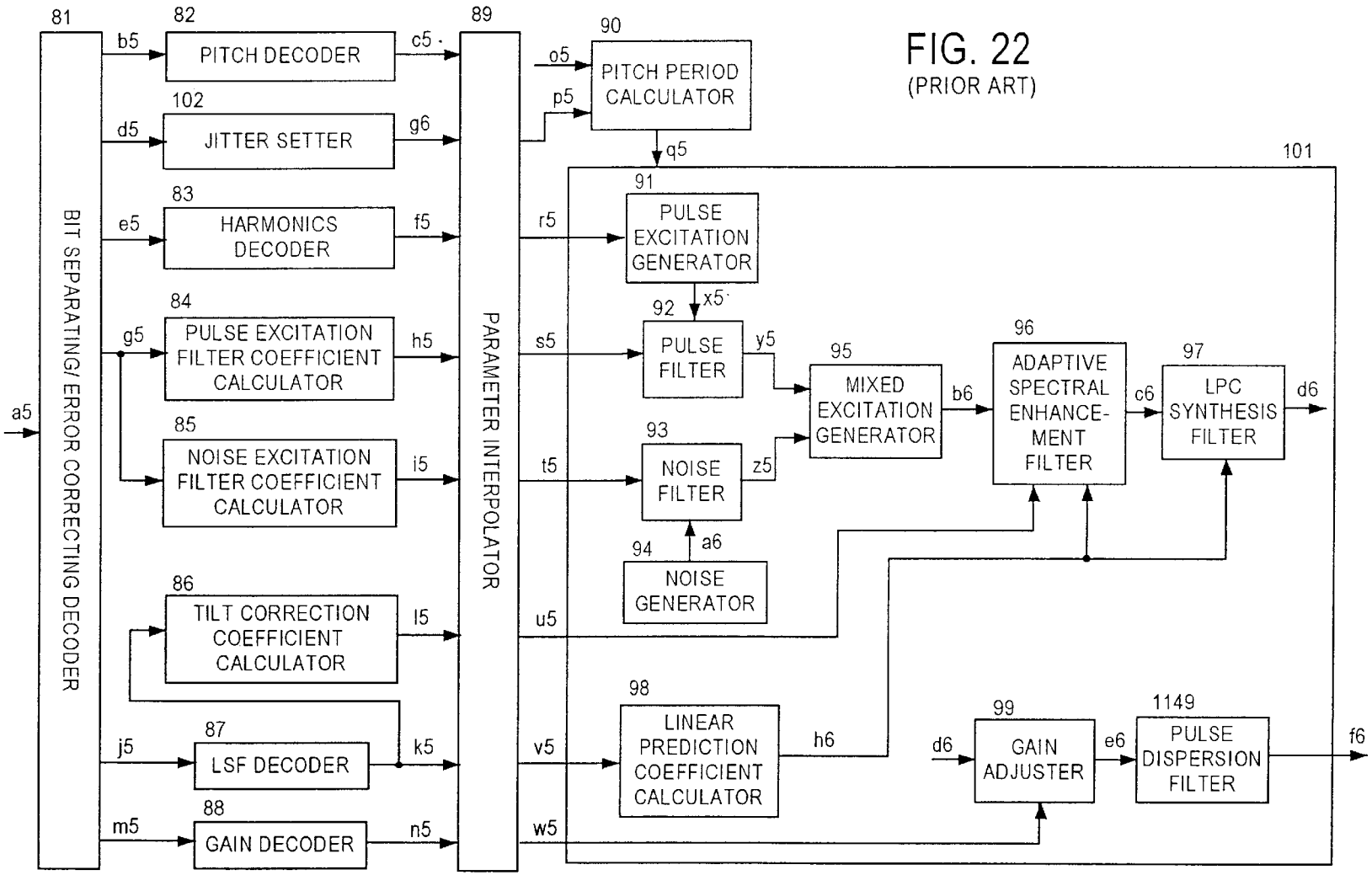
FIG. 22 (PRIOR ART)
FIG. 22 is a block diagram showing the circuit arrangement of a conventional speech decoder in the MELP system.

The $2^{nd}/3^{rd}/4^{th}$ sub-band voicing strength table (for unvoiced state) 1164 is determined based on the voicing strength measuring result of the $2^{nd}$, $3^{rd}$, and $4^{th}$ sub-bands in the unvoiced frames shown in FIG. 17. The measuring method of FIG. 17 and the determining method of the table contents are substantially the same as those of the above-described $2^{nd}/3^{rd}/4^{th}$ sub-band voicing strength table (for voiced state) 1163. The measuring result of FIG. 17 shows the following tendency:

① In the ♦ frames wherein the mean spectral envelope amplitude is maximized in the $2^{nd}$ sub-band, the voicing strength of the $2^{nd}$ sub-band is smaller than the corresponding value of the ● or ○ frames. Similarly, in the ● frames wherein the mean spectral envelope amplitude is maximized in the $3^{rd}$ sub-band, the voicing strength of the $3^{rd}$ sub-band is smaller than the corresponding value of the ♦ or ○ frames. Similarly, in the ○ frames wherein the mean spectral envelope amplitude is maximized in the $4^{th}$ sub-band, the voicing strength of the $4^{th}$ sub-band is smaller than the corresponding value of the ♦ or ● frames. Table 11 shows the detailed contends of the $2^{nd}/3^{rd}/4^{th}$ sub-band voicing strength table (for unvoiced state) 1164.

TABLE 11

2nd/3rd/4th Sub-band Voicing Strength Table (for Unvoiced state)

| | voicing strength | | |
|---|---|---|---|
| vector number | 2nd sub-band | 3rd sub-band | 4th sub-band |
| g101 | 0.247 | 0.263 | 0.301 |
| g102 | 0.34 | 0.253 | 0.317 |
| g103 | 0.324 | 0.266 | 0.29 |

Returning FIG. 10, a parameter interpolator 1140 linearly interpolates each of input parameters, i.e., pitch period c8, jitter value e8', mixing ratio g8', tilt correction coefficient j8', LSF coefficient i8', and gain n8', in synchronism with the pitch period. The parameter interpolator 1140 outputs the interpolated outputs corresponding to respective input parameters: i.e., interpolated pitch period o8', interpolated jitter value p8', interpolated mixing ratio r8', interpolated tilt correction coefficient s8', interpolated LSF coefficient t8', and interpolated gain u8'. The linear interpolation processing is performed in accordance with the following formula:

interpolated parameter=current frame's parameter×int+previous frame's parameter×(1.0−int)

In this formula, the above input parameters c8', e8', g8', j8', i8', and n8' are the current frame's parameters. The above output parameters o8', p8', r8', s8', t8', and u8' are the interpolated parameters. The previous frame's parameters are the parameters c8', e8', g8', j8', i8', and n8' in the previous frame which are stored. Furthermore, "int" is an interpolation coefficient which is defined by the following formula:

int=t0/160 where 160 is the sample number per speech decoding frame interval (20 ms), while "t0" is a start sample point of each pitch period in the decoded frame and is renewed by adding the pitch period in response to every decoding of the reproduced speech of one pitch period. When "t0" exceeds 160, it means that the decoding processing of the decoded frame is accomplished. Thus, "t0" is initialized by subtracting 160 from it upon accomplishment of the decoding processing of each fame. When the interpolation coefficient "int" is fixed to 1.0, the linear interpolation processing is not performed in synchronism with the pitch period.

A pitch period calculator 1141 receives the interpolated pitch period o8' and the interpolated jitter value p8' and calculates a pitch period q8' according to the following formula:

pitch period q8'=pitch period o8'×(1.0−jitter value p8'×random number)

where the random number falls within a range from −1.0 to 1.0.

As the pitch period q8' has a fraction, the pitch period q8' is converted into an integer by counting the fraction over ½ as one and disregarding the rest. The pitch period q8' thus converted into an integer is referred to as integer pitch period q8', hereinafter. According to the above formula, a significant jitter is added to the unvoiced or aperiodic frame because a predetermined jitter value (e.g., 0.25) is set to the unvoiced or aperiodic frame. On the other hand, no jitter is added to the perfect periodic frame because the jitter value 0 is set to the perfect periodic frame. However, as the jitter value is interpolated for each pitch, the jitter value may be a value somewhere in a range from 0 to 0.25. This means that the pitch sections having intermediate jitter values may exist.

In this manner, generating the aperiodic pitch (i.e., jitter-added pitch) makes it possible to express an irregular (i.e., aperiodic) glottal pulse caused in the transitional period or unvoiced plosives as described in the explanation of the MELP system. Thus, the tone noise can be reduced.

A 1-pitch waveform decoder 1150 decodes and outputs a reproduced speech b9' for every pitch period q8'. Accordingly, all of blocks included in the 1-pitch waveform decoder 1150 operate in synchronism with the pitch period q8'.

A pulse excitation generator 1142 outputs a single pulse signal v8' within a duration of the integer pitch period q8'. A noise generator 1143 outputs white noise w8' having an interval of the integer pitch period q8'. A mixed excitation generator 1144 mixes the single pulse signal v8' and the white noise w8' based on the interpolated mixing ratio r8' of each sub-band, and outputs a mixed excitation signal x8'.

Figure 15:
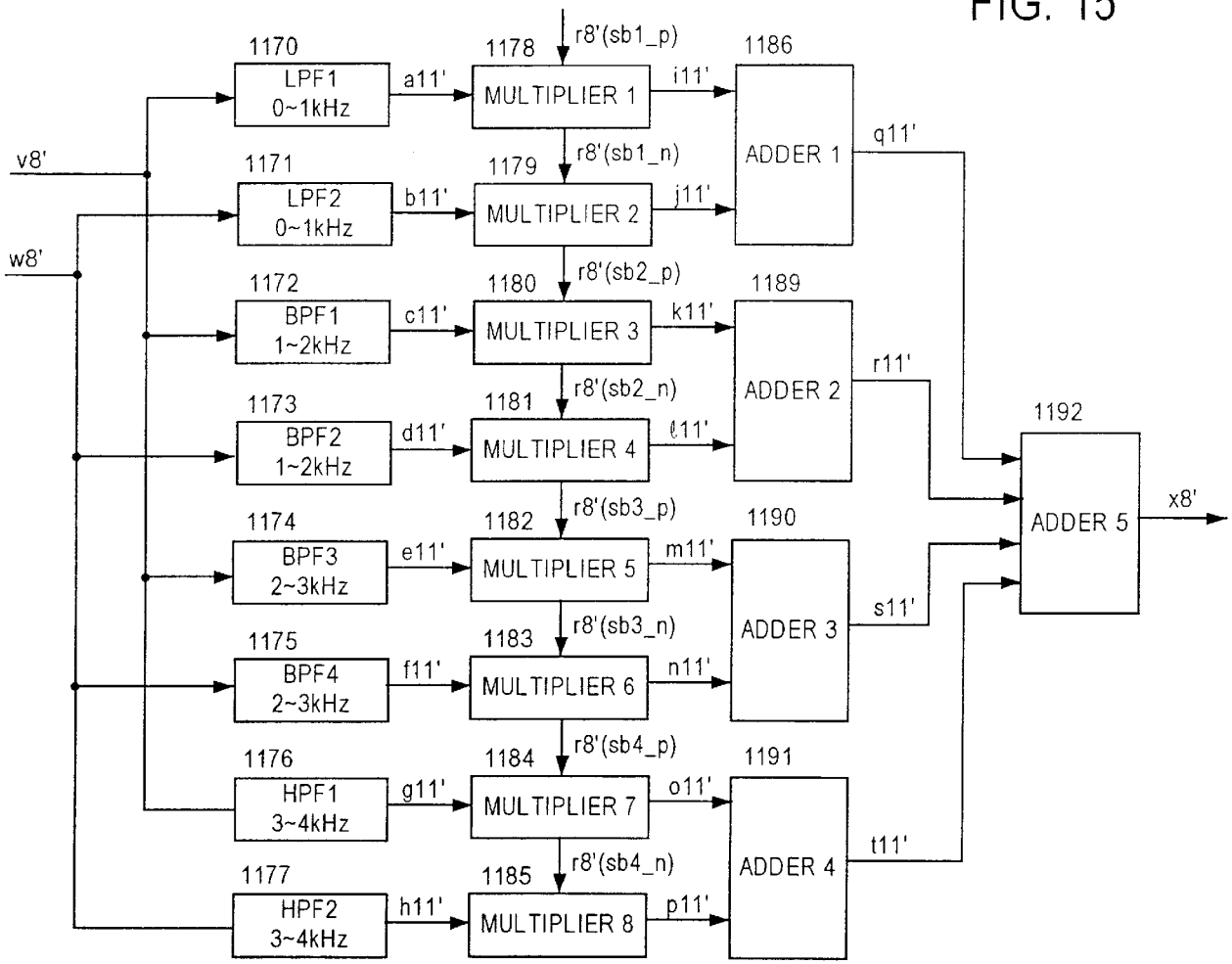
FIG. 15 is a block diagram showing the circuit arrangement of a mixed excitation generator provided in the speech decoder of in accordance with the second embodiment of the present invention.

FIG. 15 is a block diagram showing the circuit arrangement of the mixed excitation generator 1144. First, the mixed excitation signal q11' of the $1^{st}$ sub-band is produced in the following manner. A first low pass filter (i.e., LPF1) 1170 receives the single pulse signal v8' and generates an output all' being bandpass-limited to the frequency range of 0 to 1 kHz. A second low pass filter (i.e., LPF2) 1171 receives the white noise w8' and generates an output b11' being bandpass-limited to the frequency range of 0 to 1 kHz. A first multiplier 1178 multiplies the bandpass-limited output a11' with sb1_p involved in the mixing ratio information r8' to generate an output i11'. A second multiplier 1179 multiplies the bandpass-limited output b11' with sb1_n involved in the mixing ratio information r8' to generate an output j11'. A first adder 1186 sums the outputs i11' and j11' to generate a $1^{st}$ sub-band mixing signal q11'.

Similarly, a $2^{nd}$ sub-band mixing signal r11' is produced by using a first band pass filter (i.e., BPF1) 1172, a second band pass filter (i.e., BPF2) 1173, a third multiplier 1180, a fourth multiplier 1181, and a second adder 1189.

Similarly, a $3^{rd}$ sub-band mixing signal s11' is produced by using a third band pass filter (i.e., BPF3) 1174, a fourth band pass filter (i.e., BPF4) 1175, a fifth multiplier 1182, a sixth multiplier 1183, and a third adder 1190.

Similarly, a $4^{th}$ sub-band mixing signal t11' is produced by using a first high pass filter (i.e., HPF1) 1176, a second high pass filter (i.e., HPF2) 1177, a seventh multiplier 1184, an eighth multiplier 1185, and a fourth adder 1191.

A fifth adder 1192 sums all of $1^{st}$ sub-band mixing signal q11', $2^{nd}$ sub-band mixing signal r11', $3^{rd}$ sub-band mixing signal s11', and $4^{th}$ sub-band mixing signal t11' to generate a mixed excitation signal x8'.

In FIG. 10, a second linear prediction coefficient calculator 1147 converts the interpolated LSF coefficient t8' into a linear prediction coefficient, and outputs a linear prediction coefficient b10'. An adaptive spectral enhancement filter 1145 is a cascade connection of an adaptive pole/zero filter with a coefficient obtained by applying the bandwidth expansion processing to the linear prediction coefficient b10' and a spectral tilt correcting filter with a coefficient equal to the interpolated tilt correction coefficient s8'. As shown in Table 2-③, this enhances the naturalness of the reproduced speech by sharpening the formant resonance and also by improving the similarity to the formant of the natural speech. Furthermore, the lowpass muffling effect can be reduced by correcting the tilt of the spectrum by the spectral tilt correcting filter with the coefficient equal to the interpolated tilt correction coefficient s8'.

The adaptive spectral enhancement filter 1145 filters the mixed excitation signal x8' and outputs a filtered excitation signal y8'.

An LPC synthesis filter 1146 is an all-pole filter with a coefficient equal to the linear prediction coefficient b10'. The LPC synthesis filter 1146 adds the spectral envelope information to the filtered excitation signal y8', and outputs a resulting signal z8'. A gain adjuster 1148 applies the gain adjustment to the output signal z8' of the LPC synthesis filter 1146 by using the interpolated gain information u8', and outputs a gain-adjusted signal a9'. A pulse dispersion filter 1149 is a filter for improving the similarity of the pulse excitation waveform with respect to the glottal pulse waveform of the natural speech. The pulse dispersion filter 1149 filters the output signal a9' of the gain adjuster 1148 and outputs the reproduced speech b9' having improved naturalness. The effect of the pulse dispersion filter 1149 is shown in Table 2-④.

Although the mixing ratio is determined by identifying the sub-band wherein the mean spectral envelope amplitude is maximized in the above-description, it is not always necessary to use the mean spectral envelope amplitude as the standard value. Thus, the mean spectral envelope amplitude can be replaced by other value.

Furthermore, the above-described speech coding apparatus and speech decoding apparatus of the present invention can be easily realized by a DSP (i.e., Digital Signal Processor).

Furthermore, instead of using the high-frequency band voiced/unvoiced flag f8', the voiced/unvoiced flag d8' can be used as the control signal of the third switcher 1167 in the above-described pulse excitation/noise excitation mixing ratio calculator. In such a case, the present invention can be realized on the speech encoder conventionally used for the LPC system.

Moreover, the number of the above-described quantization levels, the bit number of codewords, the speech coding frame interval, the order of the linear prediction coefficient or the LSF coefficient, and the cutoff frequency of each filter are not limited to the disclosed specific values and therefore can be modified appropriately.

As described above, by using the speech coding and decoding method and apparatus of the second embodiment, it becomes possible to reduce the buzz sound. Thus, the present invention can improve the sound quality by solving the problems in the conventional LPC system, i.e., deterioration of the sound quality due to the buzz sound. Furthermore, the present invention can reduce the coding speed compared with that of the conventional MELP system. Accordingly, in the radio communications, it becomes possible to more effectively utilize the limited frequency resource.

What is claimed is:

1. A speech decoding method for reproducing a speech signal from a speech information bit stream which is a coded output of the speech signal that has been encoded by a linear prediction analysis and synthesis type speech encoder, said speech decoding method comprising the steps of:

separating spectral envelope information, voiced/unvoiced discriminating information, pitch period information and gain information from said speech information bit stream, whereby forming a plurality of separated informations, and decoding each separated information;

obtaining a spectral envelope amplitude from said spectral envelope information, and identifying a frequency band having a largest spectral envelope amplitude among a predetermined number of frequency bands each having a predetermined frequency bandwidth divided on a frequency axis for generating a mixed excitation signal;

determining a mixing ratio for each of said predetermined number of frequency bands, based on said identified frequency band and said voiced/unvoiced discriminating information and using said mixing ratio to mix a pitch pulse generated in response to said pitch period information and white noise with reference to a predetermined mixing ratio table that has previously been stored;

producing a mixing signal for each of said predetermined number of frequency bands based on said determined mixing ratio, and then producing said mixed excitation signal by summing all of said mixing signals of said predetermined number of frequency bands; and producing a reproduced speech by adding said spectral envelope information and said gain information to said mixed excitation signal.

2. A speech decoding method for reproducing a speech signal from a speech information bit stream, including spectral envelope information, low-frequency band voiced/unvoiced discriminating information, high-frequency band voiced/unvoiced discriminating information, pitch period information and gain information, which is a coded output of the speech signal encoded by a linear prediction analysis and synthesis type speech encoder, said speech decoding method comprising the steps of:

separating said spectral envelope information, low-frequency band voiced/unvoiced discriminating information, high-frequency band voiced/unvoiced discriminating information, pitch period information and gain information from said speech information bit stream whereby forming a plurality of separated informations, and decoding each separated information;

determining a mixing ratio of the low-frequency band based on said low-frequency band voiced/unvoiced discriminating information, using said mixing ratio to mix a pitch pulse generated in response to said pitch period information and white noise for the low-frequency band, and producing a mixing signal for the low-frequency band;

obtaining a spectral envelope amplitude from said spectral envelope information, and identifying a frequency band having a largest spectral envelope amplitude among a predetermined number of high-frequency bands each having a predetermined frequency bandwidth divided on a frequency axis for generating a mixed excitation signal;

determining a mixing ratio for each of said predetermined number of high-frequency bands based on said identified frequency band and said high-frequency band voiced/unvoiced discriminating information, using said mixing ratio to mix the pitch pulse generated in response to said pitch period information and white noise for each of said high-frequency bands with reference to a predetermined mixing ratio table that has previously been stored, producing a mixing signal of each of said predetermined number of high-frequency bands, and producing a mixing signal for the high-frequency band corresponding to a summation of all of the mixing signals of said predetermined number of high-frequency bands;

producing said mixed excitation signal by summing said mixing signal for the low-frequency band and said mixing signal for the high-frequency band; and producing a reproduced speech by adding said spectral envelope information and said gain information to said mixed excitation signal.

3. The speech decoding method in accordance with claim 2, wherein said predetermined number of high-frequency bands are separated into three frequency bands, and where said high-frequency band voiced/unvoiced discriminating information indicates a voiced state, setting said previously stored predetermined mixing ratio table in the following manner:

when the spectral envelope amplitude is maximized in the first or second lowest frequency band, the ratio of pitch pulse (hereinafter, referred to as "voicing strength") monotonously decreases with increasing frequency of each of said predetermined number of high-frequency bands; and when the spectral envelope amplitude is maximized in the highest frequency band, the ratio of pitch pulse for the second lowest frequency band is smaller than the voicing strength for the first lowest frequency band while the voicing strength for the highest frequency band is larger than the ratio of pitch pulse for the second lowest frequency band.

4. The speech decoding method in accordance with claim 2, wherein said predetermined number of high-frequency bands are separated into three frequency bands, and where said high-frequency band voiced/unvoiced discriminating information indicates a voiced state, setting said previously stored predetermined mixing ratio table in such a manner that:

a voicing strength of one of three frequency bands, when the spectral envelope amplitude is maximized in said one of three frequency bands, is larger than a corresponding voicing strength of said one of three frequency bands in a case where the spectral envelope amplitude of other two frequency bands is maximized.

5. The speech decoding method in accordance with claim 2, wherein said predetermined number of high-frequency bands are separated into three frequency bands, and where said high-frequency band voiced/unvoiced discriminating information indicates an unvoiced state, setting said previously stored determined mixing ratio table in such a manner that:

a voicing strength of one of three frequency bands, when the spectral envelope amplitude is maximized in said one of three frequency bands, is smaller than a corresponding voicing strength of said one of three frequency bands in a case where the spectral envelope amplitude of other two frequency bands is maximized.

6. A speech decoding method for reproducing a speech signal from a speech information bit stream, including spectral envelope information, low-frequency band voiced/unvoiced discriminating information, high-frequency band voiced/unvoiced discriminating information, pitch period information and gain information, which is a coded output of a tile speech signal encoded by a linear prediction analysis and synthesis type speech encoder, said speech decoding method comprising the steps of:

separating each of said spectral envelope information, said low-frequency band voiced/unvoiced discriminating information, said high-frequency band voiced/unvoiced discriminating information, said pitch period information and said gain information from said speech information bit stream into a plurality of separated informations, and decoding each separated information;

determining a mixing ratio of the low-frequency band based on said low-frequency band voiced/unvoiced discriminating information, using said mixing ratio to mix a pitch pulse generated in response to said pitch period information being linearly interpolated in synchronism with the pitch period and white noise for the low-frequency band;

obtaining a spectral envelope amplitude from said spectral envelope information, and identifying a frequency band having a largest spectral envelope amplitude among a predetermined number of high-frequency bands each having a predetermined frequency bandwidth divided on a frequency axis for generating a mixed excitation signal;

determining a mixing ratio for each of said predetermined number of high-frequency bands based on said identified frequency band and said high-frequency band voiced/unvoiced discriminating information, using said mixing ratio to mix the pitch pulse generated in response to said pitch period information being linearly interpolated in synchronism with the pitch period and white noise for each of said predetermined number of high-frequency bands with reference to a predetermined mixing ratio table that had previously been stored;

linearly interpolating said spectral envelope information, said pitch period information, said gain information, said mixing ratio of the low-frequency band, said mixing ratio of each of said predetermined number of high-frequency bands, in synchronism with the pitch period;

producing a mixing signal for the low-frequency band by mixing said pitch pulse and said white noise with reference to the interpolated mixing ratio of the low-frequency band;

producing a mixing signal of each of said predetermined number of high-frequency bands by mixing said pitch pulse and said white noise with reference to the interpolated mixing ratio for each of said predetermined number of high-frequency bands, and then producing a mixing signal for the high-frequency band corresponding to a summation of all of the mixing signals of said predetermined number of high-frequency bands;

producing a mixed excitation signal by summing said mixing signal for the low-frequency band and said mixing signal for the high-frequency band; and producing a reproduced speech by adding said interpolated spectral envelope information and said interpolated gain information to said mixed excitation signal.

* * * * *